US012722876B2

(12) United States Patent
Fosse et al.

(10) Patent No.: US 12,722,876 B2
(45) Date of Patent: Sep. 1, 2026

(54) EGG TRAY

(71) Applicant: Curio Products, Inc., Cambridge, MN (US)

(72) Inventors: Jonathon Fosse, Cambridge, MN (US); Daniel K. Fosse, Cambridge, MN (US)

(73) Assignee: Curio Products, Inc., Cambridge, MN (US)

( * ) Notice: Subject to any disclaimer, the term of this patent is extended or adjusted under 35 U.S.C. 154(b) by 0 days.

(21) Appl. No.: 19/265,997

(22) Filed: Jul. 10, 2025

(65) Prior Publication Data

US 2026/0015157 A1 Jan. 15, 2026

Related U.S. Application Data

(60) Provisional application No. 63/669,501, filed on Jul. 10, 2024.

(51) Int. Cl.
*B65D 85/32* (2006.01)
*B65D 43/02* (2006.01)
*B65D 81/26* (2006.01)

(52) U.S. Cl.
CPC ..... *B65D 85/32* (2013.01); *B65D 43/0214* (2013.01); *B65D 81/263* (2013.01); *B65D 2543/00027* (2013.01); *B65D 2543/00527* (2013.01)

(58) Field of Classification Search
CPC .. B65D 85/32; B65D 43/0214; B65D 81/263; B65D 85/328
USPC ..... 206/521.1, 521.8; 220/508
See application file for complete search history.

(56) References Cited

U.S. PATENT DOCUMENTS

| | | | | |
|---|---|---|---|---|
| 3,462,020 | A * | 8/1969 | Hall | A47F 5/112 206/419 |
| 3,493,164 | A | 2/1970 | Edwards | |
| 4,205,777 | A * | 6/1980 | Brown | B65D 85/324 206/521.1 |
| 4,657,173 | A | 4/1987 | Lake | |
| 6,354,435 | B1 * | 3/2002 | Belden, Jr. | G11B 33/0427 206/308.1 |
| 10,227,157 | B2 | 3/2019 | Kuruvilla et al. | |
| 2011/0180446 | A1 * | 7/2011 | Kidd | B65D 85/34 206/509 |
| 2013/0126384 | A1 * | 5/2013 | Ogg | B65D 21/0235 53/473 |
| 2015/0028034 | A1 * | 1/2015 | Bodmer | B65D 43/22 220/826 |
| 2020/0062494 | A1 * | 2/2020 | Bergeron | B65D 43/162 |
| 2020/0198879 | A1 * | 6/2020 | Schein | B65D 85/324 |
| 2023/0159262 | A1 | 5/2023 | Lichtle et al. | |

FOREIGN PATENT DOCUMENTS

| | | |
|---|---|---|
| AU | 7478587 A | 1/1989 |
| GB | 446118 A | 4/1936 |

* cited by examiner

*Primary Examiner* — Steven A. Reynolds
(74) *Attorney, Agent, or Firm* — Kinney & Lange, P.A.

(57) ABSTRACT

An egg tray includes a base that includes a plurality of cells, a plurality of posts between the plurality of cells, and a rim extending around an upper perimeter of the base. The egg tray further includes a lid configured to be releasably engaged on the base by snapping the lid onto the base, so that the lid is snapped onto at least one of the plurality of posts and under the rim of the base.

19 Claims, 38 Drawing Sheets

EGG TRAY

CROSS-REFERENCE TO RELATED APPLICATION(S)

This application claims priority to U.S. Provisional Application No. 63/669,501, filed on Jul. 10, 2024, and entitled "Egg Tray," the disclosure of which is incorporated by reference in its entirety.

BACKGROUND

The present disclosure relates to food containers, and in particular, to an egg tray.

Traditional egg cartons have a clamshell configuration with a bottom portion and a top portion connected with a hinge. Eggs are positioned in the bottom portion of the tray and extend partially out of the bottom portion of the tray. The top portion can be folded over the bottom portion of the tray and the eggs, and secured to the bottom portion of the tray to close the egg carton. Egg cartons traditionally are made out of paper, including molded pulp or molded fiber, or plastic, including polyethylene terephthalate (PETE) or expanded polystyrene (EPS). EPS is inexpensive but raises environmental concerns. EPS, in particular, is not biodegradable and is typically not accepted for recycling. Further, the use of EPS for food containers has been banned in some jurisdictions.

SUMMARY

An egg tray includes a base that includes a plurality of cells, a plurality of posts between the plurality of cells, and a rim extending around an upper perimeter of the base. The egg tray further includes a lid configured to be releasably engaged on the base by snapping the lid onto the base, so that the lid is snapped onto at least one of the plurality of posts and under the rim of the base.

BRIEF DESCRIPTION OF THE DRAWINGS

First Embodiment of an Egg Tray

Second Embodiment of an Egg Tray

Figure 12A:
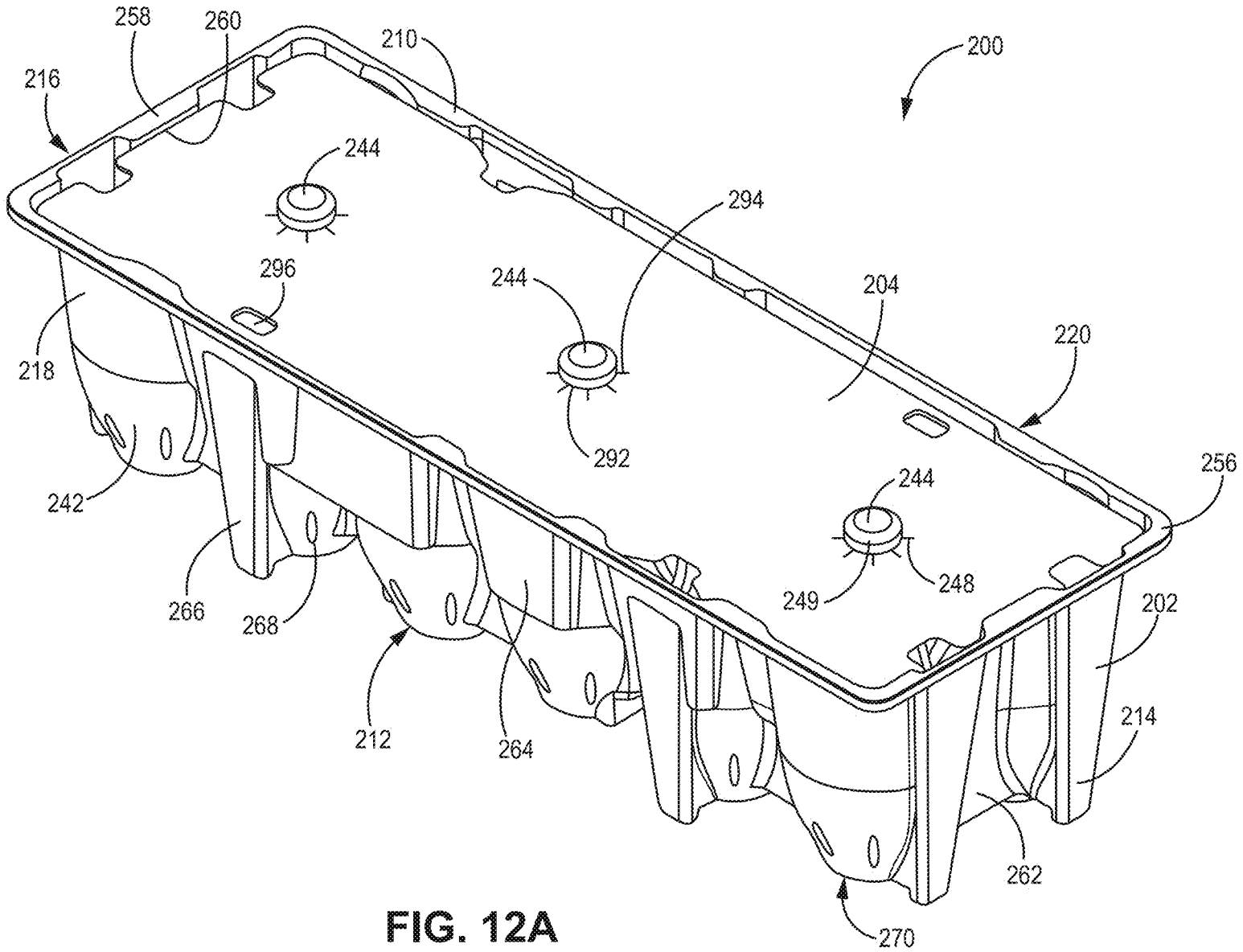

FIG. 12A is an isometric view of a second embodiment of an egg tray.

Figure 12B:
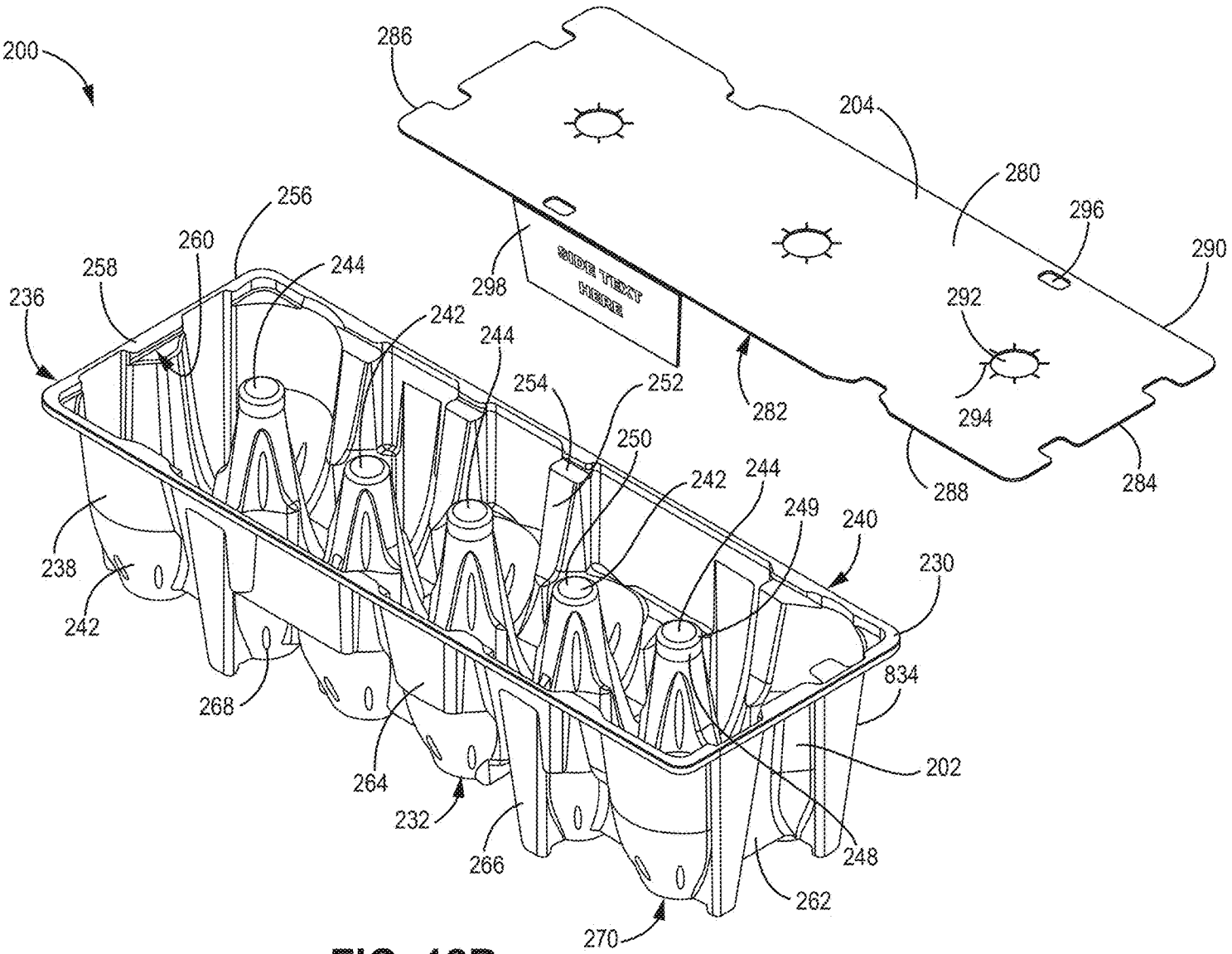

FIG. 12B is an isometric exploded view of the second embodiment of an egg tray.

Third Embodiment of an Egg Tray

Figure 13:
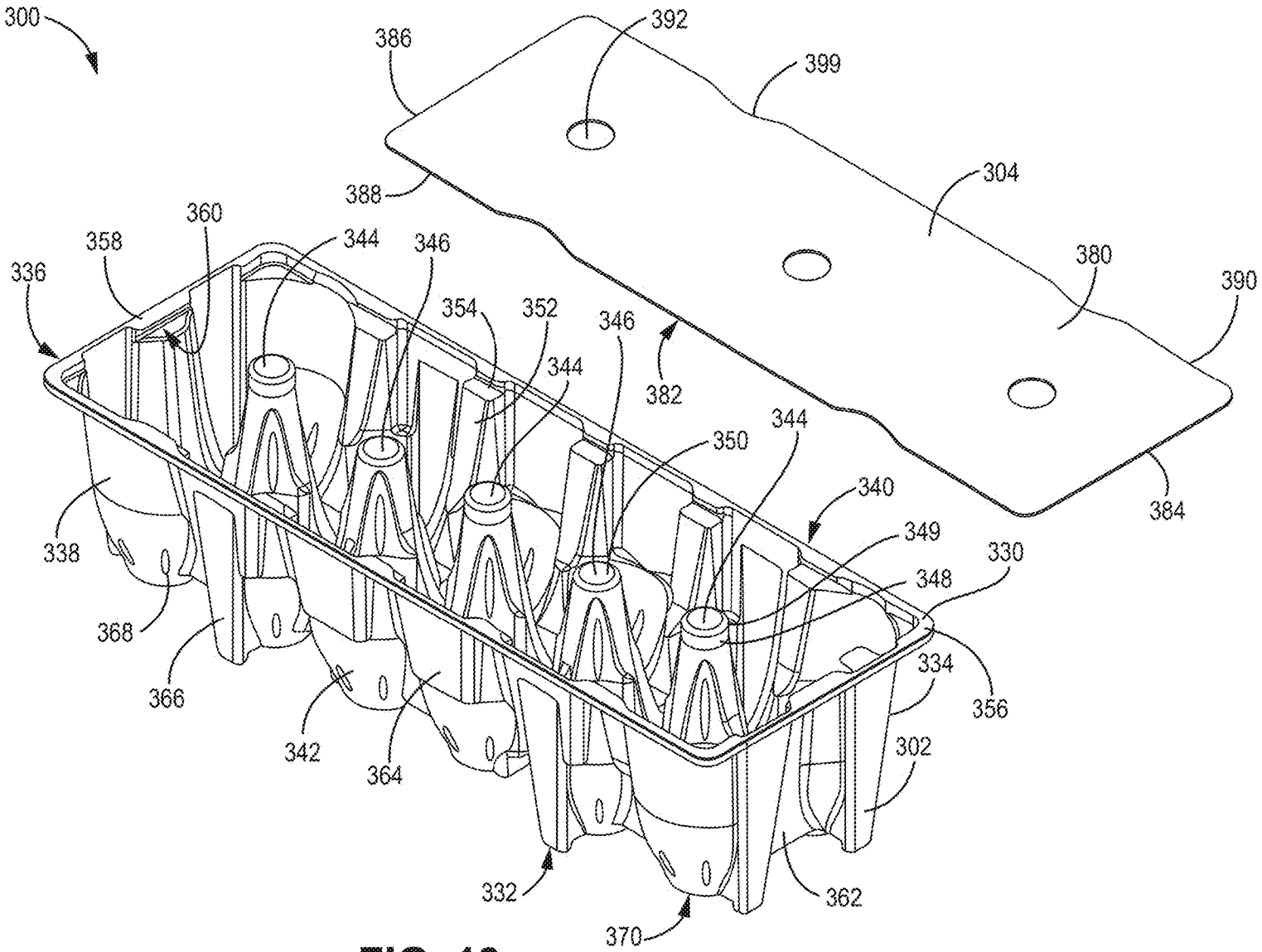

FIG. 13 is an isometric view of a third embodiment of an egg tray.

Fourth Embodiment of an Egg Tray

Figure 14A:
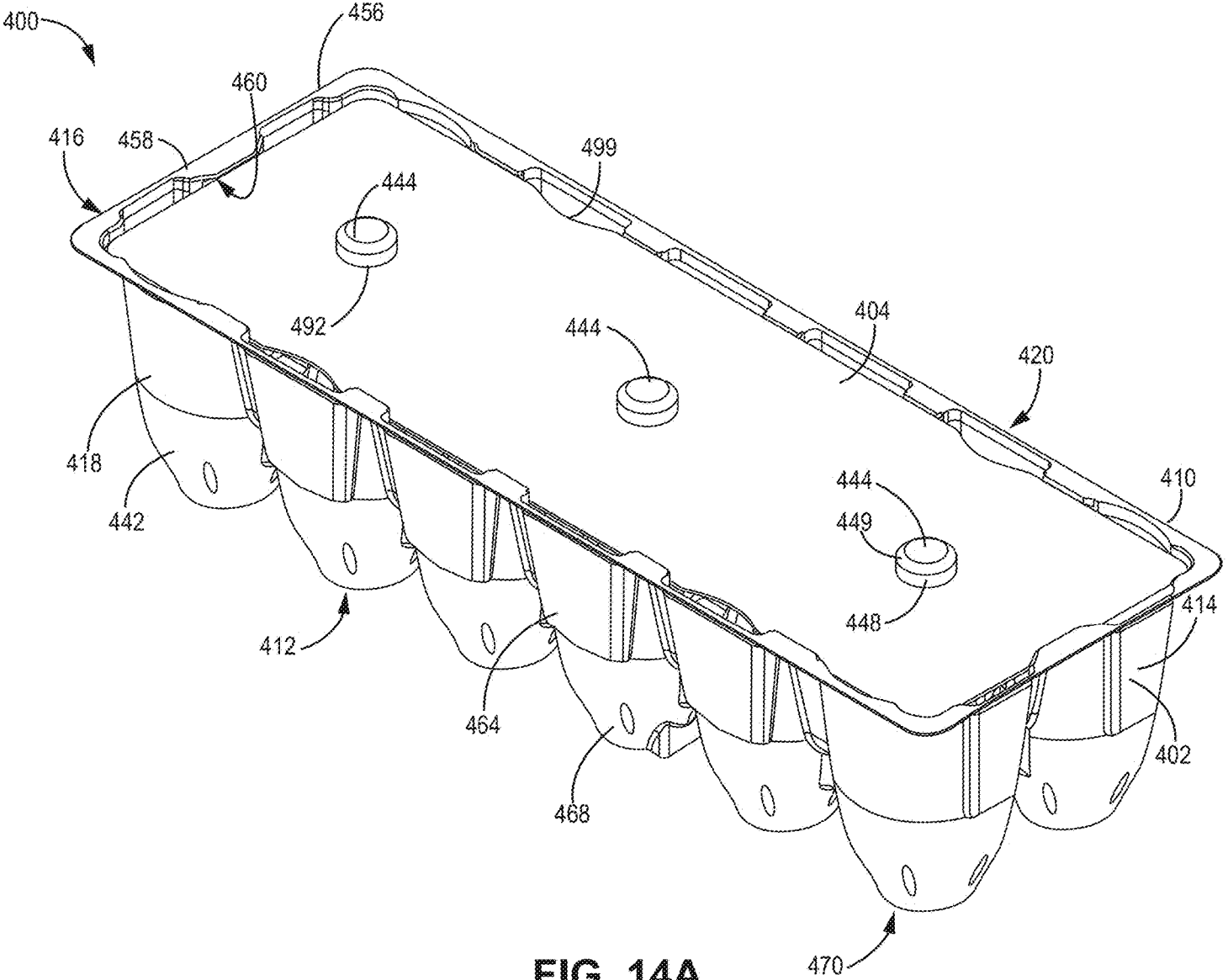

FIG. 14A is an isometric view of a fourth embodiment of an egg tray.

Figure 14B:
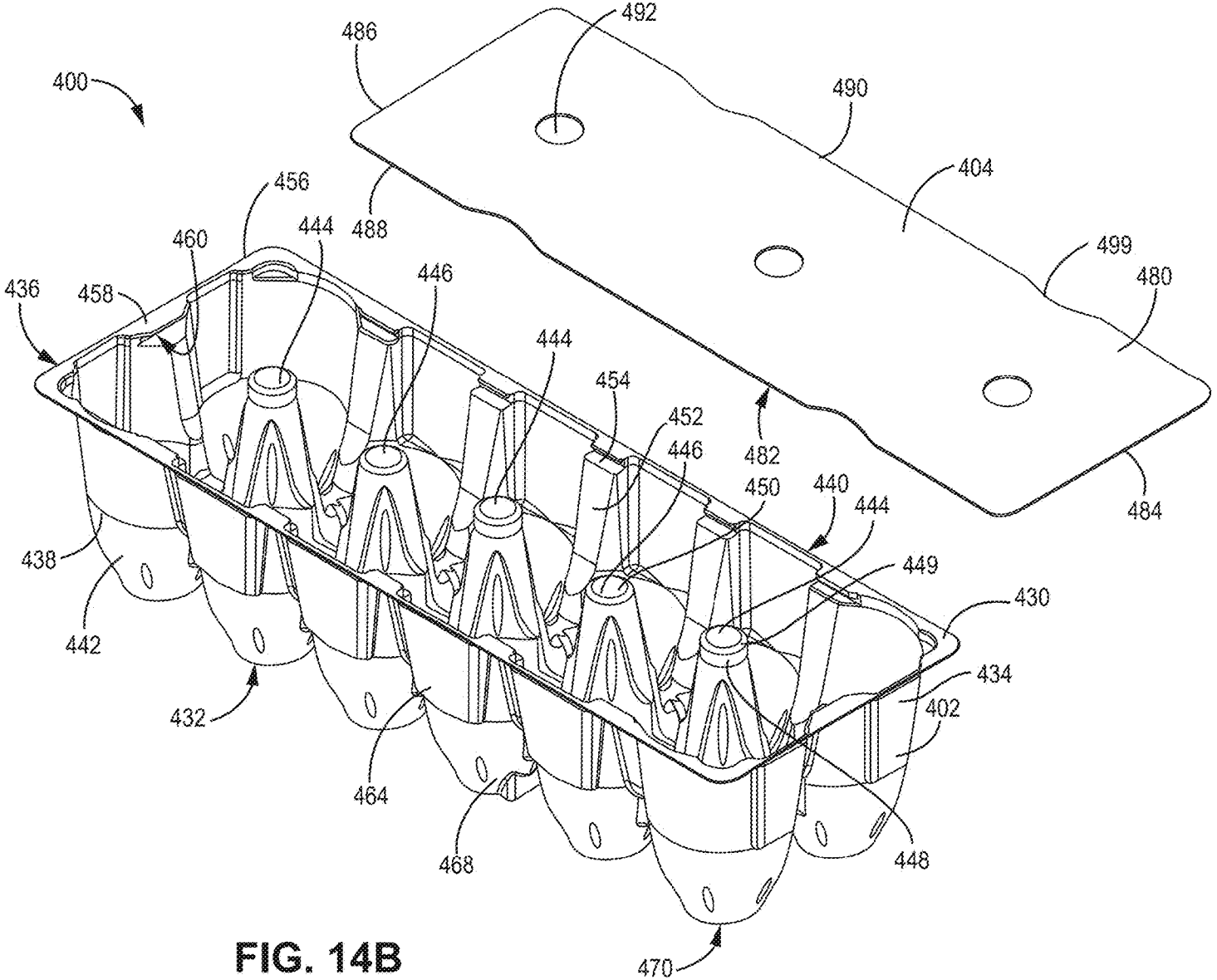

FIG. 14B is an isometric exploded view of the fourth embodiment of the egg tray.

Fifth Embodiment of an Egg Tray

Figure 15A:
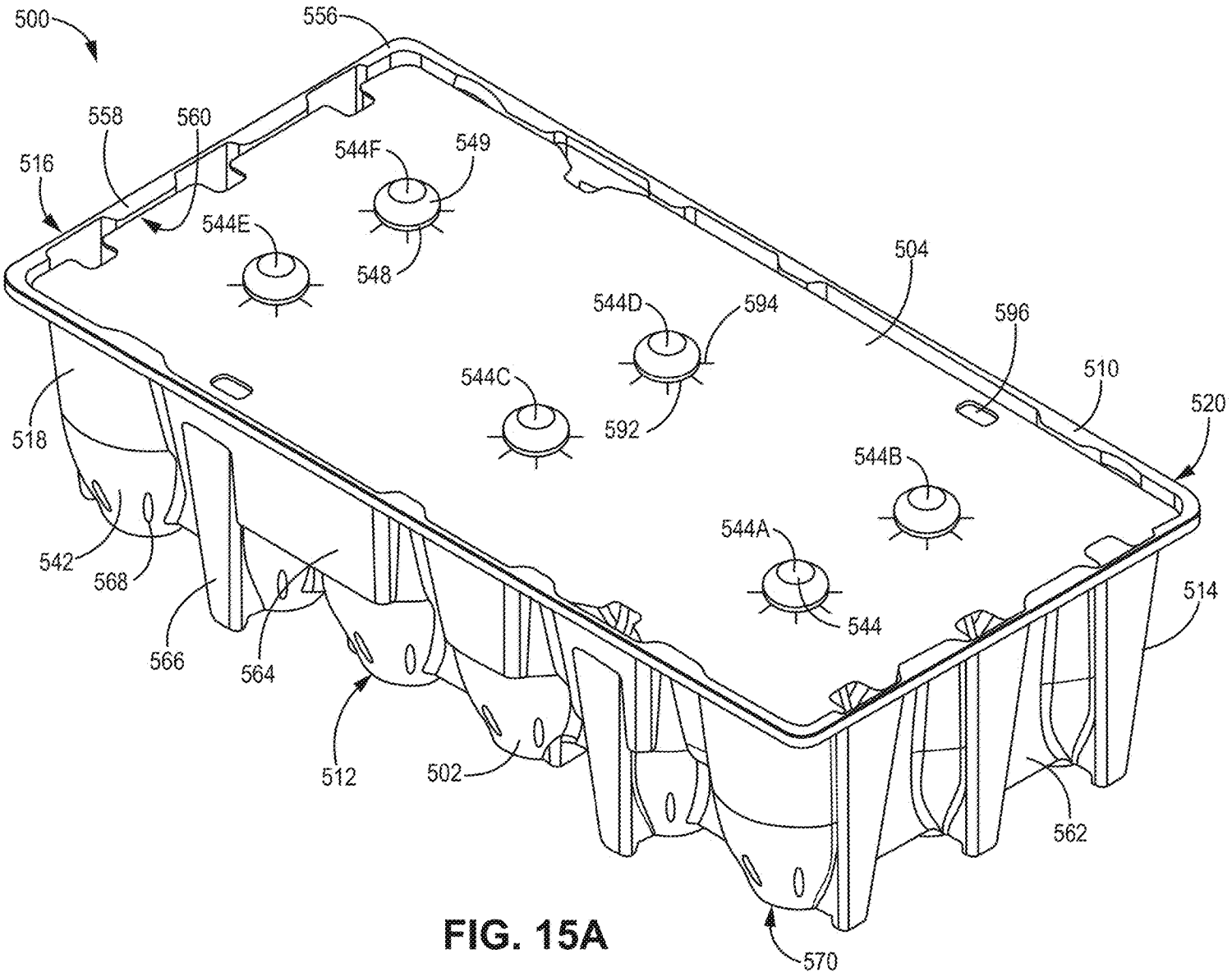

FIG. 15A is an isometric view of a fifth embodiment of an egg tray.

Figure 15B:
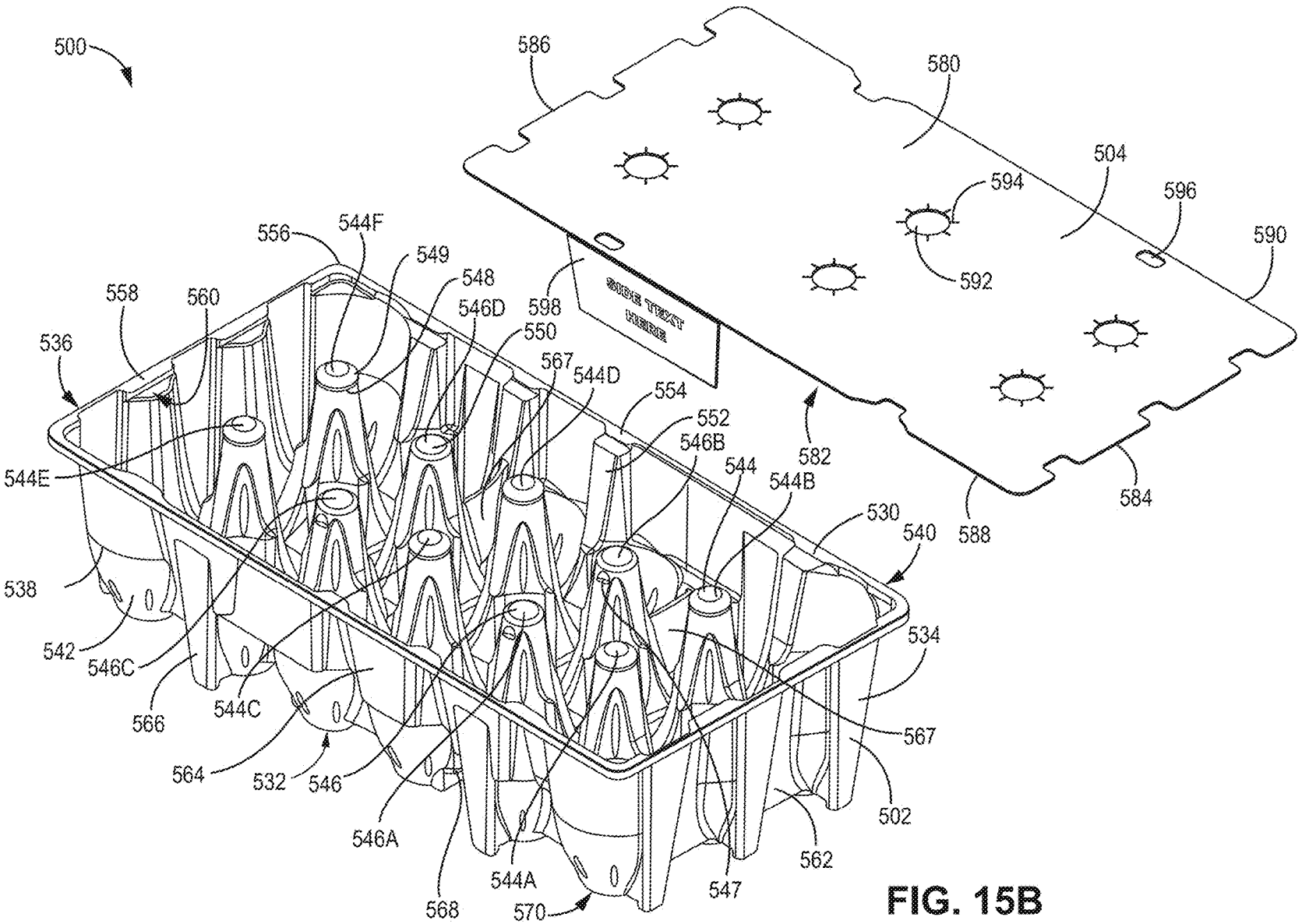

FIG. 15B is an isometric exploded view of the fifth embodiment of the egg tray.

Sixth Embodiment of an Egg Tray

Figure 16A:
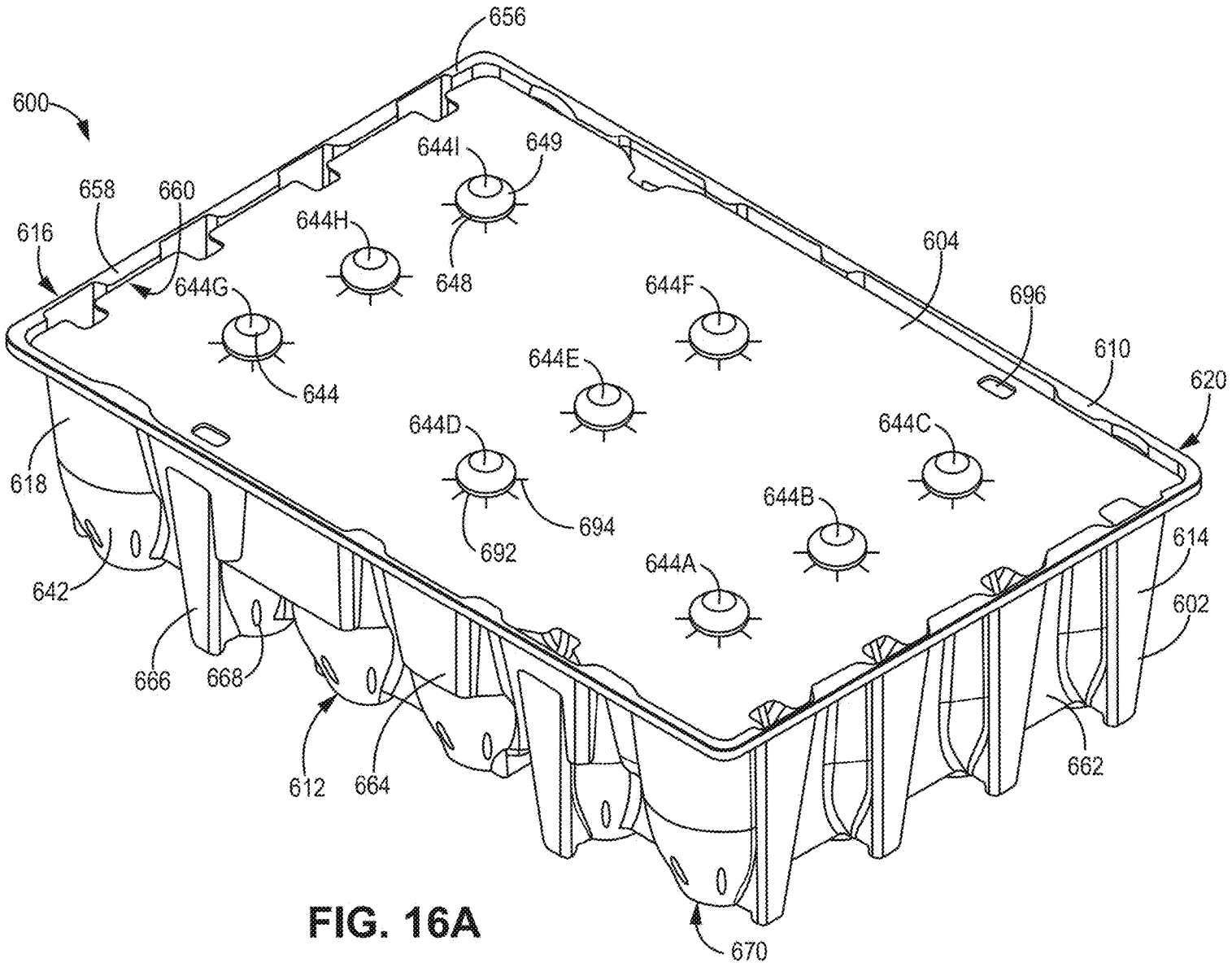

FIG. 16A is an isometric view of a sixth embodiment of an egg tray.

Figure 16B:
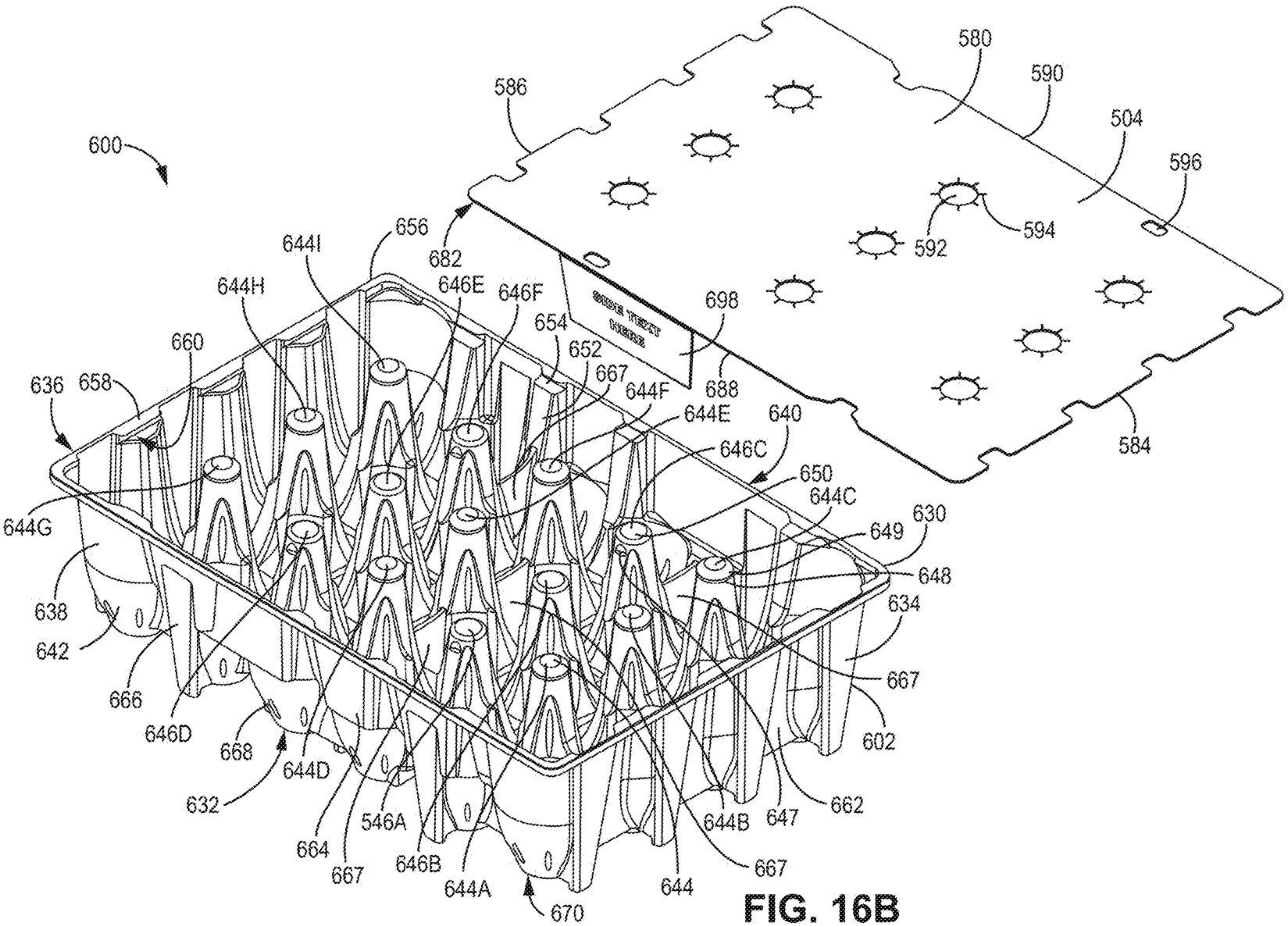

FIG. 16B is an isometric exploded view of the sixth embodiment of an egg tray.

Seventh Embodiment of an Egg Tray

Figure 17A:
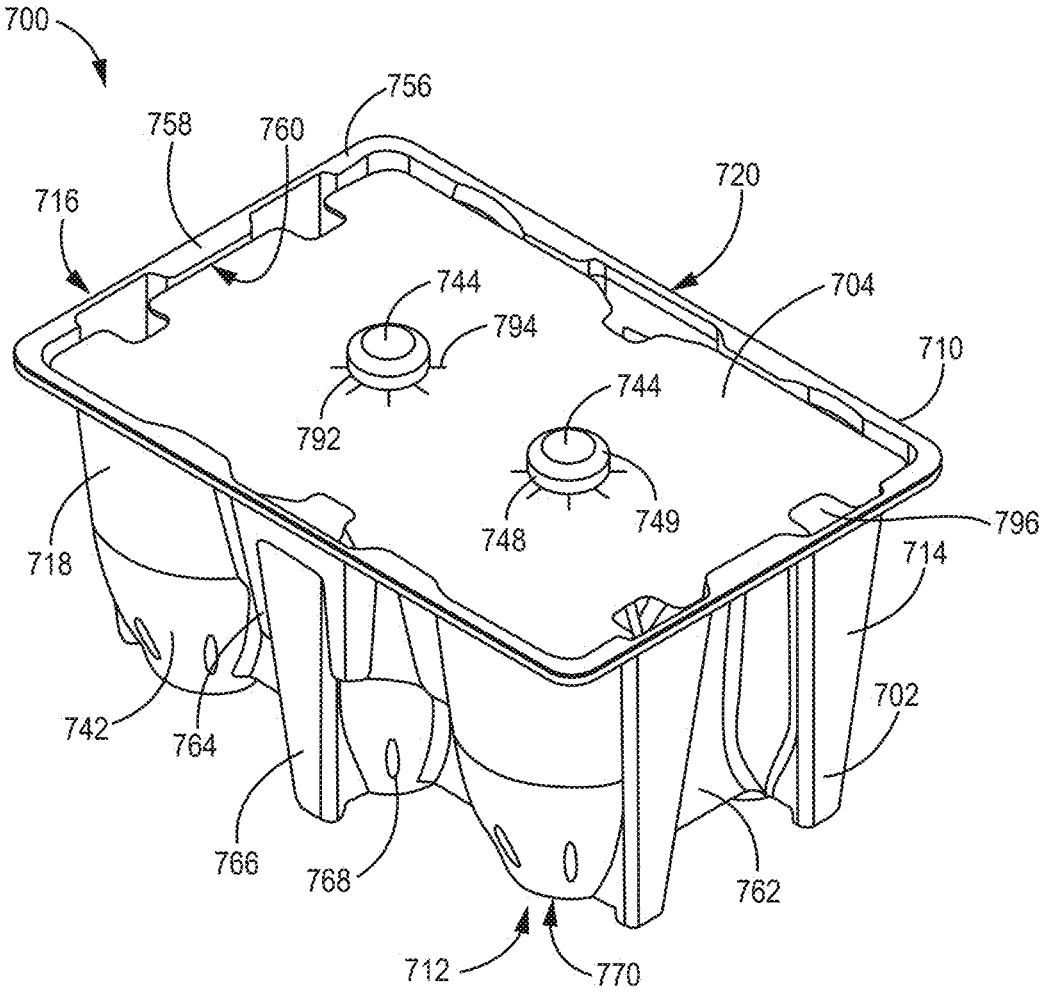

FIG. 17A is an isometric view of a seventh embodiment of an egg tray.

Figure 17B:
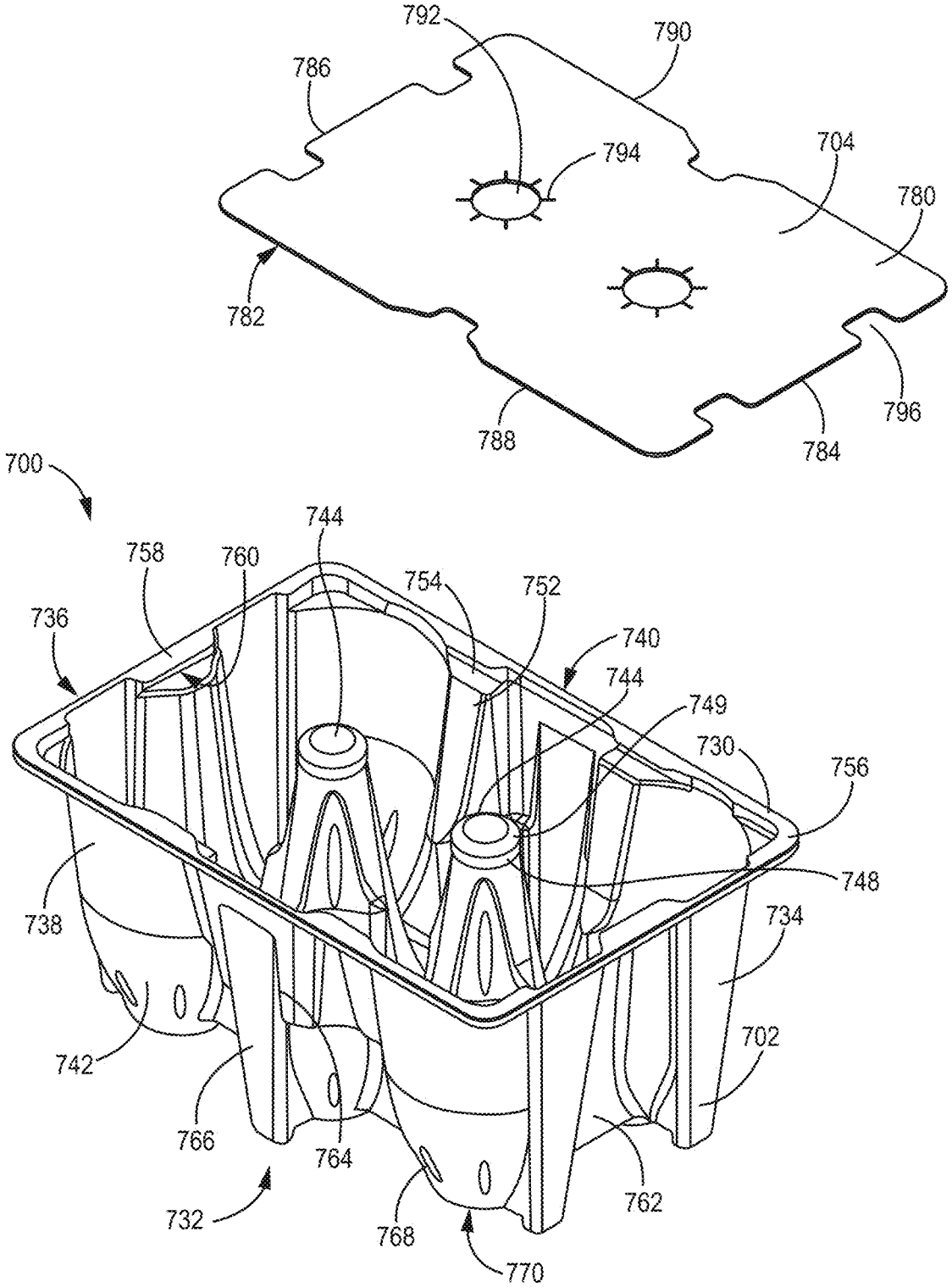

FIG. 17B is an isometric exploded view of the seventh embodiment of the egg tray.

Eighth Embodiment of an Egg Tray

Figure 18A:
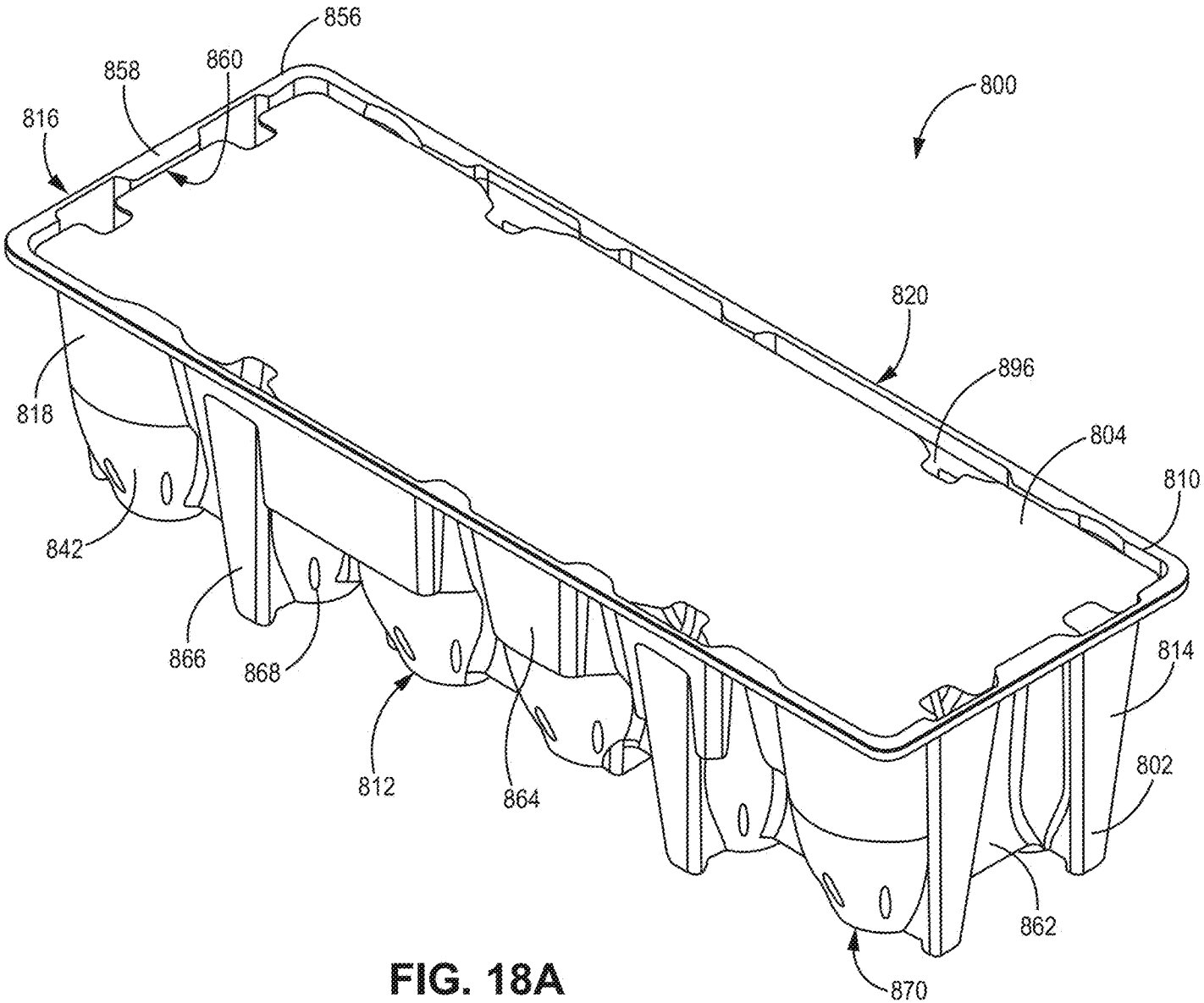

FIG. 18A is an isometric view of a eighth embodiment of an egg tray.

Figure 18B:
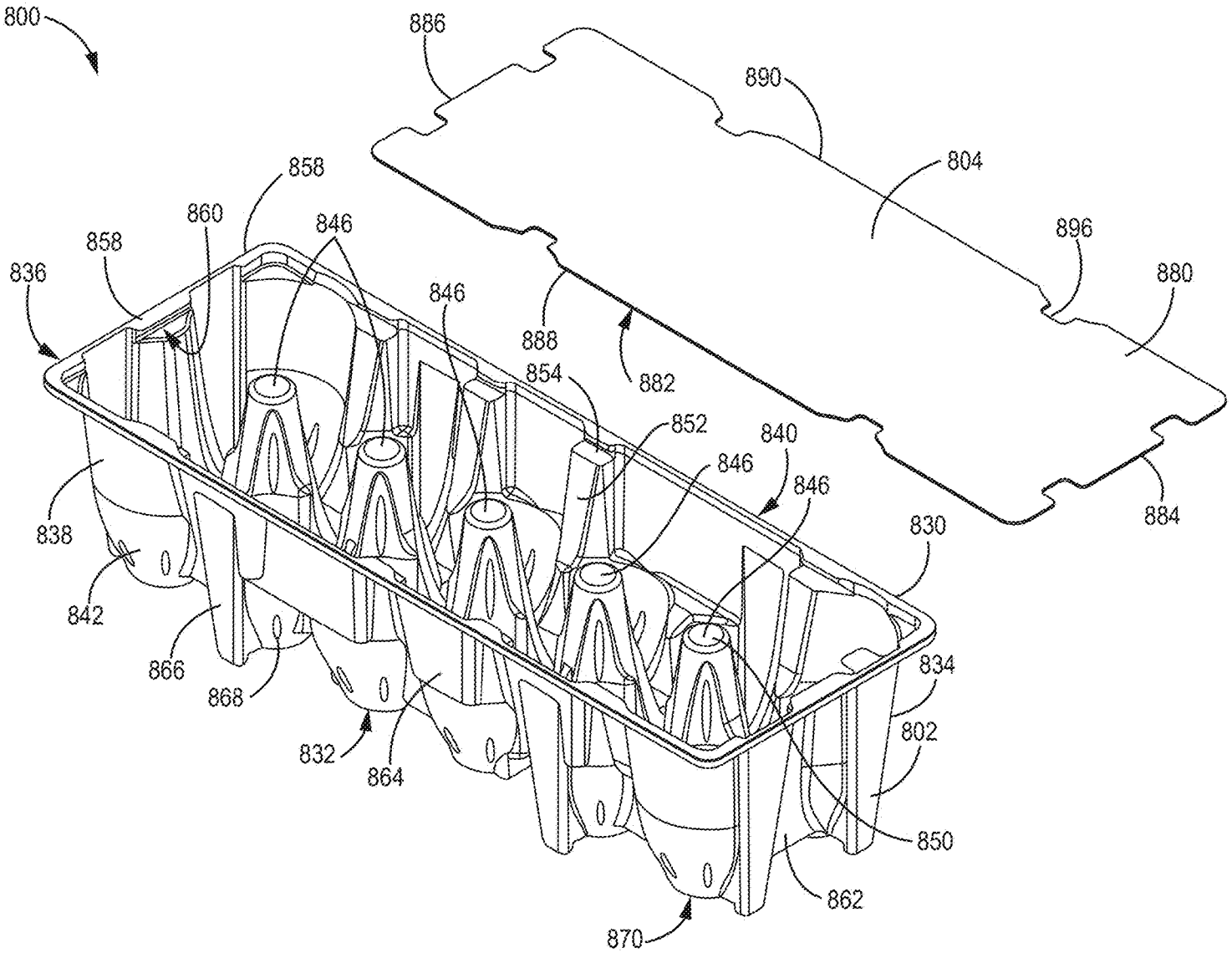

FIG. 18B is an isometric exploded view of the eighth embodiment of the egg tray.

Egg Processing Assembly Line

Figure 19:
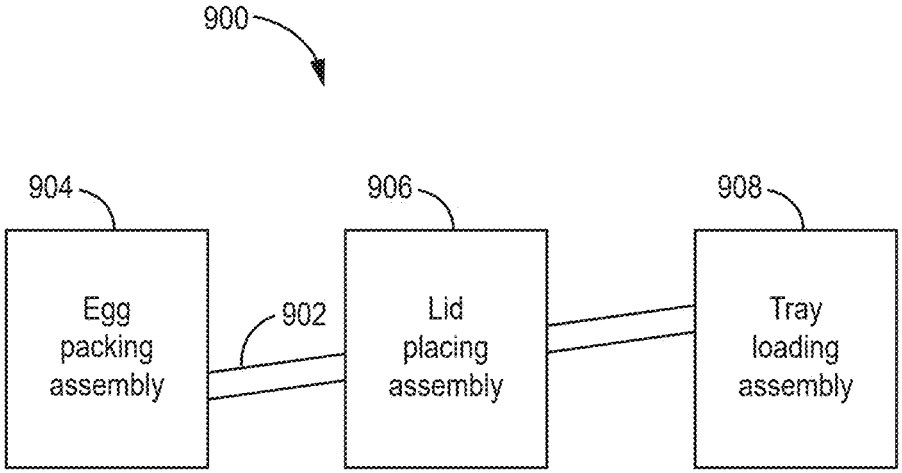

FIG. 19 is a schematic view of an egg processing assembly line.

First Embodiment of a Lid Placing Assembly

Figure 20A:
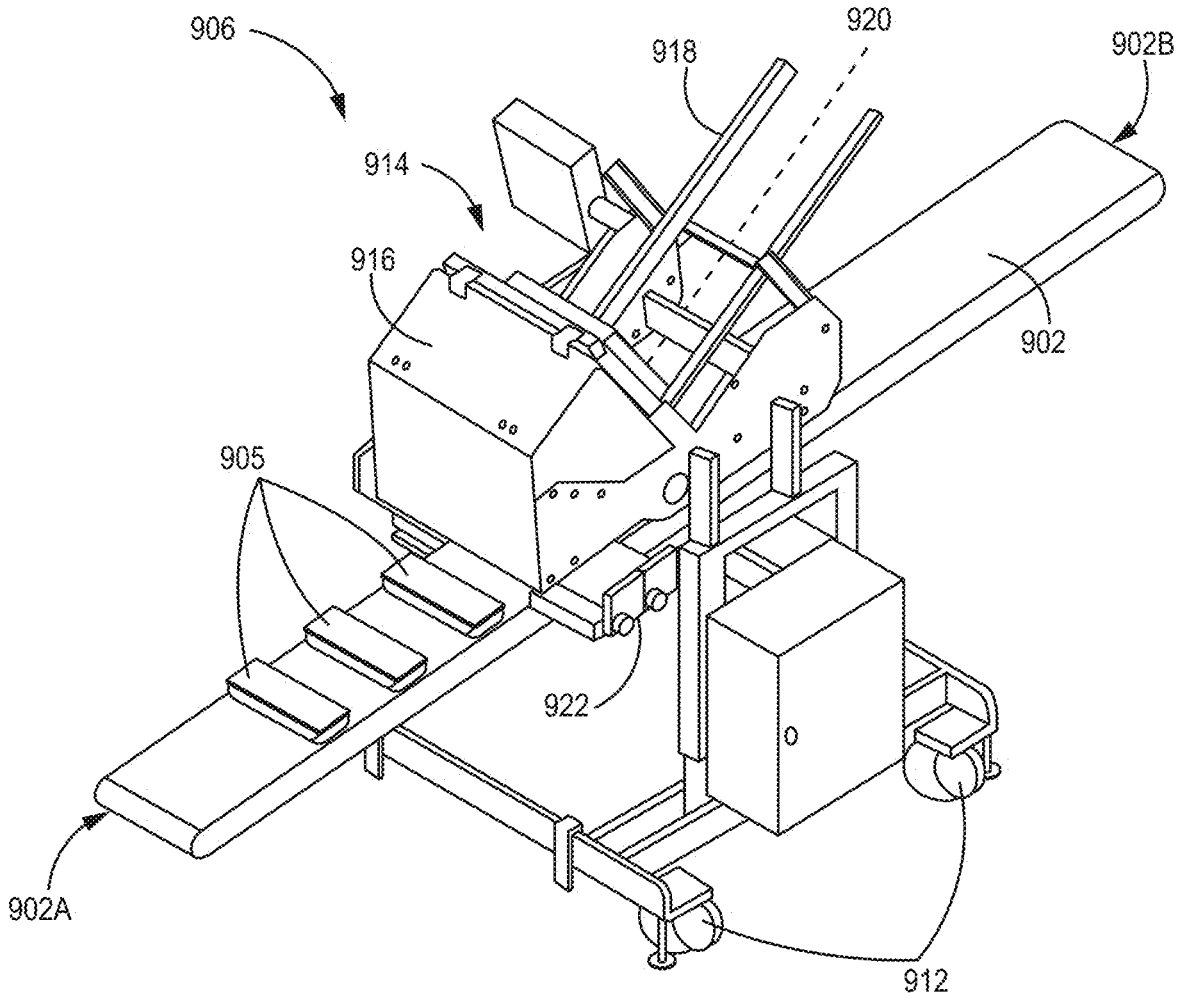

FIG. 20A is a perspective view of a first embodiment of a lid placing assembly.

Figure 20B:
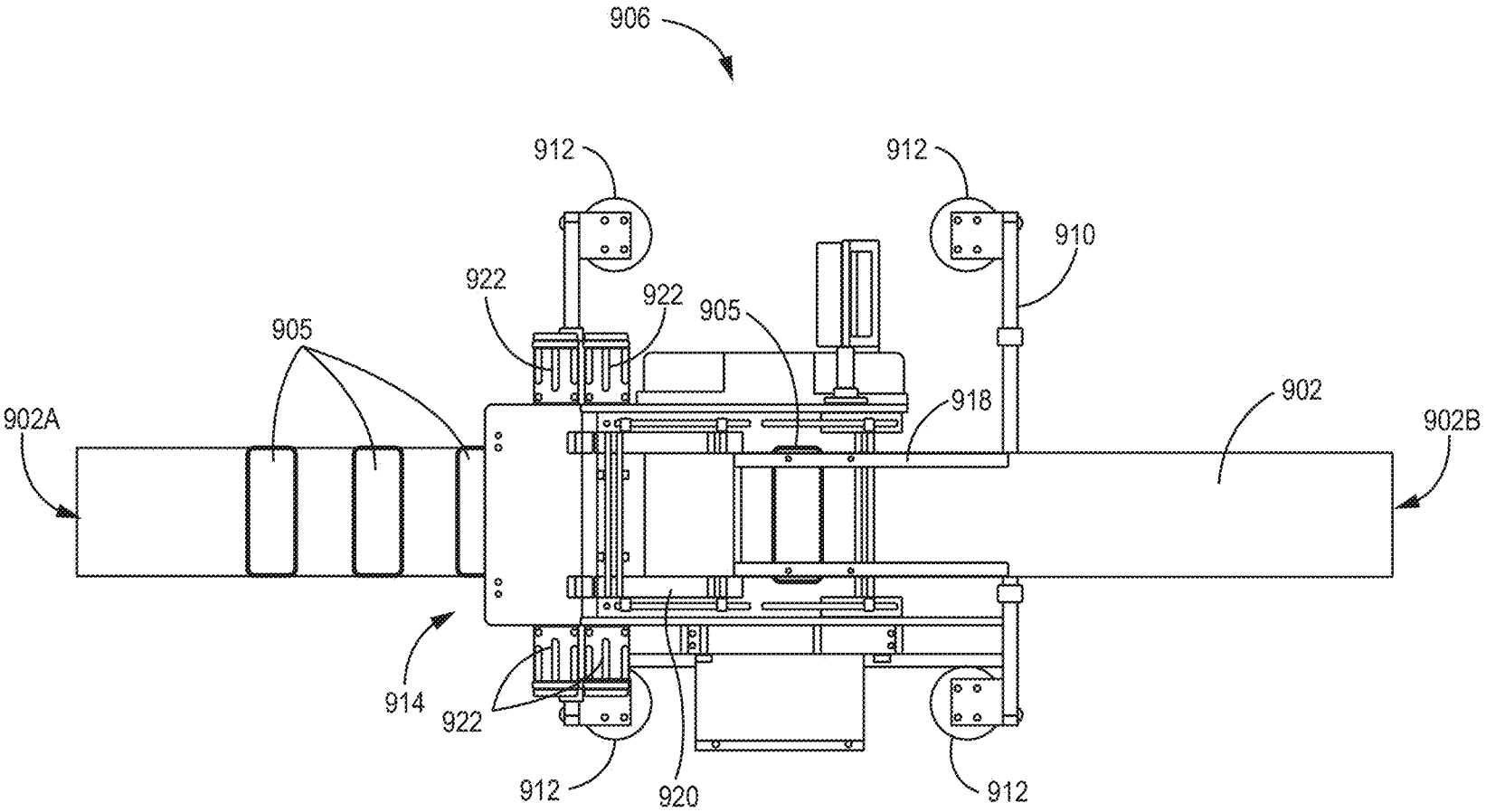

FIG. 20B is a top view of the first embodiment of the lid placing assembly.

Figure 20C:
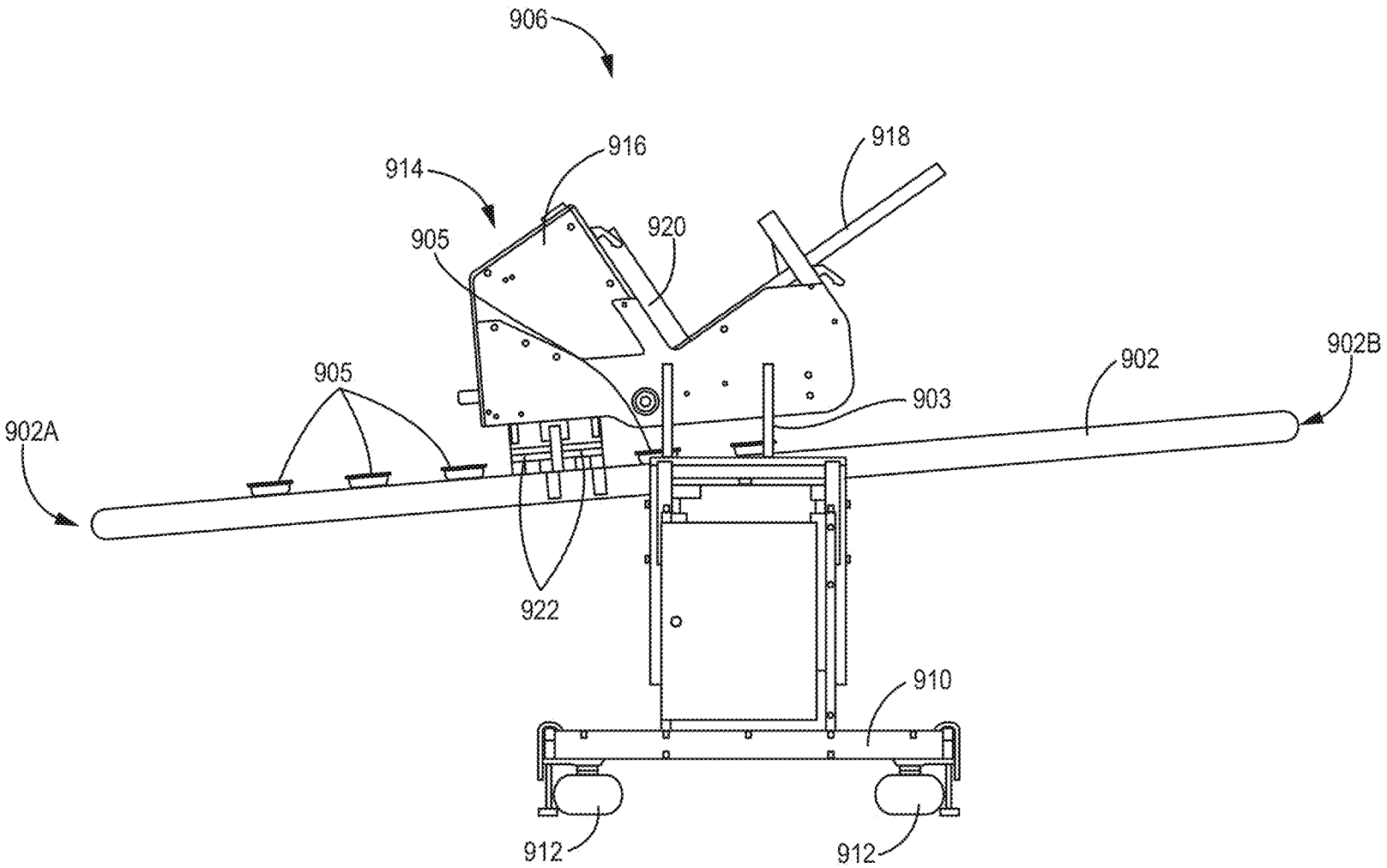

FIG. 20C is a side view of the first embodiment of the lid placing assembly.

First Embodiment of a Head for a Robotic Arm

Figure 21A:
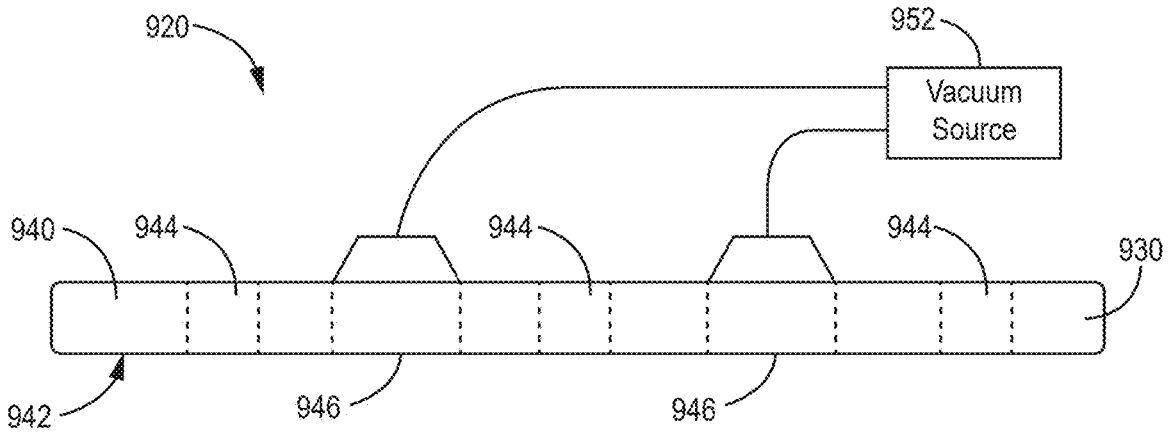

FIG. 21A is a schematic side view of a first embodiment of a head for a robotic arm.

Figure 21B:
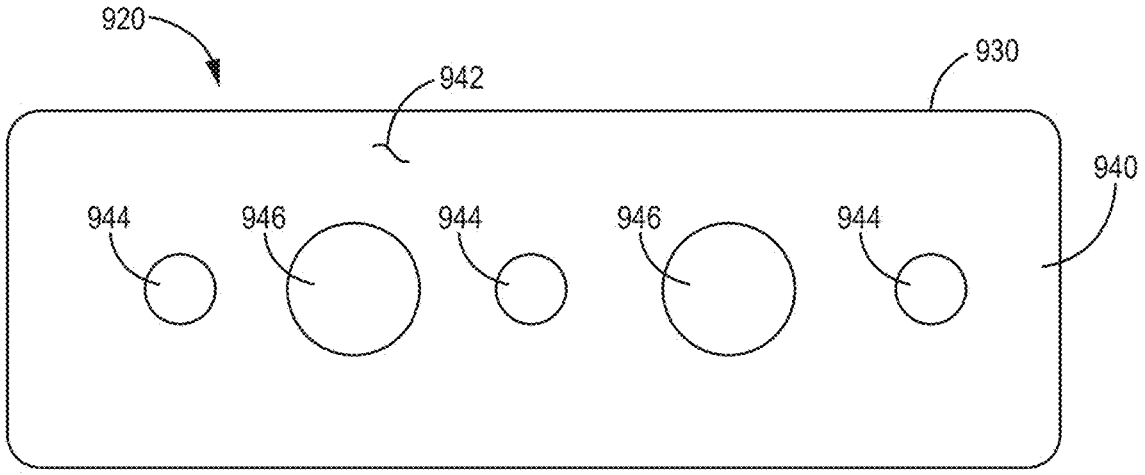

FIG. 21B is a schematic bottom view of the first embodiment of the head for the robotic arm.

Second Embodiment of a Head for a Robotic Arm

Figure 22A:
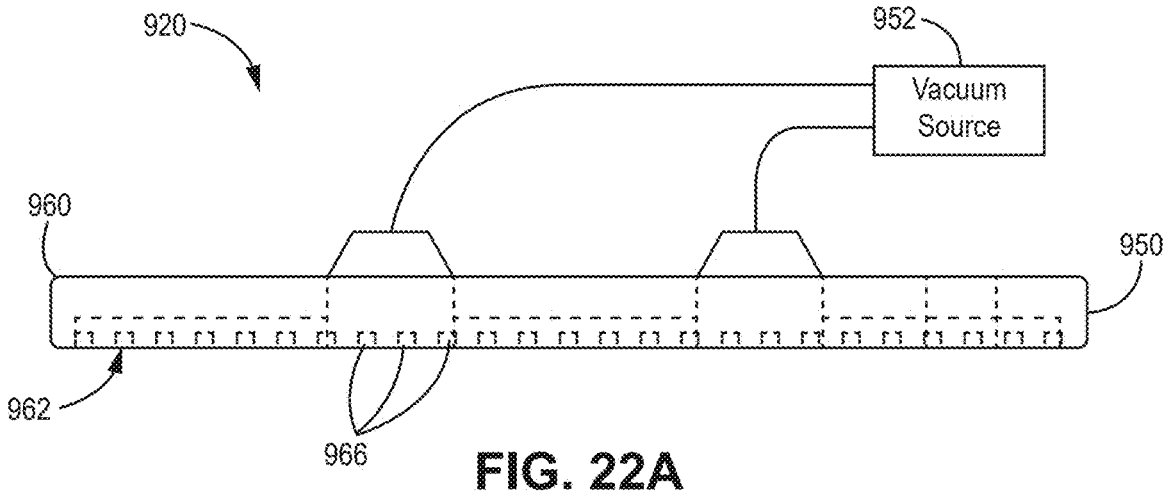

FIG. 22A is a schematic side view of a second embodiment of a head for a robotic arm.

Figure 22B:
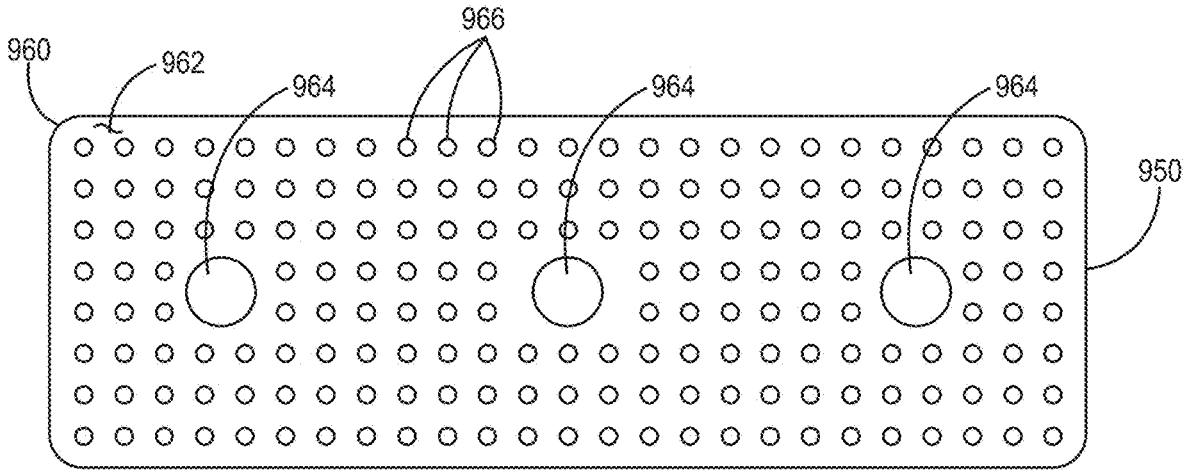

FIG. 22B is a schematic bottom view of the second embodiment of the head for the robotic arm.

Second Embodiment of a Lid Placing Assembly

Figure 23A:
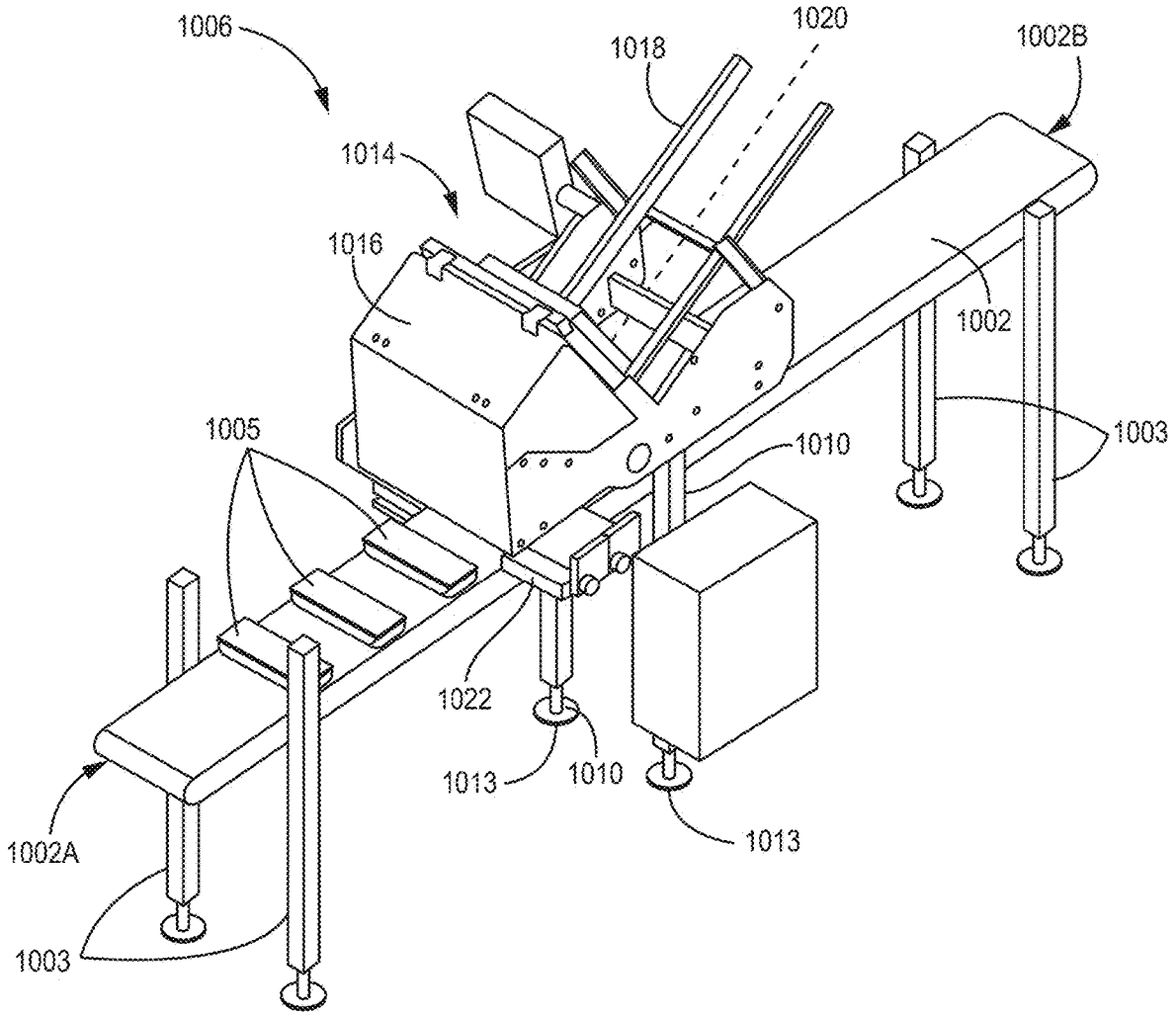

FIG. 23A is a perspective view of a second embodiment of a lid placing assembly.

Figure 23B:
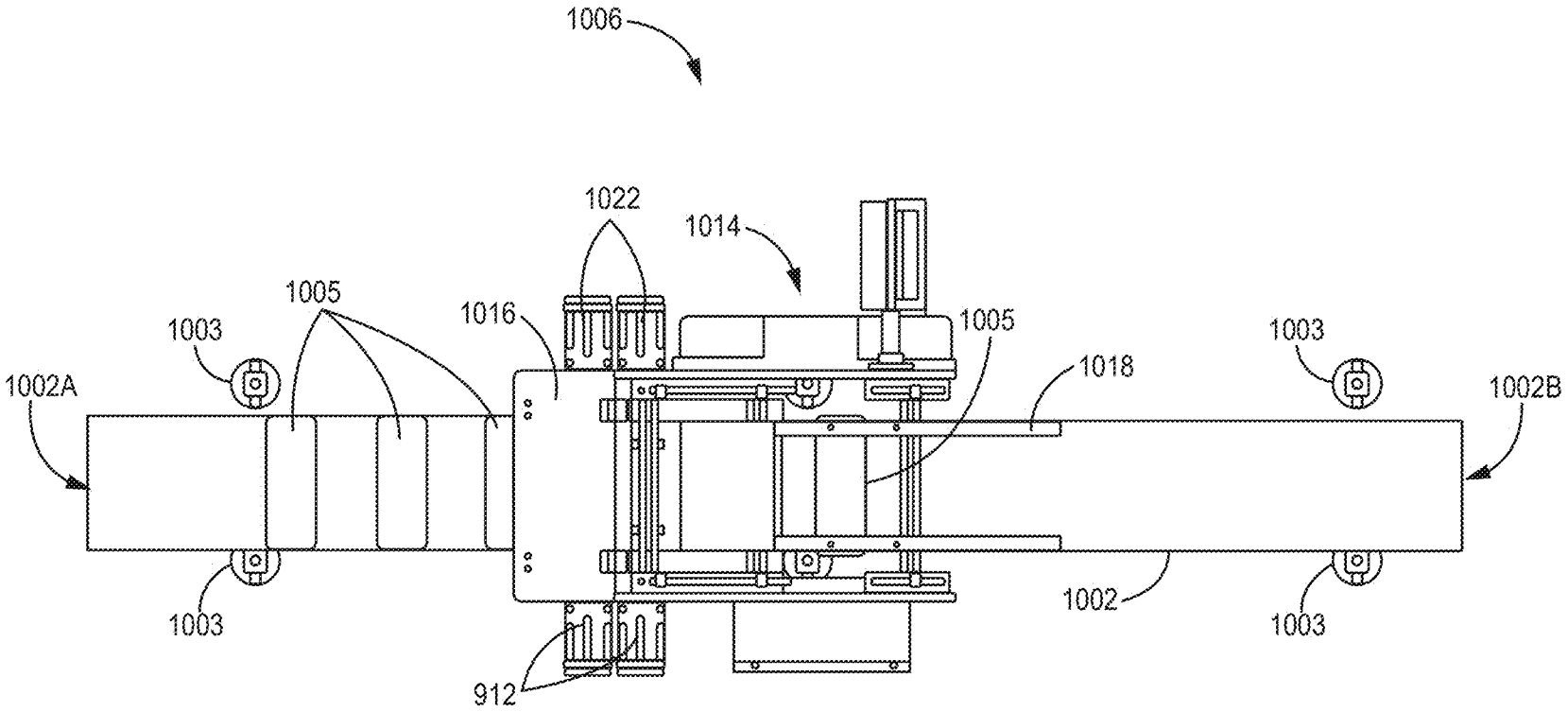

FIG. 23B is a top view of the second embodiment of the lid placing assembly.

Figure 23C:
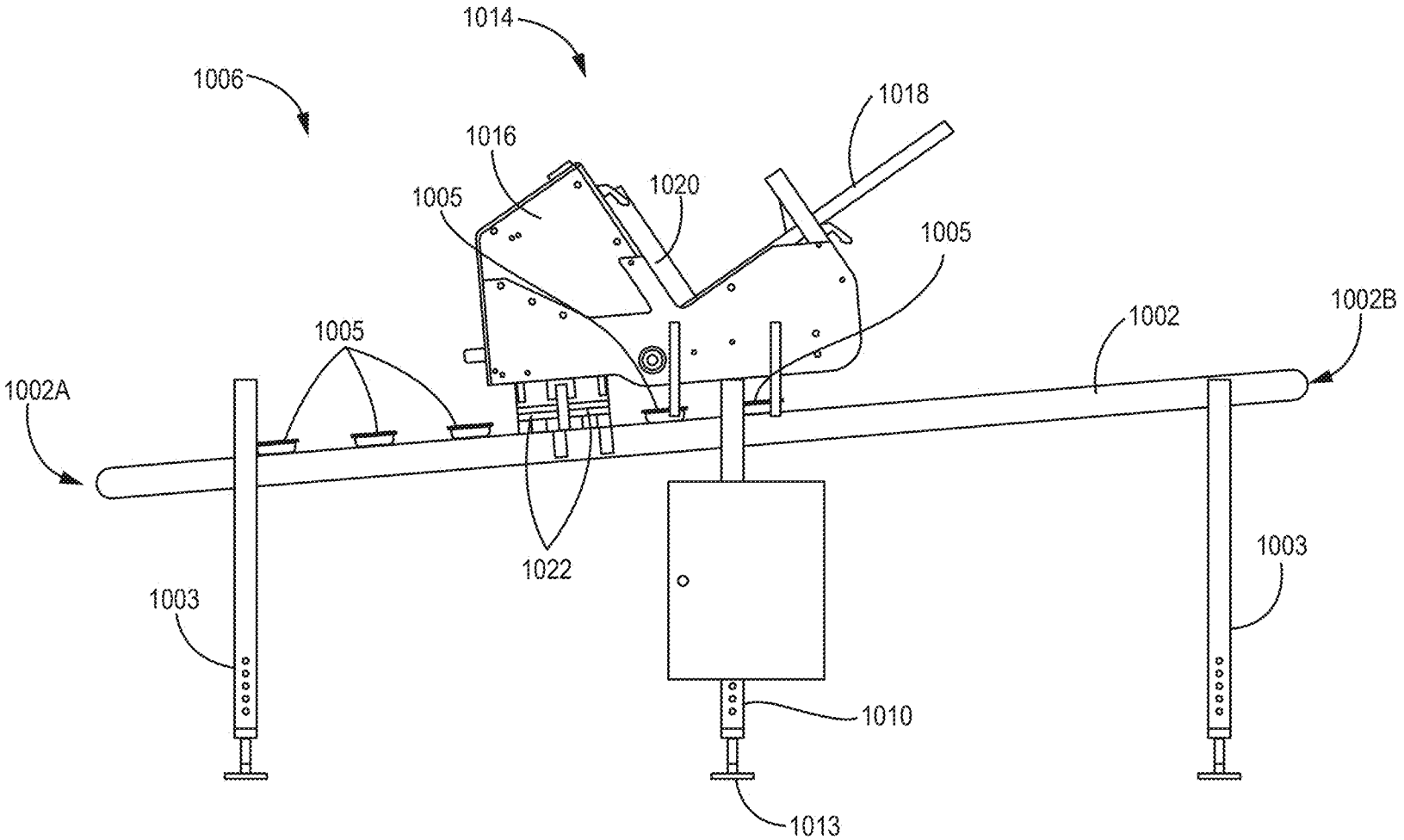

FIG. 23C is a side view of the second embodiment of the lid placing assembly.

DETAILED DESCRIPTION

Egg TRAY 100

Figure 1:
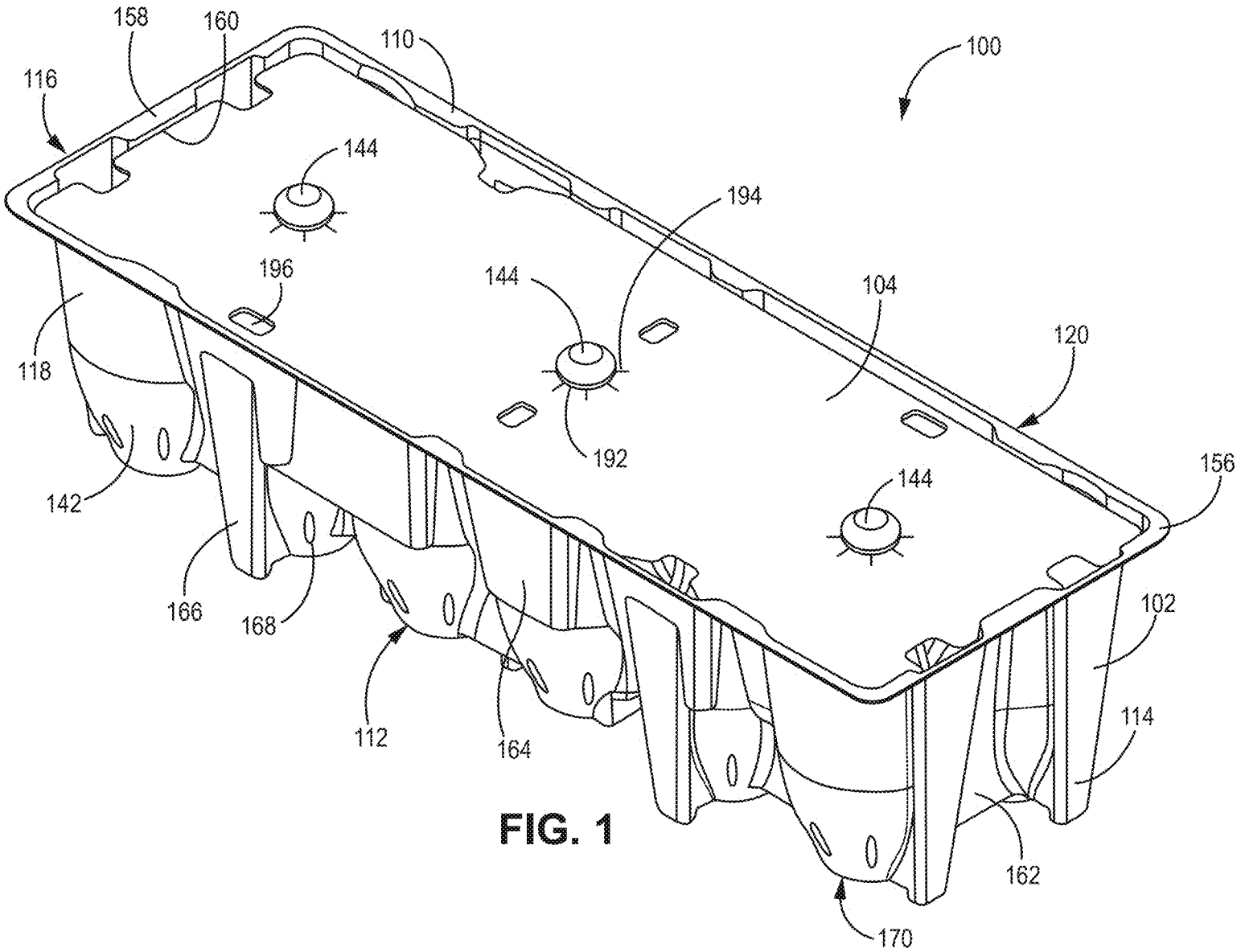
FIG. 1 is an isometric view of a first embodiment of an egg tray.
Figure 2:
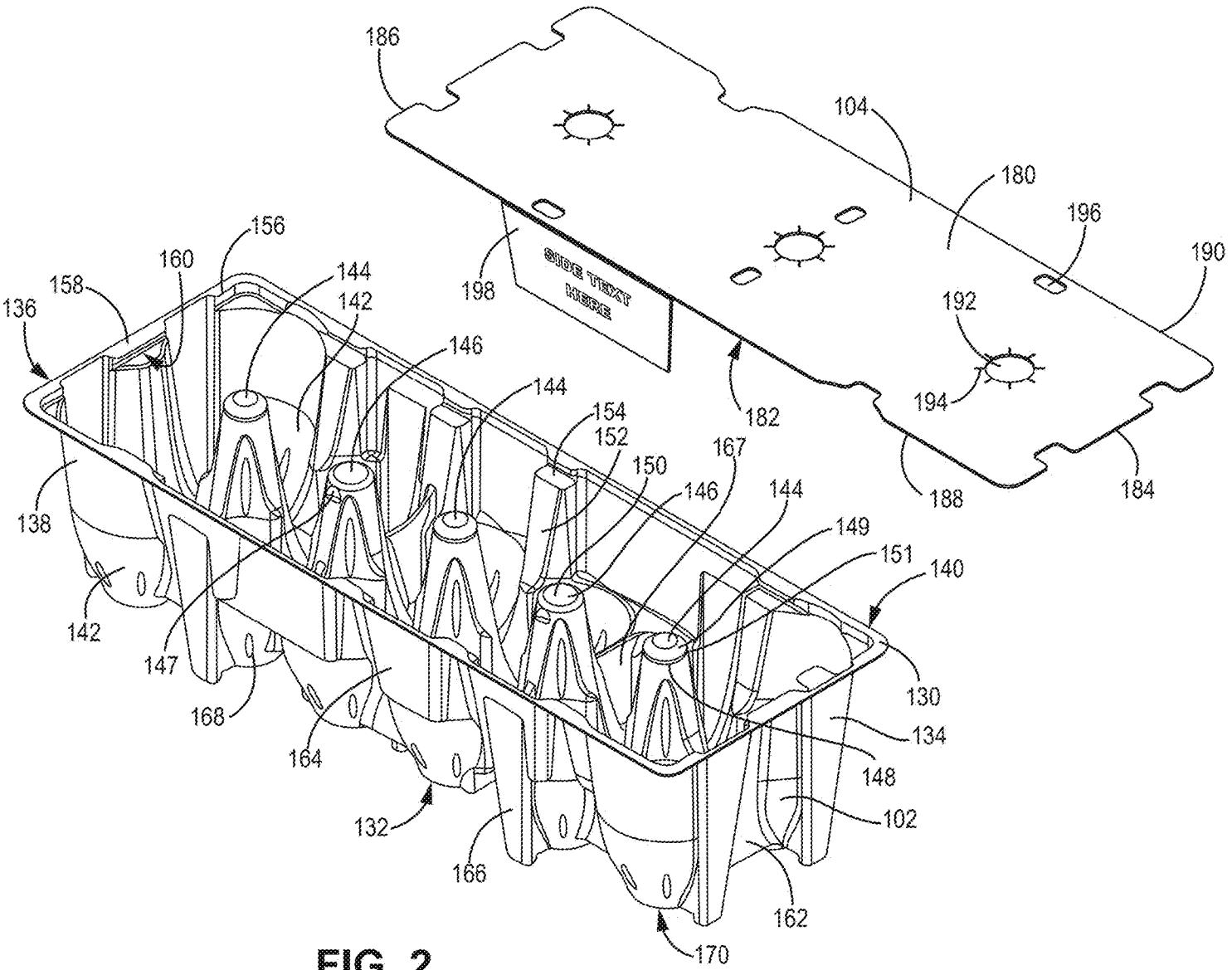
FIG. 2 is an isometric exploded view of the first embodiment of the egg tray.

FIG. 1 is an isometric view of egg tray 100. FIG. 2 is an isometric exploded view of egg tray 100. FIGS. 1-2 will be discussed together. Egg tray 100 includes base 102 and lid 104. Egg tray 100 has top 110 (shown in FIG. 1), bottom 112 (shown in FIG. 1), first end 114 (shown in FIG. 1), second end 116 (shown in FIG. 1), first side 118 (shown in FIG. 1), and second side 120 (shown in FIG. 1). Base 102 includes top 130 (shown in FIG. 2), bottom 132 (shown in FIG. 2), first end 134 (shown in FIG. 2), second end 136 (shown in FIG. 2), first side 138 (shown in FIG. 2), second side 140 (shown in FIG. 2), cells 142, first posts 144, second posts 146 (shown in FIG. 2), denest features 147 (shown in FIG. 2), undercuts 148, chamfers 149, support surfaces 150 (shown in FIG. 2), side surfaces 151 (shown in FIG. 2), ribs 152 (shown in FIG. 2), ledges 154 (shown in FIG. 2), rim 156, ridges 158, undercuts 160, support members 162, vents 164, stacking columns 166, dividers 167 (shown in FIG. 2), sets of projections 168, and dimples 170. Lid 104 includes top 180 (shown in FIG. 2), bottom 182 (shown in FIG. 2), first end 184 (shown in FIG. 2), second end 186 (shown in FIG. 2), first side 188 (shown in FIG. 2), second side 190 (shown in FIG. 2), openings 192, slits 194, cutouts 196, and flaps 198 (shown in FIG. 2).

Egg tray 100 includes base 102 and lid 104 that fits onto base 102. Lid 104 is removably engaged with base 102 to open and close egg tray 100. Egg tray 100 is configured to receive eggs. Eggs sit fully within base 102, and lid 104 is positioned on base 102 to retain the eggs in egg tray 100. Egg tray 100 is sized to hold twelve eggs in the embodiment shown in FIGS. 1-2, similar to a traditional twelve-count egg carton. Egg tray 100 can be sized to receive any number of eggs in alternate embodiments, for example egg tray 500 shown in FIGS. 15A-15B is sized to hold 18 eggs, egg tray 600 shown in FIGS. 16A-16B is sized to hold 24 eggs, and egg tray 700 shown in FIGS. 17A-17B is sized to hold 6 eggs.

Egg tray 100 includes top 110, bottom 112, first end 114, second end 116, first side 118, and second side 120. Top 110 is opposite bottom 112; first end 114 is opposite second end 116; and first side 118 is opposite second side 120. Egg tray 100 is substantially rectangular shaped.

Base 102 includes top 130, bottom 132, first end 134, second end 136, first side 138, and second side 140. Top 130 is opposite bottom 132; first end 134 is opposite second end 136; and first side 138 is opposite second side 140. Base 102 is substantially rectangular shaped. Base 102 forms a housing portion of egg tray 100 that is configured to receive and hold eggs. Base 102 is manufactured using a thermoforming process. Base 102 can be made with a thermoformed plastic, for example polyethylene terephthalate (PETE) or polypropylene. In some embodiments, base 102 can be made out of a recycled PETE material or any other recycled material. Further, in some embodiments, base 102 can be made out of polylactic acid (PLA) or polyhydroxyalkanoates (PHA), which are compostable/renewable plastic materials. Alternatively, base 102 can be made with injection molding. In further alternate embodiments, base 102 can be made out of a paper material. When base 102 is made out of plastic, it can be made out of a transparent plastic. This allows a purchaser of egg tray 100 to view the eggs packaged in egg tray 100 and confirm the eggs are not cracked or otherwise damaged.

Base 102 includes cells 142 that are shaped to receive eggs. Cells 142 include a plurality of cells 142, with each cell 142 being configured to receive one egg. Base 102 shown in FIGS. 1-2 includes twelve cells 142 to accommodate twelve eggs. Base 102 can include any number of cells 142 in alternate embodiments.

First posts 144 and second posts 146 are formed between cells 142. First posts 144 and second posts 146 extend upwards. First posts 144 and second posts 146 are configured to engage lid 104 to close egg tray 100. First posts 144 include a plurality of first posts 144 having a first height. Second posts 146 include a plurality of second posts having a second height. The first height of first posts 144 is greater than the second height of second posts 146. First posts 144 are configured to extend through lid 104 to engage lid 104. First posts 144 include undercuts 148 to engage lid 104. Undercuts 148 include a plurality of undercuts 148, with each undercut 148 formed at a top end of one of first posts 144. First posts 144 also include chamfers 149 formed along a circumference at a top end of first posts 144. Surface of undercut 148 and surface of chamfer 149 on first post 144 are connected by side surface 151. Undercuts 148 are chamfers that are angled inward from side surfaces 151. Undercuts 148, chambers 149, and side surfaces 151 are designed to be beneficial to the manufacturing process. First posts 144 are configured to engage lid 104 when lid 104 is placed on base 102 of egg tray 100. Lid 104 can be snapped onto base 102 in part by snapping lid 104 onto first posts 144. Chamfers 149 help to guide lid 104 onto first posts 144, while undercuts 148 help to provide a resistive surface to lid 104 to keep lid 104 in place on first posts 144. Lid 104 is configured to rest upon a top of second posts 146. Second posts 146 include support surfaces 150 that form flat top surfaces of second posts 146. Support surfaces 150 include a plurality of support surfaces 150, with each support surface 150 forming a flat top surface of one of second posts 146. Second posts 146 also include denest features 147. Denest features 147 can be formed on second posts 146 facing first side 138. Denest features 147 include a plurality of denest features 147. Denest features 147 can be a ledge, lip, lug, or any other appropriate design that accommodates the denesting process of removing base 102 from a stack of a plurality of base 102. Denest features 147 prevent a vacuum from occurring between a plurality of base 102 when stacked together.

Base 102 further includes ribs 152 extending between cells 142. Ribs 152 include a plurality of ribs 152, with each rib 152 being positioned between adjacent cells 142. Ribs 152 provide structural support for base 102. Ledges 154 form a top of ribs 152. Ledges 154 include a plurality of ledges 154, with each ledge 154 forming a top of one rib 152. Lid 104 rests upon ledges 154 of ribs 152 when lid 104 is placed on base 102.

Base 102 also includes rim 156 extending along an upper perimeter of base 102 at top 130 of base 102. Rim 156 is configured to engage lid 104 when lid 104 is placed on base 102 of egg tray 100. Lid 104 can be snapped onto base 102 in part by snapping lid 104 under rim 156. Ridges 158 form a portion of rim 156 and extend inwards from an outer edge of rim 156. Ridges 158 include a plurality of ridges 158, with each ridge 158 being aligned over one ledge 154 of one rib 152. Ridges 158 have undercuts 160 that form a lip under ridges 158. Undercuts 160 include a plurality of undercuts 160, with each undercut 160 forming a lip under one ridge 158. Undercuts 160 engage lid 104 when lid 104 is placed on base 102.

Support members 162 form part of base 102 and extend between cells 142. Support members 162 include a plurality of support members 162, with each support member 162 extending between two adjacent cells 142. Support members 162 provide structural support for base 102 and increase the rigidity of base 102 to prevent eggs from being damaged.

Vents 164 are formed on first side 138 and second side 140 of base 102. Vents 164 include a plurality of vents 164. Vents 164 are generally trapezoidal in shape and extend outwards from base 102. Gaps will be formed between lid 104 and base 102 in the area adjacent vents 164. Vents 164 allow moisture in base 102 to vent out of egg tray 100 when lid 104 is placed on base 102 through the gaps that are formed between lid 104 and base 102.

Stacking columns 166 are formed on first end 134, second end 136, first side 138, and second side 140 of base 102. Stacking columns 166 include a plurality of stacking columns 166. Stacking columns 166 are generally trapezoidal in shape and extend outwards from base 102. Bottoms of stacking columns 166 extend downward below bottoms of cells 142 of base 102. As such, egg tray 100 is supported by stacking columns 166 when egg tray 100 is placed on a flat surface. Further, stacking columns 166 fit into lid 104 to stack egg trays 100.

Base 102 also includes dividers 167 that are formed to accommodate stacking of egg tray 100. Base 102 shown in FIGS. 1-2 includes four dividers 167 separating plurality of cells 142 into four cells 142 to accommodate twelve eggs. Base 102 can include any number of dividers 167 in alternate embodiments to accommodate stacking of egg trays that include a plurality of cells 142. Dividers add rigidity to base 102 to improve the structural integrity of base 102.

Base 102 also includes sets of projections 168 formed in a bottom end of cells 142 and projecting inwards to cells 142. Sets of projections 168 include a plurality of sets of projections 168, each set of projections 168 formed on one cell 142. Sets of projections 168 are configured to support eggs that are placed in egg tray 100 and prevent the eggs from resting on bottoms of cells 142.

Dimples 170 are formed on a bottom of cells 142. Dimples 170 include a plurality of dimples 170, with each dimple 170 being formed on the bottom of one cell 142. Dimples 170 extend upwards into cells 142 from the bottoms of cells 142. Dimples 170 are configured to cushion the bottom of eggs that are placed in cells 142.

Lid 104 includes top 180, bottom 182, first end 184, second end 186, first side 188, and second side 190. Top 180 is opposite bottom 182; first end 184 is opposite second end 186; and first side 188 is opposite second side 190. Lid 104 is substantially rectangular shaped. Lid 104 is made from a paper material, for example laminated corrugated cardboard, paper paperboard, film, polyethylene terephthalate (PETE), or polypropylene (PP). Lid 104 can be made out of a recycled material. Lid 104 can be printed on. Lid 104 can be manufactured using any suitable method, including thermoforming, die cutting, or injection molding. Lid 104 forms a lid portion of egg tray 100 that is configured to releasably engage base 102 to open and close egg tray 100.

Lid 104 includes openings 192 extending through lid 104. Openings 104 includes a plurality of openings 104. Openings 192 are configured to fit around a top end of first posts 144 when lid 104 is placed on base 102. Slits 194 are positioned around openings 192 and extend through lid 104. Slits 194 are small cuts in lid 104. Slits 194 are configured to give lid 104 some flexibility in the area surrounding openings 192 to allow openings 192 to releasably engage first posts 144 at undercuts 148.

Cutouts 196 are formed on first end 184, second end 186, first side 188, second side 190, between opening 192 and first side 188, and between opening 192 and second side 190 of lid 104. Cutouts 196 are areas cut out of lid 104 that are configured to engage bottom ends of stacking columns 166 of base 102 when egg trays 100 are stacked together. Lid 104 further includes two flaps 198 extending downwards from lid 104. A first flap 198 is on first side 188 of lid 104, and a second flap 198 is on second side 190 of lid 104 (not shown in FIGS. 1-2). Flaps 198 are configured to be positioned in vents 164. Flaps 198 can be printed on or a label can be affixed to flaps 198 to display information pertaining to egg tray 100.

Egg tray 100 is a two-piece egg tray that can be used in lieu of traditional egg cartons. Egg tray 100 is advantageous over some traditional egg cartons (for example, those made out of expanded polystyrene (EPS), as it is fully recyclable. Base 102 is made out of a recyclable plastic, and lid 104 is made out of a recyclable paper material. Further, base 102 can be made out of a recycled PETE or other recycled material, and lid 104 can be made out of a recycled material. Both base 102 and lid 104 made out of recycled materials can be recycled again. Further, the amount of material used to make base 102 and lid 104 is significantly less in volume and weight than traditional egg cartons, for example egg cartons made out of molded pulp, molded fiber, PETE, and EPS. This allows base 102 to be economically made with respect to traditional egg carton designs.

Lid 104 can be releasably engaged on base 102, making egg tray 100 easy to use. Lid 104 can be snapped onto base 102 to engage lid 104 on base 102. Lid 104 can be removed from and placed back on base 102 to allow a user to open and close egg tray 100 to remove eggs from egg tray 100.

Figure 3A:
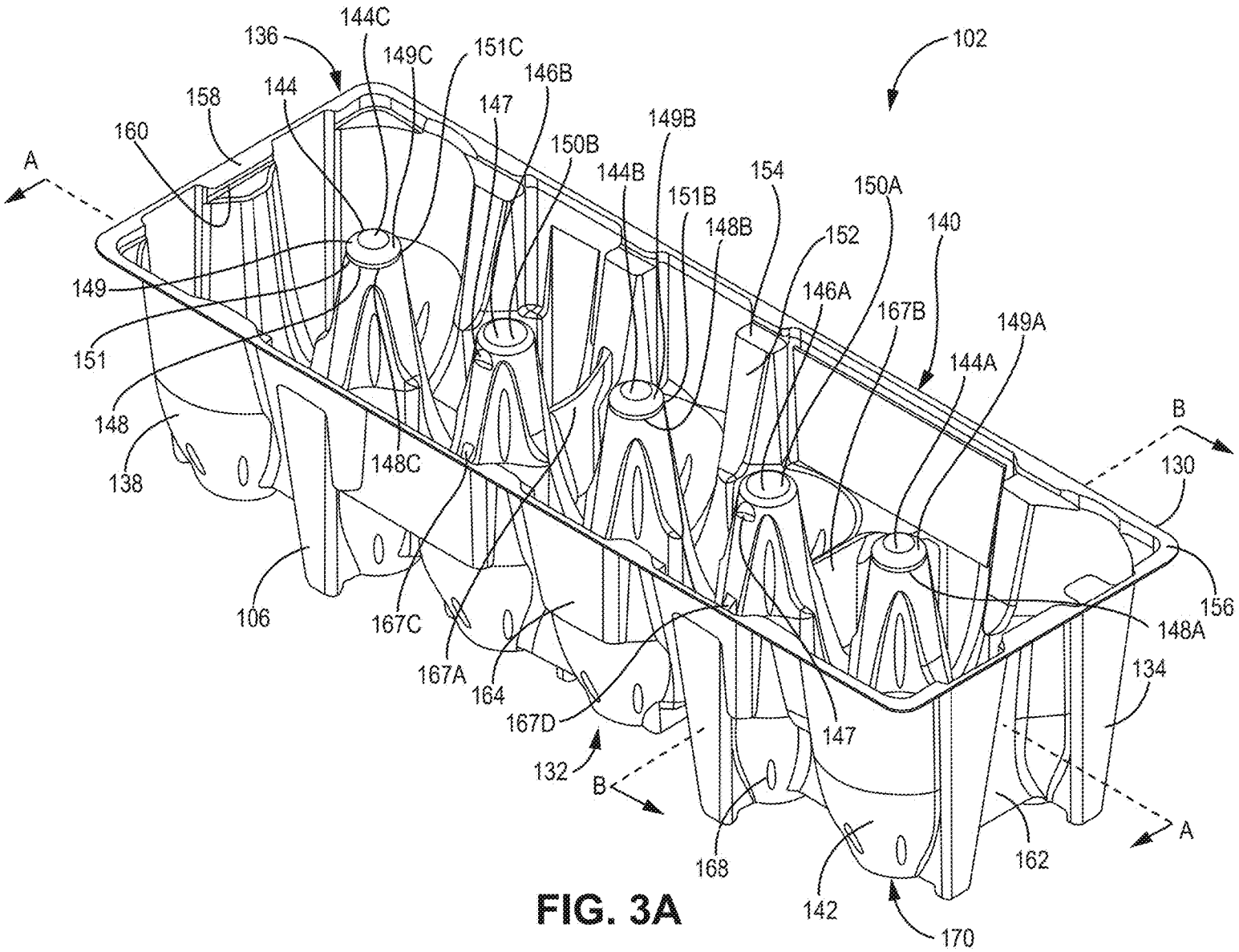
FIG. 3A is an isometric view of a base of the first embodiment of the egg tray shown in FIGS. 1-2.
Figure 3B:
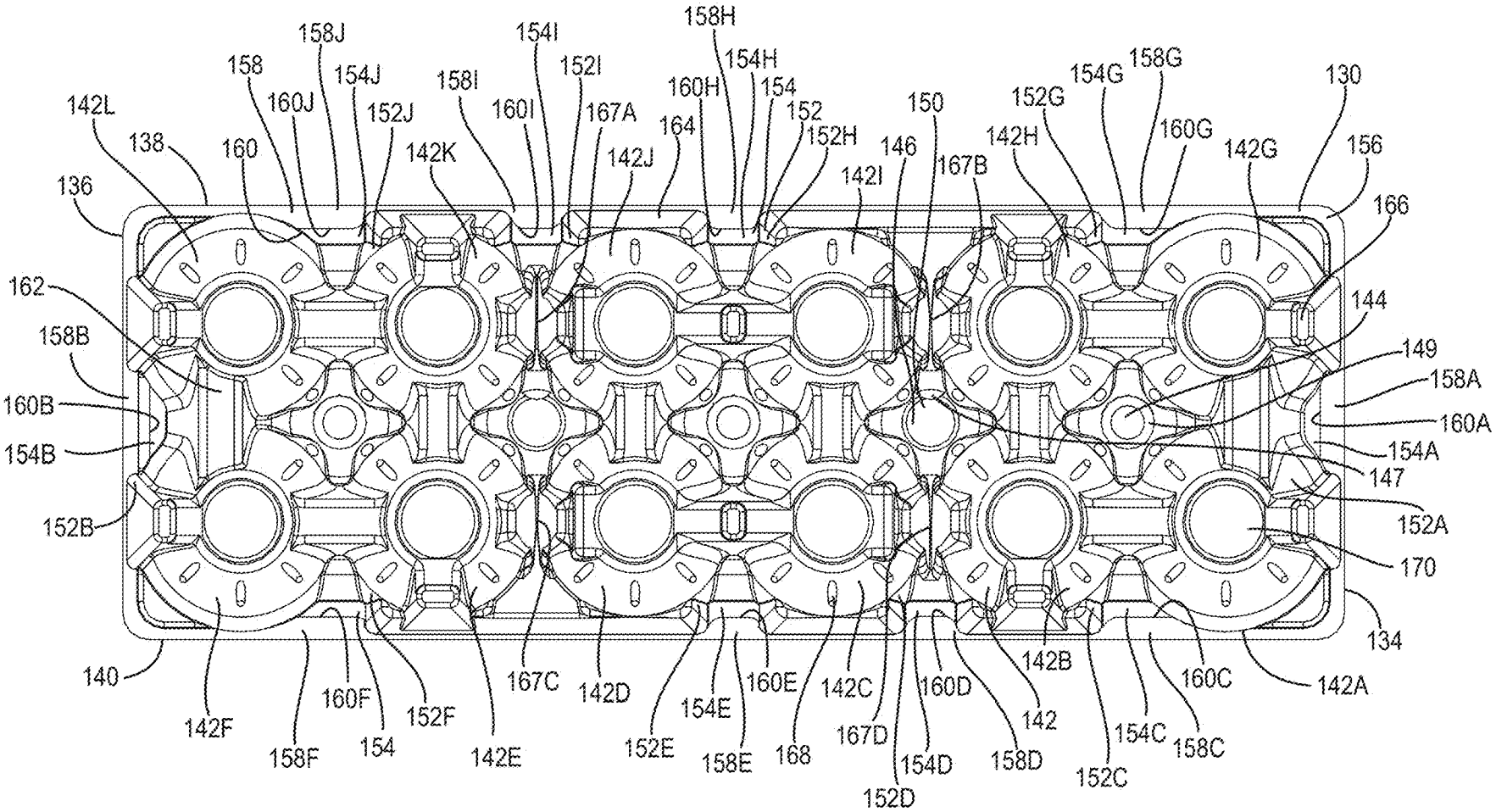
FIG. 3B is a top view of the base of the first embodiment of the egg tray.
Figure 3C:
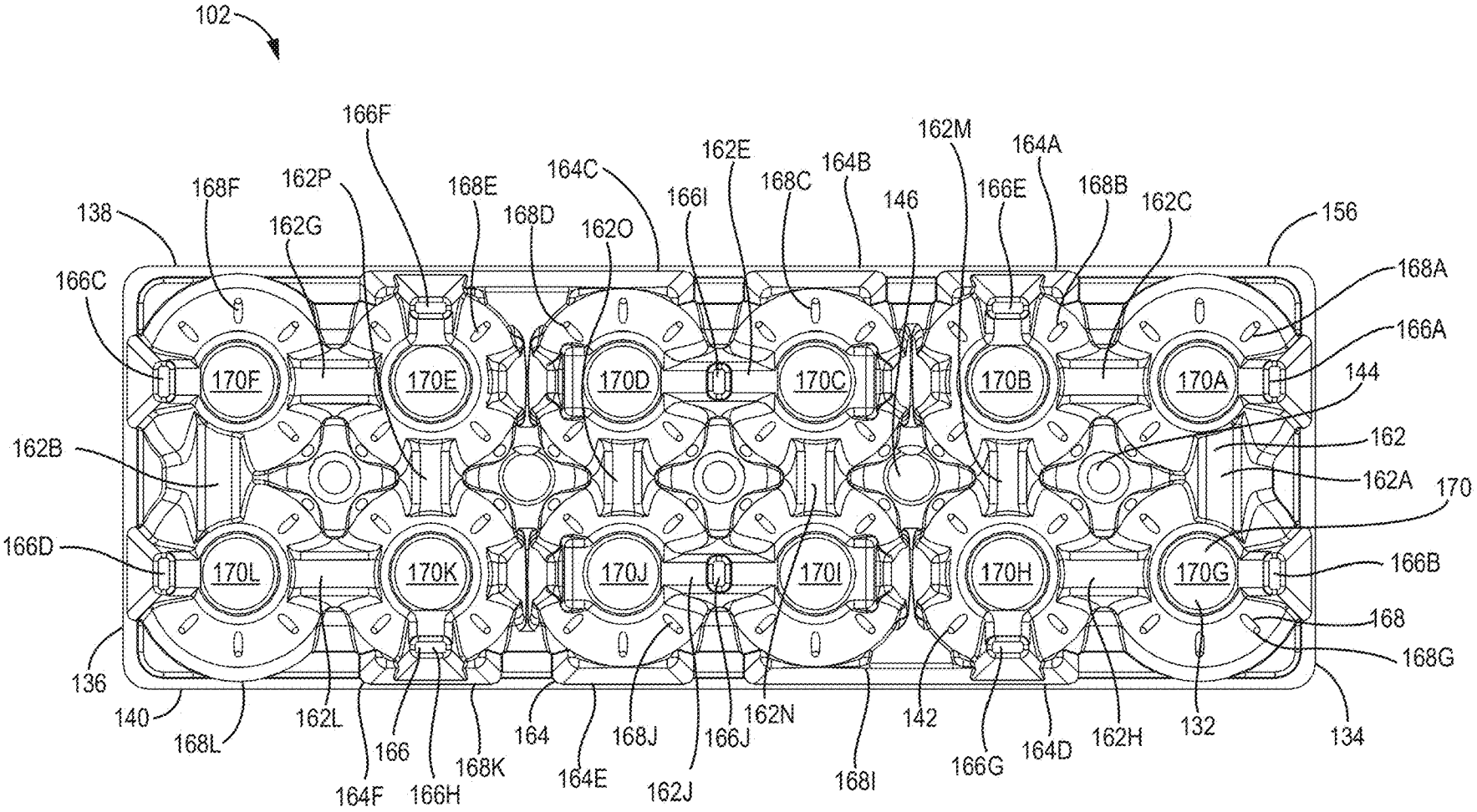
FIG. 3C is a bottom view of the base of the first embodiment of the egg tray.
Figure 3D:
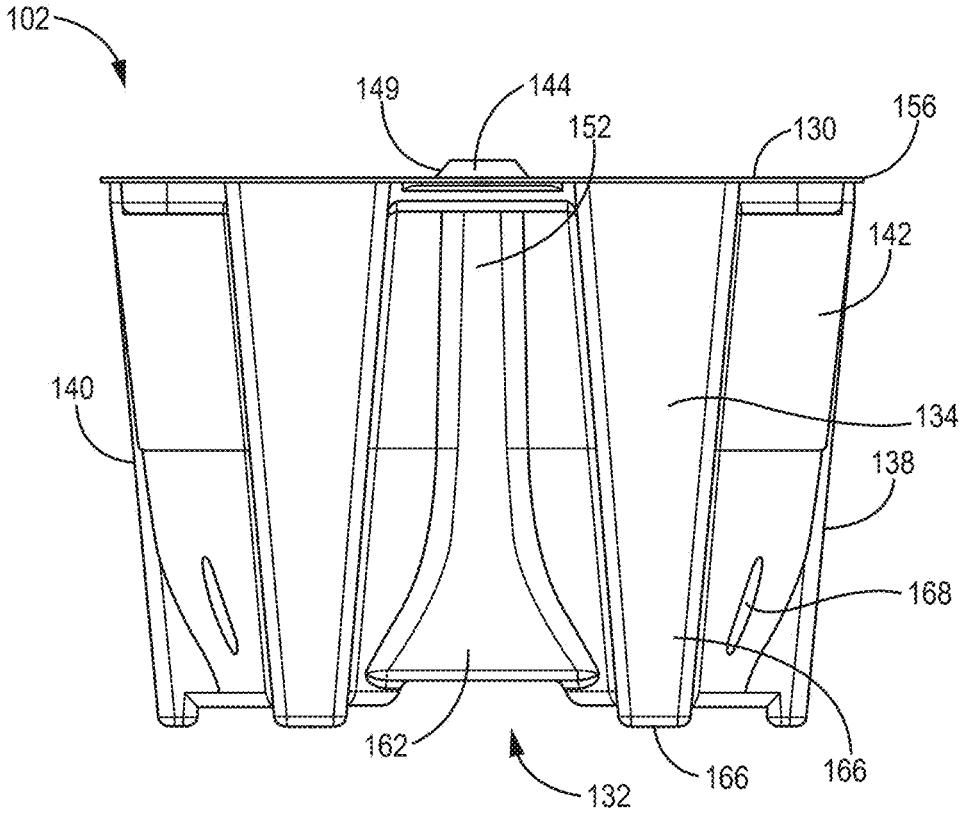
FIG. 3D is an end view of the base of the first embodiment of the egg tray.
Figure 3E:
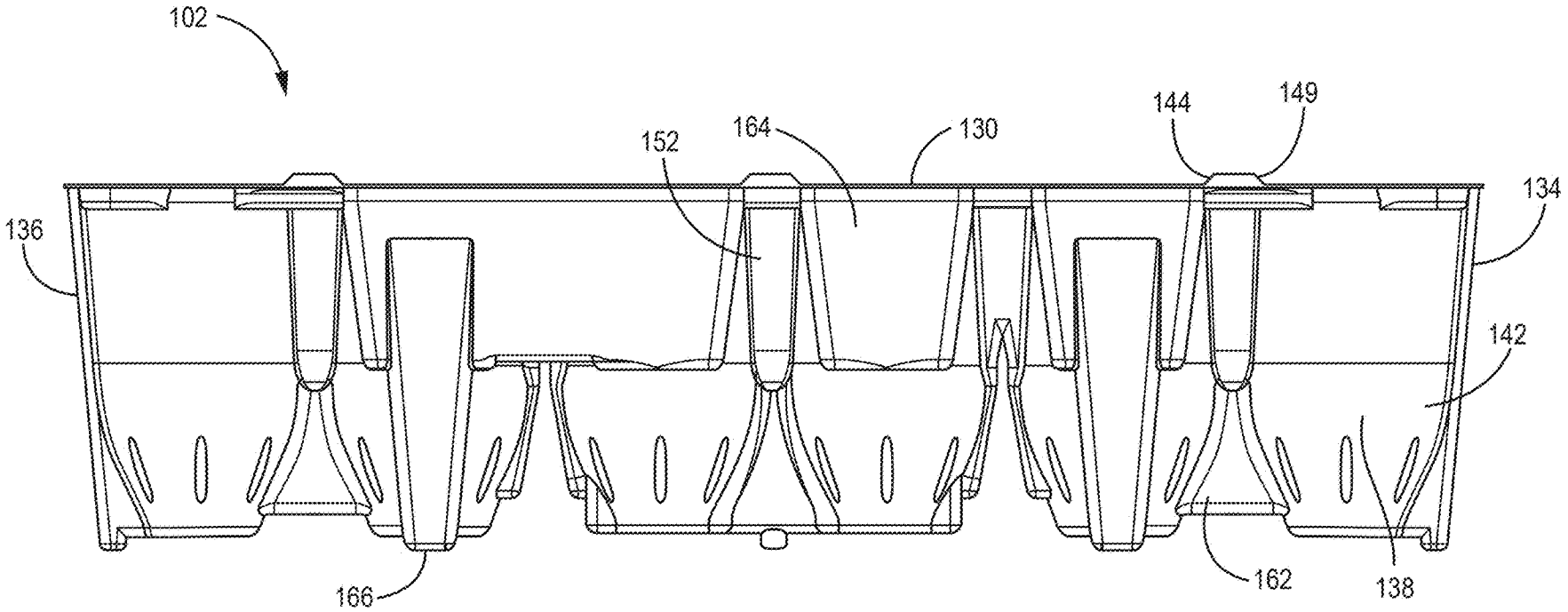
FIG. 3E is a side view of the base of the first embodiment of the egg tray.
Figure 4:
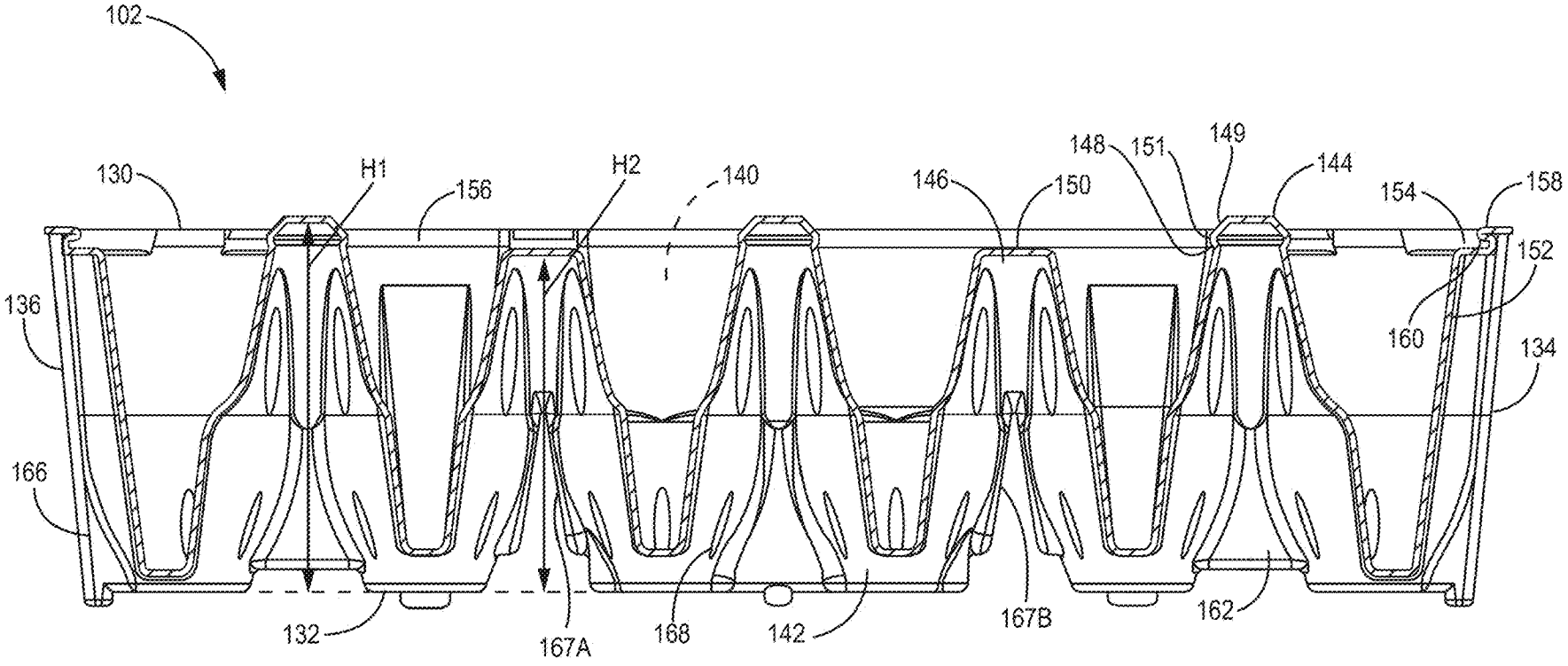
FIG. 4 is a side cross-sectional view of the base of the first embodiment of the egg tray taken along line A-A of FIG. 3A.
Figure 5:
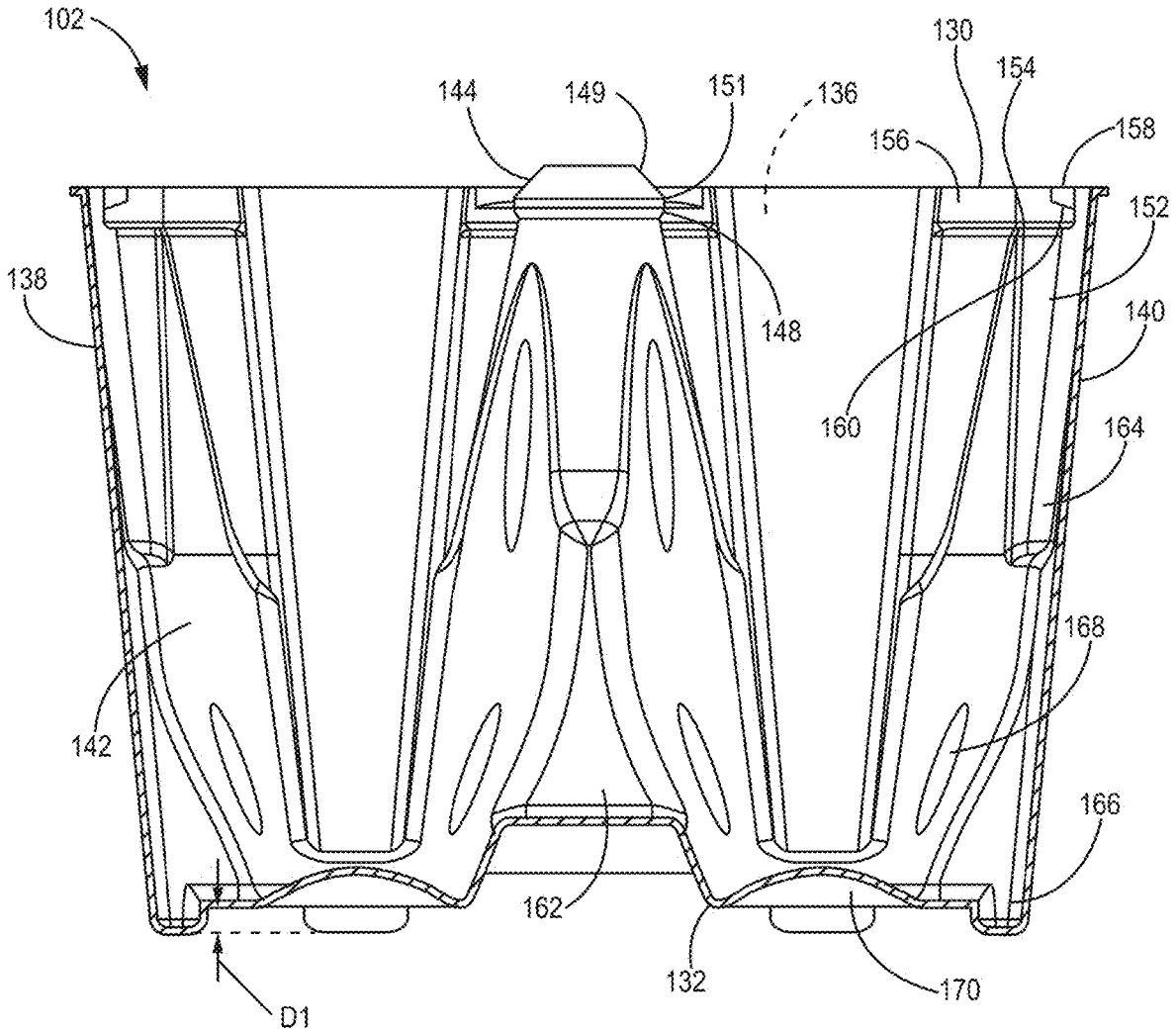
FIG. 5 is an end cross-sectional view of the base of the first embodiment of the egg tray taken along line B-B of FIG. 3A.

FIG. 3A is an isometric view of base 102 of egg tray 100. FIG. 3B is a top view of base 102 of egg tray 100. FIG. 3C is a bottom view of base 102 of egg tray 100. FIG. 3D is an end view of base 102 of egg tray 100. FIG. 3E is a side view of base 102 of egg tray 100. FIG. 4 is a cross-sectional view of base 102 of egg tray 102 taken along line 4-4 of FIG. 3D. FIG. 5 is a cross-sectional view of base 102 of egg tray 100 taken along line 5-5 of FIG. 3E. FIGS. 3A-5 will be discussed together. Base 102 includes top 130, bottom 132, first end 134, second end 136, first side 138, second side 140, cells 142, first posts 144, second posts 146, denest features 147, undercuts 148, support surfaces 150, side surface 151, ribs 152, ledges 154, rim 156, ridges 158, undercuts 160, support members 162, vents 164, stacking columns 166, dividers 167, sets of projections 168, and dimples 170. FIG. 4 further shows first height H1 and second height H2. FIG. 5 further shows distance D1.

Base 102 includes top 130, bottom 132, first end 134, second end 136, first side 138, and second side 140. Top 130 is opposite bottom 132; first end 134 is opposite second end 136; and first side 138 is opposite second side 140. Base 102 is sized to hold twelve eggs in the embodiment shown in FIGS. 3A-5. Base 102 is substantially rectangular shaped.

Base 102 includes cells 142 that are shaped to receive eggs. Base 102 includes twelve cells 142 in the embodiment shown in FIGS. 3A-5. Cells 142 are arranged in two rows with six cells 142 in each row. Cells 142 include cell 142A, cell 142B, cell 142C, cell 142D, cell 142E, cell 142F, cell 142G, cell 142H, cell 142I, cell 142J, cell 142K, and cell 142L, which are labeled in FIG. 3B. Cell 142A is adjacent first end 134, first side 138, cell 142B, and cell 142G; cell 142B is adjacent first cell 142A, first side 138, cell 142C, and cell 142H; cell 142C is adjacent cell 142B, first side 138, cell 142D, and cell 142I; cell 142D is adjacent cell 142C, first side 138, cell 142E, and cell 142K; cell 142E is adjacent cell 142D, first side 138, cell 142F, and cell 142K; cell 142F is adjacent cell 142E, first side 138, second end 136, and cell 142L; cell 142G is adjacent first end 134, cell 142A, cell 142H, and second side 140; cell 142H is adjacent cell 142G, cell 142B, cell 142I, and second side 140; cell 142I is adjacent cell 142H, cell 142C, cell 142J, and second side 140; cell 142J is adjacent cell 142I, cell 142D, cell 142K, and second side 140; cell 142K is adjacent cell 142J, cell 142E, cell 142L, and second side 140; and cell 142L is adjacent 142K, cell 142F, second end 136, and second side 140.

First posts 144 and second posts 146 are formed between cells 142 and extend upwards. First posts 144 and second posts 146 are configured to engage lid 104 when lid 104 is placed on base 102 to close egg tray 100. First posts 144 include first post 144A, first post 144B, and first post 144C, which are labeled in FIG. 3A. First post 144A is positioned between cell 142A, cell 142B, cell 142H, and cell 142G; first post 144B is positioned between cell 142C, cell 142D, cell 142J, and cell 142I; and first post 144C is positioned between cell 142E, cell 142F, cell 142L, and cell 142K. First posts 144 have first height H1, as shown in FIG. 4. Second posts 146 include second post 146A and second post 146B, which are labeled in FIG. 3A. Second post 146A is positioned between cell 142B, cell 142C, cell 142I, and cell 142H; and second post 144D is positioned between cell 142D, cell 142E, cell 142K, and cell 142J. Second posts 146 have second height H2, as shown in FIG. 4. First height H1 is greater than second height H2. As such, first posts 144 have a greater height than second posts 146. First posts 144 are configured to extend through lid 104 to engage lid 104 when lid 104 is placed on base 102, allowing lid 104 to snap onto base 102. Lid 104 is configured to rest upon second posts 146 when lid 104 is placed on base 102.

First posts 144 include undercuts 148 formed on an upper end of first posts 144. Undercuts 148 include undercut 148A, undercut 148B, and undercut 148C, which are labeled in FIG. 3A. Undercut 148A is formed on an upper end of first post 144A; undercut 148B is formed on an upper end of first post 144B; and undercut 148C is formed on an upper end of first post 144C. Undercuts 148 extend circumferentially inward to form a lip on first posts 144. First posts 144 are configured to extend through openings 192 in lid 104, and undercuts 148 are configured to engage lid 104 to retain lid 104 on base 102.

First posts 144 also include chamfers 149 formed along a circumference at a top end of first posts 144. Chambers 149 include chamfer 149A, chamfer 149B, and chamfer 149C, which are labeled in FIG. 3A. Chamfer 149A is formed at a top end of first post 144A; chamfer 149B is formed at a top end of first post 144B; and chamfer 149C is formed at a top end of first post 144C. Chamfers 149 help to guide lid 104 onto first posts 144.

Second posts 146 include support surfaces 150 that form a flat top surface of second posts 146. Support surfaces 150 include support surface 150A and support surface 150B, which are labeled in FIG. 3A. Support surface 150A forms a flat top surface of second post 146A; and support surface 150B forms a flat top surface of second post 146B. Lid 104 rests upon support surfaces 150 when lid 104 is positioned on base 102.

Base 102 includes dividers 167 to improve the structural integrity of egg tray 100. Dividers 167 include divider 167A, divider 167B, divider 167C, and divider 167D, which are labelled in FIG. 3A and FIG. 3B.

Base 102 further includes ribs 152 extending between cells 142. Ribs 152 include rib 152A, rib 152B, rib 152C, rib 152D, rib 152E, rib 152F, rib 152G, rib 152H, rib 152I, and rib 152J, which are labeled in FIG. 3B. Rib 152A is positioned on first end 134 and extends between cell 142A and cell 142G; rib 152B is positioned on second end 136 and extends between cell 142F and cell 142L; rib 152C is positioned on first side 138 and extends between cell 142A and cell 142B; rib 152D is positioned on first side 138 and extends between cell 142B and cell 142C; rib 152E is positioned on first side 138 and extends between cell 142C and cell 142D; rib 152F is positioned on first side 138 and extends between cell 142E and cell 142F; rib 152G is positioned on second side 140 and extends between cell 142G and cell 142H; rib 152H is positioned on second side 140 and extends between cell 142I and cell 142J; rib 152I is positioned on second side 140 and extends between cell 142J and cell 142K; and rib 152J is positioned on second side 140 and extends between cell 142K and cell 142L. Ribs 152 are generally trapezoidal in shape. Ribs 152 extend between adjacent cells 142 to provide structural support to base 102.

Ledges 154 form a top of ribs 152. Ledges 154 include ledge 154A, ledge 154B, ledge 154C, ledge 154D, ledge 154E, ledge 154F, ledge 154G, ledge 154H, ledge 154I, and ledge 154J, which are labeled in FIG. 3B. Ledge 154A is positioned on first end 134 and forms a top of rib 152A; ledge 154B is positioned on second end 136 and forms a top of rib 152B; ledge 154C is positioned on first side 138 and forms a top of rib 152C; ledge 154D is positioned on first side 138 and forms a top of rib 152D; ledge 154E is positioned on first side 138 and forms a top of rib 152E; ledge 154F is positioned on first side 138 and forms a top of rib 152F; ledge 154G is positioned on second side 140 and forms a top of rib 152G; ledge 154H is positioned on second side 140 and forms a top of rib 152H; ledge 154I is positioned on second side 140 and forms a top of rib 152I; and ledge 154J is positioned on second side 140 and forms a top of rib 152J. When lid 104 is placed on base 102, lid 104 rests upon and is supported by ledges 154.

Rim 156 extends along an upper perimeter of base 102 at top 130 of base 102. Rim 156 is configured to engage lid 104 when lid 104 is placed on base 102 of egg tray 100. Lid 104 can be snapped onto base 102 in part by snapping lid 104 under rim 156. Ridges 158 form a portion of rim 156 and extend inwards from an outer edge of rim 156. Ridges 158 include ridge 158A, ridge 158B, ridge 158C, ridge 158D, ridge 158E, ridge 158F, ridge 158G, ridge 158H, ridge 158I, and ridge 158J, which are labeled in FIG. 3B. Ridge 158A is positioned on first end 134 and aligned with rib 152A and ledge 154A between cell 142A and cell 142G; ridge 158B is positioned on second end 136 and is aligned with rib 152B and ledge 154B between cell 142F and cell 142L; ridge 156C is positioned on first side 138 and is aligned with rib 152C and ledge 154C between cell 142A and cell 142B; ridge 156D is positioned on first side 138 and is aligned with rib 152D and ledge 154D between cell 142B and cell 142C; ridge 156E is positioned on first side 138 and is aligned with rib 152E and ledge 154E between cell 142C and cell 142D; ridge 156F is positioned on first side 138 and is aligned with rib 152F and ledge 154F between cell 142E and cell 142F; ridge 156G is positioned on second side 140 and is aligned with rib 152G and ledge 154G between cell 142G and cell 142H; ridge 156H is positioned on second side 140 and is aligned with rib 152H and ledge 154H between cell 142I and cell 142J; ridge 156I is positioned on second side 140 and is aligned with rib 152I and ledge 154I between cell 142J and cell 142K; and ridge 156J is positioned on second side 140 and is aligned with rib 152J and ledge 154J between cell 142K and cell 142L.

Ridges 158 have undercuts 160 that form a lip under ridges 158. Undercuts 160 include undercut 160A, undercut 160B, undercut 160C, undercut 160D, undercut 160E, undercut 160F, undercut 160G, undercut 160H, undercut 160I, and undercut 160J, which are labeled in FIG. 3B. Undercut 160A is formed on a bottom side of ridge 158A; undercut 160B is formed on a bottom side of ridge 158B; undercut 160C is formed on a bottom side of ridge 158C; undercut 160D is formed on a bottom side of ridge 158D; undercut 160E is formed on a bottom side of ridge 158E; undercut 160F is formed on a bottom side of ridge 158F; undercut 160G is formed on a bottom side of ridge 158G; undercut 160H is formed on a bottom side of ridge 158H; undercut 160I is formed on a bottom side of ridge 158I; and undercut 160J is formed on a bottom side of ridge 158J. Undercuts 160 engage lid 104 when lid 104 is placed on base 102. Lid 104 can be snaped onto base 102 using undercuts 160.

Base 102 includes support members 162 that extend between cells 142. Support members 162 include support member 162A, support member 162B, support member 162C, support member 162E, support member 162G, support member 162H, support member 162J, support member 162L, support member 162M, support member 162N, support member 162O, and support member 162P, which are labeled in FIG. 3C. Support member 162A is positioned on first end 134 below rib 152A and between cell 142A and cell 142G; and support member 162B is positioned on second end 136 between rib 152B and between cell 142F and cell 142L. Support member 162A and support member 162B are integrally formed and flush with rib 152A and rib 152B, respectively. Support member 162C is positioned on first side 138 below rib 152C and between cell 142A and cell 142B; support member 162E is positioned on first side 138 below rib 152E and between cell 142C and cell 142D; support member 162G is positioned on first side 138 below rib 152F and between cell 142E and cell 142F; support member 162H is positioned on second side 140 below rib 152G and between cell 142G and cell 142H; support member 162J is positioned on second side 140 below rib 152H and between cell 142I and cell 142J; support member 162L is positioned on second side 140 below rib 152J and between cell 142K and cell 142L; support member 162M is positioned in an interior of base 102 and between cell 142B and cell 142H; support member 162N is positioned in an interior of base 102 and between cell 142C and cell 142I; support member 162O is positioned in an interior of base 102 and between cell 142D and cell 142J; and support member 162P is positioned in an interior of base 102 and between cell 142E and cell 142K. Support members 162C-142L jut inward from ribs 152C-J. Support members 162 provide structural support for base 102 and increase the rigidity and stiffness of base 102 and to reduce the flexing and twisting of egg tray 100. This prevents eggs in egg tray 100 from being damaged. Support members 162 can have different heights to change where egg tray 100 can flex to increase the strength and rigidity of egg tray 100. Further, support members 162 allow for receipt of ink jet date coding, food safety information, and other text to be applied to one or more of support members 162.

Vents 164 are formed on first side 138 and second side 140 of base 102. Vents 164 include vent 164A, vent 164B, vent 164C, vent 164D, vent 164E, and vent 164F, which are labeled in FIG. 3C. Vent 164A is positioned on first side 138 and is aligned with cell 142B; vent 164B is positioned on first side 138 and is aligned with cell 142C; vent 164C is positioned on first side 138 and spans across cell 142D and cell 142E; vent 164D is positioned on second side 140 and spans across cell 142H and cell 142I; vent 164E is positioned on second side 140 and is aligned with cell 142J; and vent 164F is positioned on second side 140 and is aligned with cell 142K. Vents 164 extend outwards from cells 142. Vents 164 are generally trapezoidal in shape. Gaps will be formed between lid 104 and base 102 in the area adjacent vents 164. Vents 164 allow moisture in base 102 to vent out of egg tray 100 when lid 104 is placed on base 102 through the gaps that are formed between base 102 and lid 104.

Stacking columns 166 are formed on first end 134, second end 136, first side 138, second side 140, and on support members 162 of base 102. Stacking columns 166 include stacking column 166A, stacking column 166B, stacking column 166C, stacking column 166D, stacking column 166E, stacking column 166F, stacking column 166G, stacking column 166H, stacking column 166I, and stacking column 166J which are labeled in FIG. 3C. Stacking column 166A is positioned on first end 134 and is aligned with cell 142A; stacking column 166B is positioned on first end 134 and is aligned with cell 142G; stacking column 166C is positioned on second end 136 and is aligned with cell 142F; stacking column 166D is positioned on second end 136 and is aligned with cell 142L; stacking column 166E is positioned on first side 138 and is aligned with cell 142B and vent 164A; stacking column 166F is positioned on first side 138 and is aligned with cell 142E and vent 142C; stacking column 166G is positioned on second side 140 and is aligned with cell 142H and vent 142D; stacking column 166H is positioned on second side 140 and is aligned with cell 142K and vent 142F; stacking column 166I is positioned on first side 138 on support member 162E between cell 142I and cell 142J; and stacking column 166J is positioned on second side 140 on support member 162J between cell 142C and cell 142D. Stacking columns 166A-166H are generally trapezoidal in shape and jut outwards from base 102. Stacking columns 166I-166J are generally rectangular in shape and jut outwards from base 102. Bottoms of stacking columns 166 extend downward below bottoms of cells 142 of base 102. Stacking columns 166 extend distance D1 below a bottom of cell 142, as shown in FIG. 5. As such, egg tray 100 is supported by stacking columns 166 when egg tray 100 is placed on a flat surface. Further, stacking columns 166 fit into lid 104 to stack egg trays 100.

Base 102 also includes sets of projections 168 positioned on a bottom end of cells 142 and projecting inwards to cells 142. Sets of projections 168 include set of projections 168A, sets of projections 168B, sets of projections 168C, sets of projections 168D, sets of projections 168E, sets of projections 168F, sets of projections 168G, and sets of projections 168H, which are labeled in FIG. 3C. Set of projections 168A are positioned on cell 142A and project inwards from cell 142A; set of projections 168B are positioned on cell 142B and project inwards from cell 142B; set of projections 168C are positioned on cell 142C and project inwards from cell 142C; set of projections 168D are positioned on cell 142D and project inwards from cell 142D; set of projections 168E are positioned on cell 142E and project inwards from cell 142E; set of projections 168F are positioned on cell 142F and project inwards from cell 142F; set of projections 168G are positioned on cell 142G and project inwards from cell 142G; and set of projections 168H are positioned on cell 142H and project inwards from cell 142H. Set of projections 168 are configured to support eggs that are placed in egg tray 100 and prevent the eggs from resting on the bottoms of cells 142.

Dimples 170 are formed on a bottom of cells 142. Dimples 170 include dimple 170A, dimple 170B, dimple 170C, dimple 170D, dimple 170E, dimple 170F, dimple 170G, dimple 170H, dimple 170I, dimple 170J, dimple 170J, dimple 170K and dimple 170L, which are labeled in FIG. 3C. Dimple 170A forms a bottom of cell 142A; dimple 170B forms a bottom of cell 142B; dimple 170C forms a bottom of cell 142C; dimple 170D forms a bottom of cell 142D; dimple 170BE forms a bottom of cell 142E; dimple 170F forms a bottom of cell 142F; dimple 170G forms a bottom of cell 142G; dimple 170H forms a bottom of cell 142H; dimple 170I forms a bottom of cell 142I; dimple 170J forms a bottom of cell 142J; dimple 170K forms a bottom of cell 142K; and dimple 170L forms a bottom of cell 142L. Dimples 170 extend upwards from a bottom of cells 142, as shown in FIG. 5. Dimples 170 are configured to cushion the bottom of eggs that are placed in cells 142.

Figure 6A:
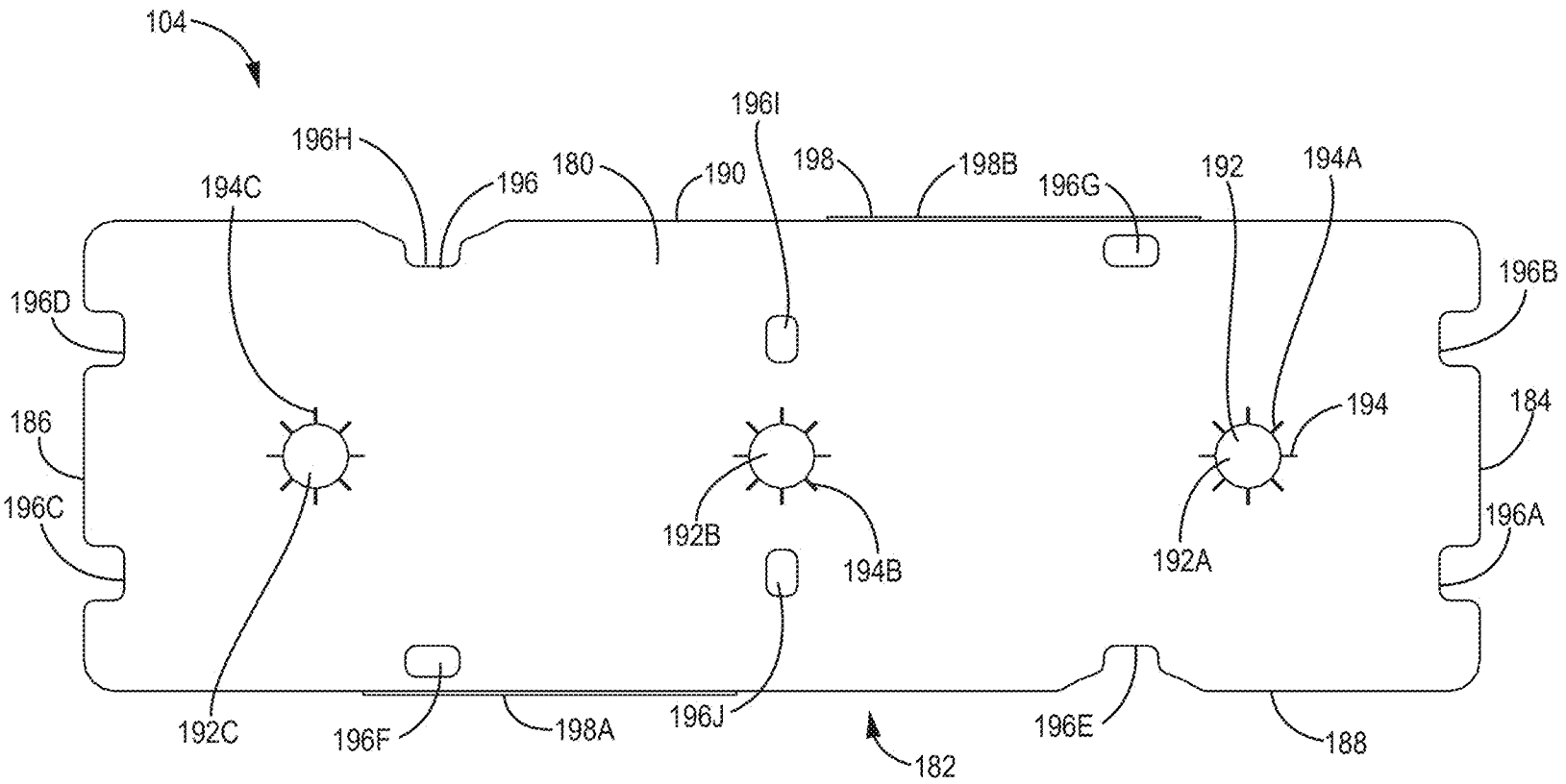
FIG. 6A is a top view of a lid of the first embodiment of the egg tray shown in FIGS. 1-2.
Figure 6B:
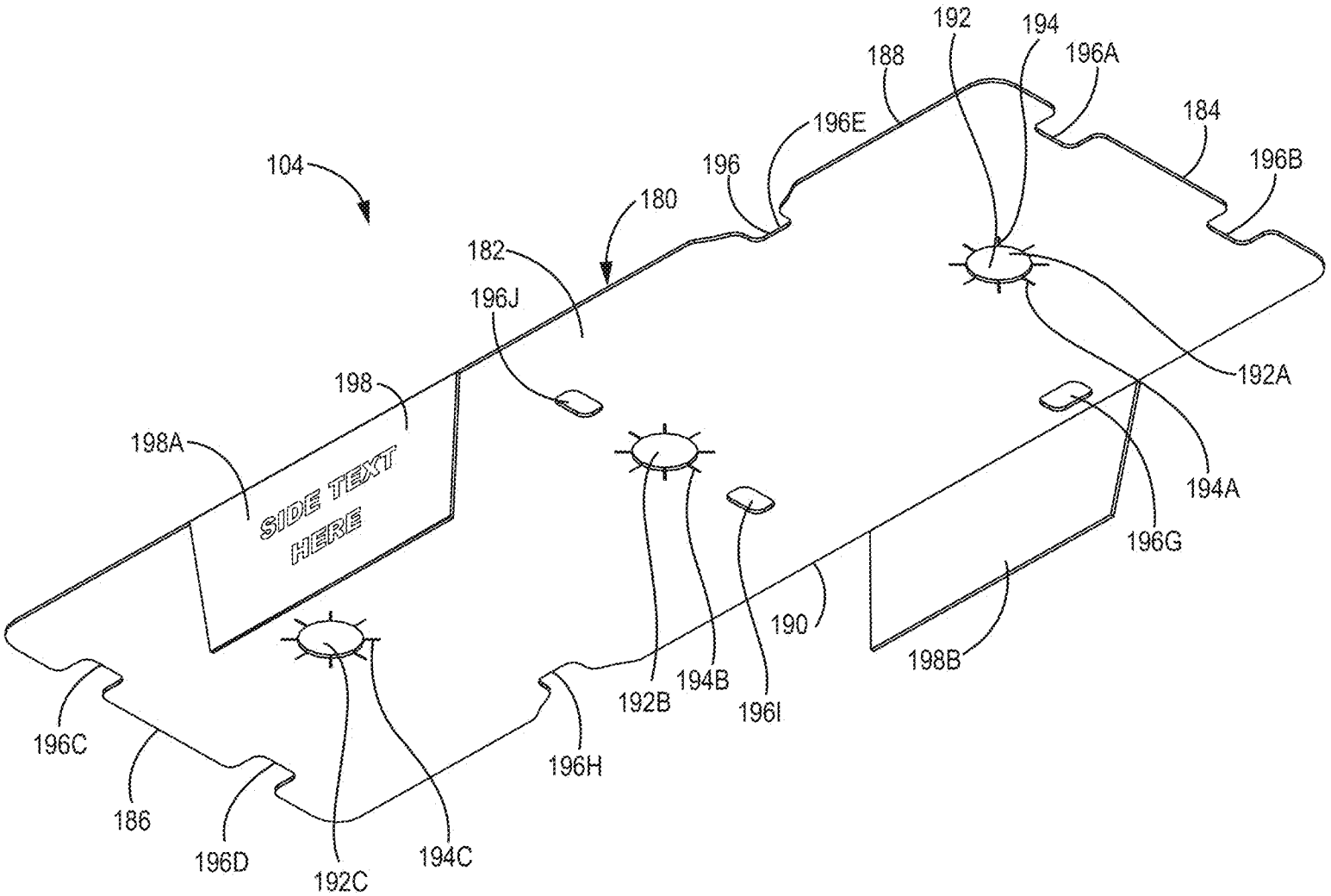
FIG. 6B is a bottom isometric view of the lid of the first embodiment of the egg tray.

FIG. 6A is a top view of lid 104 of egg tray 100 shown in FIGS. 1-2. FIG. 6B is a bottom isometric view of the lid of the first embodiment of the egg tray. FIGS. 6A-6B will be discussed together. Lid 104 includes top 180, bottom 182, first end 184, second end 186, first side 188, second side 190, openings 192, sets of slits 194, cutouts 196, and flaps 198.

Lid 104 includes top 180, bottom 182, first end 184, second end 186, first side 188, and second side 190. Top 180 is opposite bottom 182; first end 184 is opposite second end 186; and first side 188 is opposite second side 190. Lid is substantially rectangular shaped. Lid 104 is sized to fit on base 102 in the embodiment shown in FIG. 6.

Lid 104 includes openings 192 extending through lid 104. Openings 192 include opening 192A, opening 192B, and opening 192C. Opening 192A extends through lid 104 adjacent first end 184; opening 192B extends through lid 104 in a middle of lid 104; and opening 192 extends through lid 104 adjacent second end 186. Openings 192 are configured to fit around a top end of first posts 144 when lid 104 is placed on base 102.

Sets of slits 194 are positioned around openings 192 and extend through lid 104. Sets of slits 194 are small cuts in lid 104. Sets of slits 194 include set of slits 194A, set of slits 194B, and set of slits 194C. Set of slits 194A extend through lid 104 surrounding opening 192A; set of slides 194B extend through lid 104 surrounding opening 192B; and set of slits 194C extend through lid 104 surrounding opening 192C. Slits 194 are configured to give lid 104 some flexibility in the area surrounding openings 192 to allow openings 192 to releasably engage first posts 144.

Lid 104 further includes cutouts 196 on first end 184, second end 186, first side 188, and second side 190. Cutouts 196 include cutout 196A, cutout 196B, cutout 196C, cutout 196D, cutout 196E, cutout 196F, cutout 196G, cutout 196H, cutout 196I, and cutout 196J. Cutout 196A is positioned on first end 184 and is an area cut out of a perimeter of lid 104; cutout 196B is positioned on first end 184 and is an area cut out of a perimeter of lid 104; cutout 196C is positioned on second end 186 and is an area cut out of a perimeter of lid 104; cutout 196D is positioned on second end 186 and is an area cut out of a perimeter of lid 104; cutout 196E is positioned on first side 188 and is an area cut out of a perimeter of lid 104; cutout 196F is positioned on first side 188 and is an opening extending through lid 104; cutout 196G is positioned on second side 190 and is an area cut out of a perimeter of lid 104; cutout 196H is positioned on second side 190 and is an opening extending through lid 104; cutout 196I is positioned on second side 190 and is an opening extending through lid 104; and cutout 196J is positioned on first side 188 and is an opening extending through lid 104. Cutout 196E and cutout 196H are designed to have a larger cutout area to provide space for a user to grasp lid 104 and remove lid 104 from egg tray 100. Cutouts 196 are configured to engage bottom ends of stacking columns 166 of base 102 when egg trays 100 are stacked together.

Lid 104 also includes flaps 198 on first side 188 and second side 190. Flaps 198 include first flap 198A and second flap 198B. First flap 198A is positioned on first side 188 near second end 186 and extending downwards from lid 104; and second flap 198B is positioned on second side 190 near first end 184 and extending downwards from lid 104. Flaps 198 are configured to be positioned in vents 164. More specifically, flap 198A is configured to be positioned in vent 164C, and flap 198B is configured to be positioned in vent 164D. Flaps 198 can be printed on. Base 102 can be made of a transparent material, allowing the printing on flaps 198 to be viewable through vents 164 of base 102.

Figure 7:
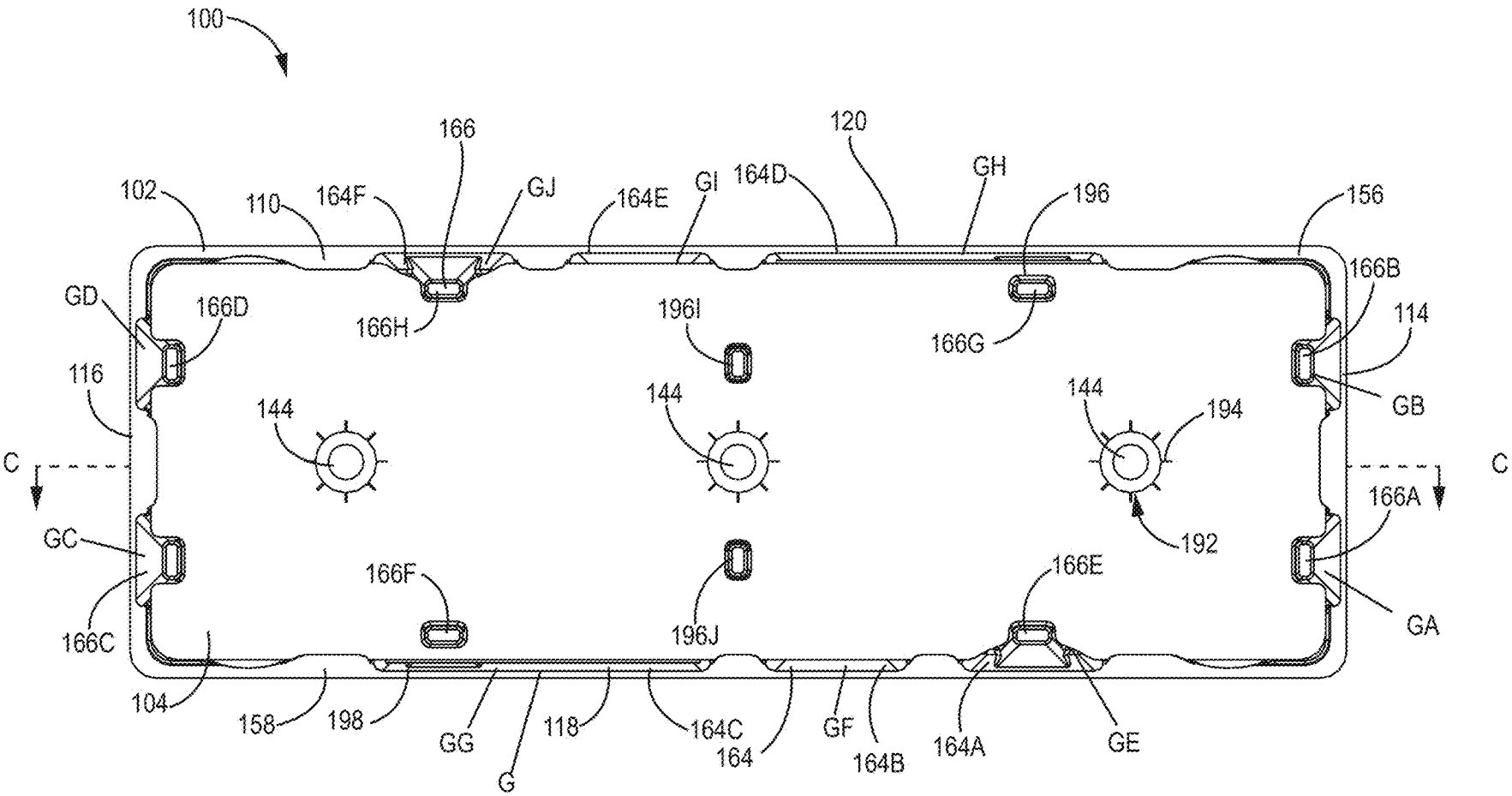
FIG. 7 is a top view of the first embodiment of the egg tray.

FIG. 7 is a top view of egg tray 100. Egg tray 100 includes base 102 and lid 104. Egg tray 100 has top 110, bottom 112 (not shown in FIG. 7), first end 114, second end 116, first side 118, and second side 120. Base 102 includes first posts 144, rim 156, ridges 158, vents 164, and stacking columns 166. Lid 104 includes openings 192, slits 194, cutouts 196, and flaps 198. FIG. 7 further shows gaps G.

Egg tray 100 has the structure and design as discussed above in reference to FIGS. 1-6. As shown in FIG. 7, gaps G are formed between base 102 and lid 104 in areas adjacent to vents 164 and in areas adjacent to stacking columns 166. Vent 164A, vent 164B, vent 164C, vent 164D, vent 164E, and vent 164F, as discussed above in reference to FIGS. 3A-5, are labeled in FIG. 7. Stacking column 166A, stacking column 166B, stacking column 166C, stacking column 166D, stacking column 166E, stacking column 166F, stacking column 166G, and stacking column 166H, as discussed above in reference to FIGS. 3A-5, are labeled in FIG. 7.

Gaps G include gap GA, gap GB, gap GC, gap GD, gap GE, gap GF, gap GG, gap GH, gap GI, and gap GJ. Gap GA, gap GB, gap GC, and gap GD are defined by stacking columns 166. Specifically, gap GA is formed between stacking column 166A and lid 104; gap GB is formed between stacking column 166B and lid 104; gap GC is formed between stacking column 166C and lid 104; and gap GD is formed between stacking column 166D and lid 104. Gap GE and gap GJ are defined by vents 164 and stacking columns 166. Specifically, gap GE is formed between vent 164A and stacking column 166E, and lid 104; and gap GJ is formed between vent 164F and stacking column 166H, and lid 104. Gap GF, gap GG, gap GH, and gap GI are defined by vents 164. Specifically, gap GF is formed between vent 164B and lid 104; gap GG is formed between vent 164C and lid 104; gap GH is formed between vent 164D and lid 104; and gap GI is formed between vent 164E and lid 104. Gap GG and gap GH are longer than the other gaps G, as vent 164C and vent 164D both span two cells 142 (shown in FIGS. 1-5).

Gaps G are formed between base 102 and lid 104 to allow moisture out of egg tray 100. In egg packing facilities, eggs are often warm and wet from being washed when they are packed into egg cartons. The warmth and wetness can cause moisture in egg tray 100. Vents 164 and stacking columns 166 are formed in base 102 in part to allow gaps G to be formed between 102 and lid 104 to allow the moisture in egg tray 100 to escape out of egg tray 100.

Figure 8:
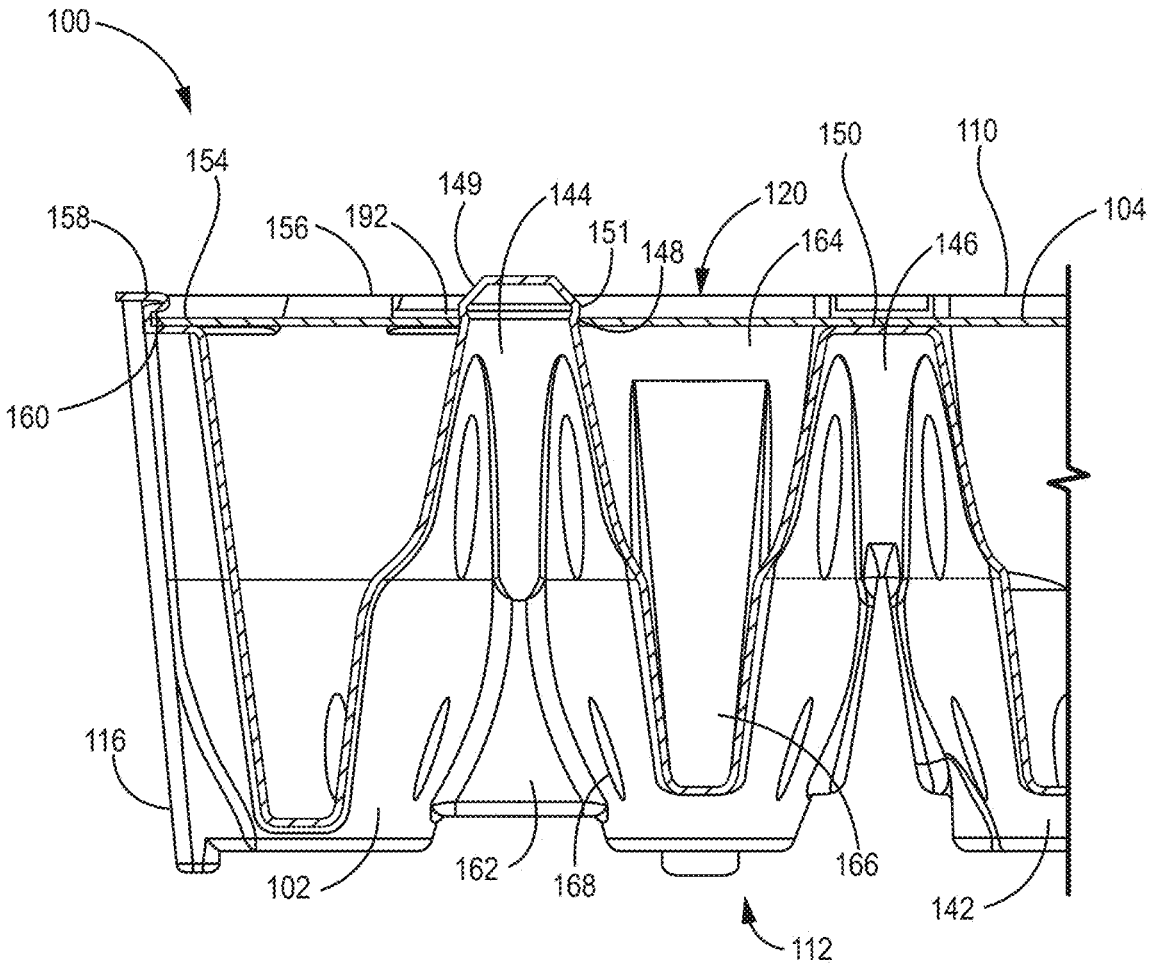
FIG. 8 is a side cross-sectional view of a first portion of the first embodiment of the egg tray taken along line C-C of FIG. 7.

FIG. 8 is a side cross-sectional view of a first portion of egg tray 100 taken along line 8-8 of FIG. 7. Egg tray 100 includes base 102 and lid 104. Egg tray 100 has top 110, bottom 112, first end 114 (not shown in FIG. 8), second end 116, first side 118 (not shown in FIG. 8), and second side 120. Base 102 includes cells 142, first posts 144, second posts 146, undercuts 148, chamfers 149, support surfaces 150, ribs 152, ledges 154, rim 156, ridges 158, undercuts 160, support members 162, vents 164, stacking columns 166, and sets of projections 168. Lid 104 includes openings 192.

Egg tray 100 has the structure and design as discussed above in reference to FIGS. 1-7. FIG. 8 shows a blown-up view of a second end of egg tray 100 for clarity.

Base 102 of egg tray 100 includes first posts 144 having undercuts 148 and chamfers 149. One first post 144 is shown in cross-section in FIG. 8. As shown in FIG. 8, undercut 148 extends along a circumference on a top of first post 144 opposite chamfer 149. Undercut 148 of first post 144 helps to keep top of lid 104 fixed in place when lid 104 is placed on base 102. Chamfer 149 also extends along a circumference of a top of first post 144 and helps to guide opening 192 of lid 104 onto first post 144 to engage undercut 148 of first post 144. Surface of undercut 148 and surface of chamfer 149 on first post 144 are divided by side surface 151. Slits 194 on lid 104 are not shown in FIG. 8, but slits 194 surround opening 192 in lid 104 and help to guide lid 104 onto first post 144.

Base 102 of egg tray 100 also includes second posts 146 having support surfaces 150. One second post 146 is shown in cross-section in FIG. 8. As shown in FIG. 8, support surface 150 forms a top surface of second post 146. Lid 104 abuts and rests on support surface 150 of second post 146 when lid 104 is placed on base 102. As such, support surfaces 150 and second posts 146 provide support for lid 104 when lid 104 is placed on base 102.

Base 102 of egg tray 100 further includes ribs 152 having ledges 154. One rib 152 is shown in cross-section in FIG. 8. As shown in FIG. 8, ledge 154 forms a top of rib 152. Lid 104 abuts and rests on ledge 154 of rib 152 when lid 104 is placed on base 102. As such, ledges 154 and ribs 152 provide support for lid 104 when lid 104 is placed on base 102.

Base 102 of egg tray 100 further includes rim 156 having ridges 158 and undercuts 160. One ridge 158 is shown in cross-section in FIG. 8. As shown in FIG. 8, undercut 160 forms a lip on ridge 158. Undercut 160 of ridge 158 sits on top of lid 104 when lid 104 is placed on base 102.

As shown in FIG. 8, support surfaces 150 of second posts 146 are in the same plane as ledges 154 of ribs 152. This allows lid 104 to be supported by support surfaces 150 of second posts 146 and ledges 154 of ribs 152 when lid 104 is placed on base 102. Support surfaces 150 of second posts 146 and ledges 154 of ribs 152 work together to provide support for lid 104 when lid 104 is placed on base 102. In particular, as pressure is placed on a top of lid 104 to snap lid 104 onto base 102, support surfaces 150 of second posts 146 and ledges 154 of ribs 152 provide a stop upon which lid 104 will reach.

Further, undercuts 148 on first posts 144 and undercuts 160 on ridges 158 work together to snap lid 104 onto base 102. Undercuts 148 on first posts 144 and undercuts 160 on ridges 158 engage lid 104 and ensure that lid 104 remains in place on base 102.

Lid 104 is releasably engaged with base 102. Lid 104 can easily be placed onto base 102 and removed from base 102. Some egg carton designs include a film sealed onto a base after eggs are placed in the egg carton. This can require additional equipment to seal the film onto the base. Further, once the film is removed it cannot be easily re-adhered to the base. In contrast, lid 104 can be easily placed onto and removed from base 102. Lid 104 can be easily snapped onto base 102 in an egg packing facility, without the need for any bonding agents or sealing of different parts to close egg tray 100. Further, an end user can remove lid 104, remove eggs from egg tray 100, and place lid 104 back onto base 102 to store any remaining eggs.

Figure 9:
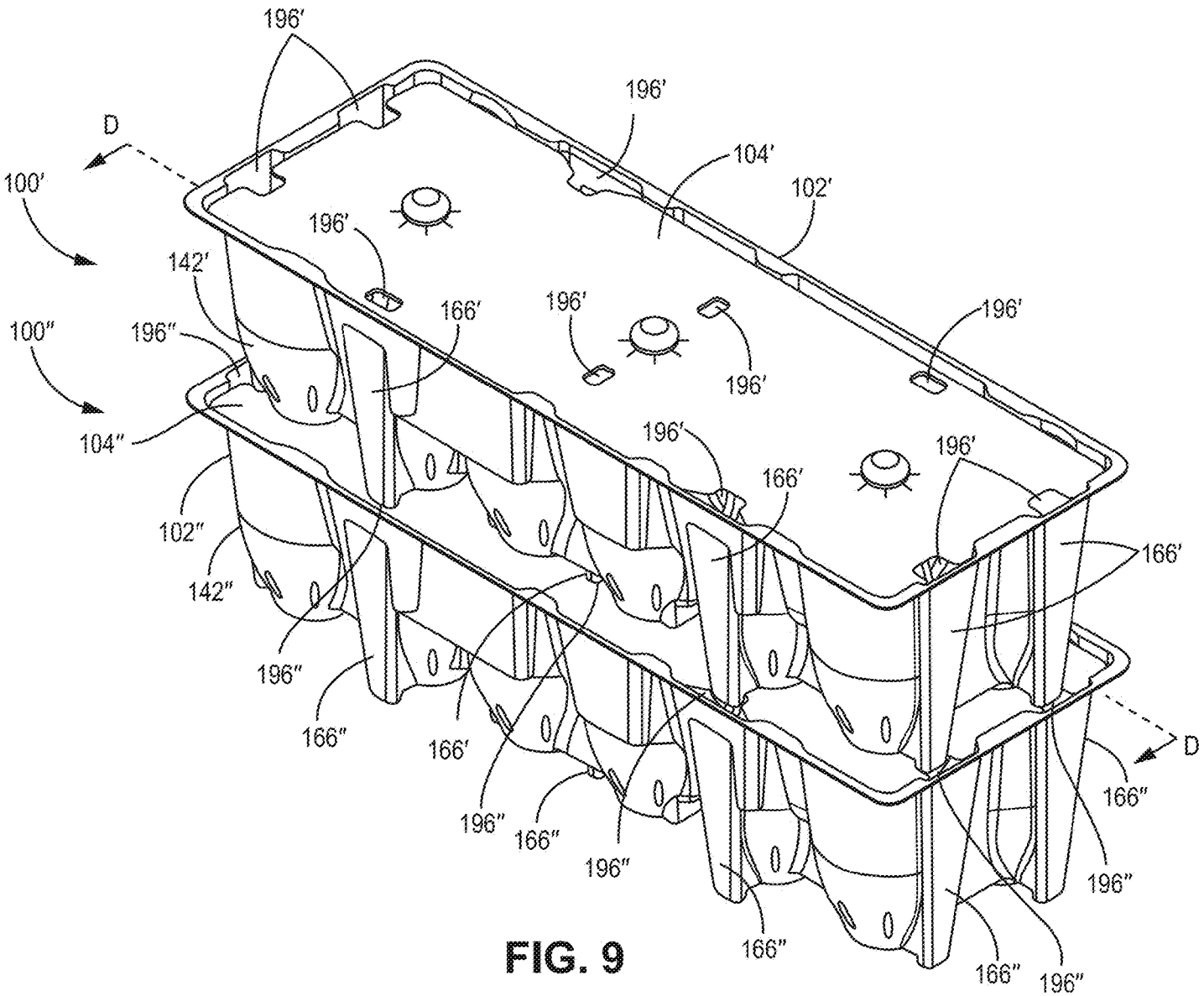
FIG. 9 is an isometric view of two egg trays of the first embodiment of the egg tray stacked together with a lid.

FIG. 9 is an isometric view of two egg trays 100 stacked together. FIG. 9 shows egg tray 100' and egg tray 100". Egg tray 100' includes base 102' and lid 104'. Base 102' includes cells 142' and stacking columns 166'. Lid 104' includes cutouts 196'. Egg tray 100" includes base 102" and lid 104". Base 102" includes cells 142" and stacking columns 166". Lid 104" includes cutouts 196".

Egg tray 100' and egg tray 100" have the structure and design as discussed above in reference to FIGS. 1-8. As shown in FIG. 9, egg tray 100' and egg tray 100" can be stacked together. Egg tray 100' is stacked on top of egg tray 100" in FIG. 9. Stacking columns 166' of egg tray 100' are positioned in cutouts 196" of lid 104" of egg tray 100". Stacking columns 166' extend down below a bottom of cells 142' of base 102' of egg tray 100' to allow stacking columns 166' of egg tray 100' to sit into cutouts 196" of lid 104" of egg tray 100". The bottoms of cells 142' of egg carton 100' will rest on a top of lid 104" of egg tray 100". When stacking columns 166' of egg carton 100' are engaged in cutouts 196" of lid 104", egg carton 100' will be prevented from sliding sideways. Stacking columns 166' and cutouts 196" help to hold egg carton 100' in a secure position on egg carton 100".

Figure 10:
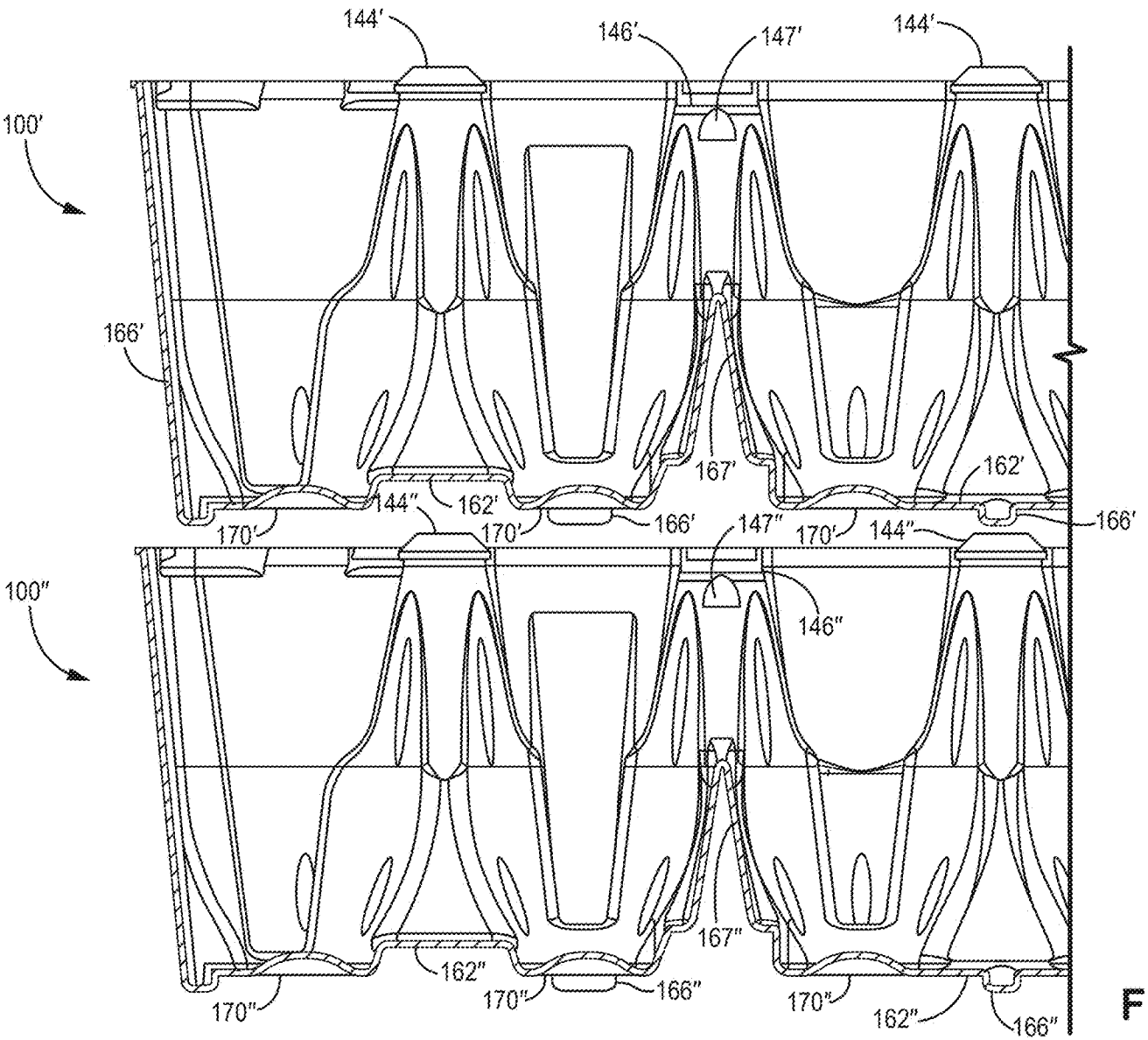
FIG. 10. is a side cross-sectional view of a first portion of two egg trays of the first embodiment of the egg tray to be stacked taken along line D-D of FIG. 9.

FIG. 10 is a side cross-sectional view of a first portion of two egg trays of the first embodiment of the egg tray to be stacked taken along line D-D of FIG. 9. FIG. 9 shows egg tray 100' and egg tray 100". Egg tray 100' includes base 102'. Base 102' includes cells 142', first posts 144', second posts 146', denest features 147', support members 162', stacking columns 166', dividers 167', and dimples 170'. Egg tray 100" includes base 102". Base 102" includes cells 142", first posts 144", second posts 146", denest features 147", support members 162", stacking columns 166", dividers 167", and dimples 170".

Egg tray 100' and egg tray 100" have the structure and design as discussed above in references to FIGS. 1-9. Base 102' of egg tray 100' and base 102" of egg tray 100' can be stacked together (without a lid) for easy shipping and storage prior to lids being placed on either of base 102' and base 102". Base 102' and base 102" are shown aligned with one another in FIG. 10 to illustrate how base 102' and base 102" can be nested together to stack base 102' and base 102".

When base 102' is stacked on top of base 102", first posts 144' can stack on top of first posts 144" such that first posts 144' contact first posts 144", and second posts 146' can stack on top of second posts 146" such that second posts 146' contact second posts 146". In the stacking arrangement shown in FIG. 10, denest features 147' can stack on top of denest features 147" such that denest features 147' contact denest features 147". Alternatively, base 102' and base 102" can be alternately stacked so that denest feature 147' and denest feature 147" face alternate directions when base 102' and base 102" are stacked together.

Similarly, support members 162' can stack on top of support members 162" such that support members 162' contact support members 162" and stacking columns 166' can stack on top of stacking columns 166" such that stacking columns 166' contact stacking columns 166". Similarly, dividers 167' can stack on top of dividers 167" such that dividers 167' contact dividers 167" and dimples 170' can stack on top of dimples 170" such that dimples 170' contact dimples 170". This allows for easy stacking of base 102' and base 102" (and any suitable number of bases) for easy shipping and storage. Base 102' and base 102" can also be easily removed from one another when being filled with eggs in an egg packing facility.

Any number of egg trays 100 can be stacked together. Being able to stack numerous egg trays 100 is important for shipping and distribution of egg trays 100. Egg trays 100 can be packaged in a corrugated case or reusable plastic crate or stacked on a pallet at an egg processing facility and then shipped to stores for sale to users. Further, egg trays 100 can be securely stacked on one another on a store shelf.

Figure 11:
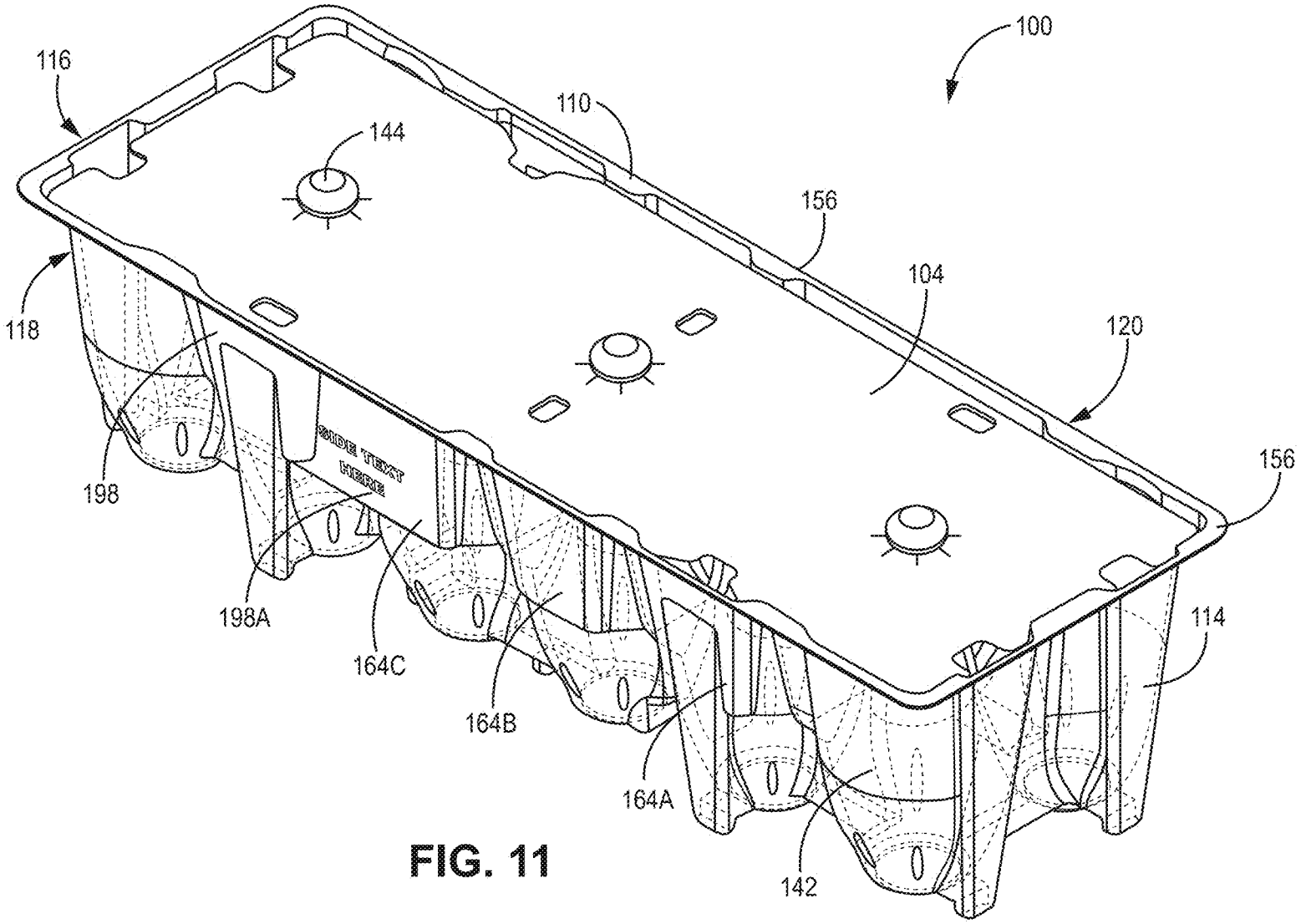
FIG. 11 is an isometric view of the first embodiment of the egg tray with the base shown as being transparent.

FIG. 11 is an isometric view of egg tray 100 with base 102 shown as being transparent. Egg tray 100 includes base 102 and lid 104. Egg tray 100 has top 110, bottom 112, first end 114, second end 116, first side 118, and second side 120. Base 102 includes cells 142, first posts 144, rim 156, and vents 164. Lid 104 includes flaps 198.

Egg tray 100 has the structure and design as discussed above in reference to FIGS. 1-10. FIG. 11 shows base 102 as being transparent. Vent 164A, vent 164B, and vent 164C, as discussed above in reference to FIGS. 3A-5, are labeled in FIG. 11. Flap 198A, as discussed above in reference to FIGS. 6A-6B, is labeled in FIG. 11.

As shown in FIG. 11, flap 198A can be positioned in base 102 in the gap formed by vent 164C. Flap 198A is integrally formed with lid 104 and is folded to fit in vent 164C in the embodiment shown in FIG. 11. In alternate embodiments, egg tray 100 can include a label that can be a separate component that can be slid into vent 164C. Vent 164C on first side 118 of egg carton 100 and vent 164D (shown in FIG. 3C) on second side 120 of egg carton 100 span two adjacent cells 142 to provide a bigger area that can receive flaps 198. Base 102 is typically made of a transparent plastic material, thus flap 198A and flap 198B positioned in vent 164C and vent 164D, respectively, will be visible to a user.

Lid 104 is made out of a paper material that is capable of being printed on prior to assembly of egg tray 100. For example, lid 104 can be made from laminated corrugated cardboard, paper paperboard, film, polyethylene terephthalate (PETE), or polypropylene (PP). Lid 104 can be made out of a recycled material. A top surface of lid 104 can be printed on to display information on a top of egg tray 100. Further, a bottom surface of lid 104 can be printed on to display information that a user can view after removing lid 104 from base 102. Flaps 198 can be printed to display information on a side of egg tray 100 through base 102. As shown in FIG. 11, flap 198A includes the text "SIDE TEXT HERE" to show how the text printed on flaps 198 can be shown through base 102. Flaps 198 allow information to be displayed to a potential purchaser when egg trays 100 are stacked on top of one another.

Egg Tray 200

FIG. 12A is an isometric view of a second embodiment of an egg tray. FIG. 12B is an isometric exploded view of the second embodiment of an egg tray. FIG. 12A and FIG. 12B will be discussed together. Egg tray 200 includes base 202 and lid 204. Egg tray 200 has top 210 (shown in FIG. 12A), bottom 212 (shown in FIG. 12A), first end 214 (shown in FIG. 12A), second end 216 (shown in FIG. 12A), first side 218 (shown in FIG. 12A), and second side 220 (shown in FIG. 12A). Base 202 includes top 230 (shown in FIG. 12B), bottom 232 (shown in FIG. 12B), first end 234 (shown in FIG. 12B), second end 236 (shown in FIG. 12B), first side 238 (shown in FIG. 12B), second side 240 (shown in FIG. 12B), cells 242, first posts 244, second posts 246 (shown in FIG. 12B), undercuts 248, chamfers 249, support surfaces 250 (shown in FIG. 12B), ribs 252 (shown in FIG. 12B), ledges 254 (shown in FIG. 12B), rim 256, ridges 258, undercuts 260, support members 262, vents 264, stacking columns 266, sets of projections 268, and dimples 270. Lid 204 includes top 280 (shown in FIG. 12B), bottom 282 (shown in FIG. 12B), first end 284 (shown in FIG. 12B), second end 286 (shown in FIG. 12B), first side 288 (shown in FIG. 12B), second side 290 (shown in FIG. 12B), openings 292, slits 294, cutouts 296, and flaps 298 (shown in FIG. 12B).

Egg tray 200 has the same general structure and design as egg tray 100 shown in FIGS. 1-11 but with some different features. The reference numerals that refer to the parts of egg tray 200 are incremented by one-hundred compared to the reference numerals that refer to the parts of egg tray 100 shown in FIGS. 1-11.

Egg tray 200 includes base 202 and lid 204 that fits onto base 202. Lid 204 is removably engaged with base 202 to open and close egg tray 200. Egg tray 200 is configured to receive eggs. Eggs sit fully within base 202, and lid 204 is positioned on base 202 to retain the eggs in egg tray 200. Egg tray 200 is sized to hold twelve eggs in the embodiment shown in FIGS. 12A-12B, similar to a traditional twelve-count egg carton. Egg tray 200 can be sized to receive any number of eggs in alternate embodiments, for example egg tray 500 shown in FIG. 15A-15B is sized to hold 18 eggs, egg tray 600 shown in FIG. 16A-16B is sized to hold 24 eggs, and egg tray 700 shown in FIGS. 17A-17B is sized to hold 6 eggs.

Egg tray 200 includes top 210, bottom 212, first end 214, second end 216, first side 218, and second side 220. Top 210 is opposite bottom 212; first end 214 is opposite second end 216; and first side 218 is opposite second side 220. Egg tray 200 is substantially rectangular shaped.

Base 202 includes top 230, bottom 232, first end 234, second end 236, first side 238, and second side 240. Top 230 is opposite bottom 232; first end 234 is opposite second end 236; and first side 238 is opposite second side 240. Base 202 is substantially rectangular shaped. Base 202 forms a housing portion of egg tray 200 that is configured to receive and hold eggs. Base 202 is manufactured using a thermoforming process. Base 202 can be made with a thermoformed plastic, for example polyethylene terephthalate (PETE) or polypropylene. In some embodiments, base 202 can be made out of a recycled PETE material or any other recycled material. Further, in some embodiments, base 202 can be made out of polylactic acid (PLA) or polyhydroxyalkanoates (PHA), which are compostable/renewable plastic materials. Alternatively, base 202 can be made with injection molding. In further alternate embodiments, base 202 can be made out of a paper material. When base 202 is made out of plastic, it can be made out of a transparent plastic. This allows a purchaser of egg tray 200 to view the eggs packaged in egg tray 200 and confirm the eggs are not cracked or otherwise damaged.

Egg tray 200 is one example of an alternate embodiment of egg tray 100. Egg tray 200 does not include denest features 147, support member 162D, support member 162F, support member 162I, support member 162K, dividers 167, cutout 196I, and cutout 196J. Egg tray 200 can include denest features 147, undercuts 148 on first posts 144, support member 162D, support member 162F, support member 162I, support member 162K, dividers 167, cutout 196I, and cutout 196J in alternate embodiments.

Egg Tray 300

FIG. 13 is an isometric view of egg tray 300. Egg tray 300 includes base 302 and lid 304. Base 302 includes top 330, bottom 332, first end 334, second end 336, first side 338, second side 340, cells 342, first posts 344, second posts 346, undercuts 348, chamfers 349, support surfaces 350, ribs 352, ledges 354, rim 356, ridges 358, undercuts 360, support members 362, vents 364, stacking columns 366, sets of projections 368, and dimples 370. Lid 304 includes top 380, bottom 382, first end 384, second end 386, first side 388, second side 390, openings 392, and finger cuts 399.

Egg tray 300 has the same general structure and design as egg tray 200 shown in FIGS. 12A-12B. The reference numerals that refer to the parts of egg tray 300 are incremented by one-hundred compared to the reference numerals that refer to the parts of egg tray 200 shown in FIGS. 12A-12B.

Egg tray 300 is one example of an alternate embodiment of egg tray 200. Egg tray 300 is a twelve-count egg carton. Egg tray 300 has two additional vents 364 compared to egg tray 200. Egg tray 300 has eight vents 364 compared to egg tray 200 which has six vents 364. Egg tray 300 does not include any vents 364 that span adjacent cells 364. Additionally, lid 304 does not include flaps, slits, or cutouts on lid 304, however egg tray 300 can include flaps, slits, or cutouts on lid 304 in alternate embodiments. Egg tray 300 includes finger cuts 399 that a user can use to remove lid 304 from base 302. When a user does not require printing or labeling on the side, egg tray 300 can be used.

Egg Tray 400

FIG. 14A is an isometric view of egg tray 400. FIG. 14B is an isometric exploded view of egg tray 400. FIGS. 14A-14B will be discussed together. Egg tray 400 includes base 402 and lid 404. Egg tray 400 has top 410 (shown in FIG. 14A), bottom 412 (shown in FIG. 14A), first end 414 (shown in FIG. 14A), second end 416 (shown in FIG. 14A), first side 418 (shown in FIG. 14A), and second side 420 (shown in FIG. 14A). Base 402 includes top 430 (shown in FIG. 14B), bottom 432 (shown in FIG. 14B), first end 434 (shown in FIG. 14B), second end 436 (shown in FIG. 14B), first side 438 (shown in FIG. 14B), second side 440 (shown in FIG. 14B), cells 442, first posts 444, second posts 446 (shown in FIG. 14B), undercuts 448, chamfers 449, support surfaces 450 (shown in FIG. 14B), ribs 452 (shown in FIG. 14B), ledges 454 (shown in FIG. 14B), rim 456, ridges 458, undercuts 460, vents 464, sets of projections 468, and dimples 470. Lid 404 includes top 480 (shown in FIG. 14B), bottom 482 (shown in FIG. 14B), first end 484 (shown in FIG. 14B), second end 486 (shown in FIG. 14B), first side 488 (shown in FIG. 14B), second side 490 (shown in FIG. 14B), openings 492, and finger cuts 499.

Egg tray 400 has the same general structure and design as egg tray 200 shown in FIGS. 12A-12B. The reference numerals that refer to the parts of egg tray 400 are incremented by two-hundred compared to the reference numerals that refer to the parts of egg tray 200 shown in FIGS. 12A-12B.

Egg tray 400 is a second example of an alternate embodiment of egg tray 200. Egg tray 400 is a twelve-count egg carton. Egg tray 400 does not include support members or stacking columns on base 402. Further, egg tray 400 does not include slits or cutouts on lid 404, however egg tray 400 can include slits and cutouts on lid 404 in alternate embodiments. Egg tray 400 includes finger cuts 499 that a user can use to remove lid 404 from base 402.

Egg Tray 500

FIG. 15A is an isometric view of egg tray 500. FIG. 15B is an isometric exploded view of egg tray 500. FIGS. 15A-15B will be discussed together. Egg tray 500 includes base 502 and lid 504. Egg tray 500 has top 510 (shown in FIG. 15A), bottom 512 (shown in FIG. 15A), first end 514 (shown in FIG. 15A), second end 516 (shown in FIG. 15A), first side 518 (shown in FIG. 15A), and second side 520 (shown in FIG. 15A). Base 502 includes top 530 (shown in FIG. 15B), bottom 532 (shown in FIG. 15B), first end 534 (shown in FIG. 15B), second end 536 (shown in FIG. 15B), first side 538 (shown in FIG. 15B), second side 540 (shown in FIG. 15B), cells 542, first posts 544, second posts 546 (shown in FIG. 15B), denest features 547, undercuts 548, chamfers 549, support surfaces 550 (shown in FIG. 15B), ribs 552 (shown in FIG. 15B), ledges 554 (shown in FIG. 15B), rim 556, ridges 558, undercuts 560, support members 562, vents 564, stacking columns 566, dividers 567, sets of projections 568, and dimples 570. Lid 504 includes top 580 (shown in FIG. 15B), bottom 582 (shown in FIG. 15B), first end 584 (shown in FIG. 15B), second end 586 (shown in FIG. 15B), first side 588 (shown in FIG. 15B), second side 590 (shown in FIG. 15B), openings 592, slits 594, cutouts 596, and flaps 598 (shown in FIG. 15B).

Egg tray 500 has the same general structure and design as egg tray 200 shown in FIGS. 12A-12B. The reference numerals that refer to the parts of egg tray 500 are incremented by three-hundred compared to the reference numerals that refer to the parts of egg tray 200 shown in FIGS. 12A-12B.

Egg tray 500 is a third example of an alternate embodiment of egg tray 200. Egg tray 500 is an eighteen-count egg carton. Egg tray 500 includes eighteen cells 542 that are configured to receive eighteen eggs. Egg tray 500 includes six first posts 544 and four second posts 546.

First posts 444 include first post 544A, first post 544B, first post 544C, first post 544D, first post 544E, and first post 544F, which are labeled in FIGS. 15A-15B. First post 544A and first post 544B are positioned next to one another adjacent first end 514 of egg tray 500; first post 544C and first post 544D are positioned next to one another in the middle of egg tray 500; and first post 544E and first post 544F are positioned next to one another adjacent second end 516 of egg tray 500.

Second posts 546 include second post 546A, second post 546B, second post 546C, and second post 546D, which are labeled in FIG. 15B. Second post 546A and second post 546B are positioned next to one another in the first end of egg tray 500; and second post 546C and second post 546D are positioned next to one another in the second end of egg tray 500. More specifically, second post 546A is between first post 544A and first post 544C; second post 546B is between first post 544B and first post 544D; second post 546C is between first post 544C and first post 544E; and second post 546D is between first post 544D and first post 544F.

Egg tray 500 has first posts 544 and second posts 546 arranged in an alternating pairs extending from first end 514 to second end 516 of egg tray 500. Egg tray 500 having eighteen cells 542 can have first posts 544 and second posts 546 arranged in any suitable arrangement in alternate embodiments. Egg tray 500 can also include denest features 547 and dividers 567 arranged in any suitable arrangement in alternative embodiments.

Egg Tray 600

FIG. 16A is an isometric view of egg tray 600. FIG. 16B is an isometric exploded view of egg tray 600. FIGS.

16A-16B will be discussed together. Egg tray 600 includes base 602 and lid 604. Egg tray 600 has top 610 (shown in FIG. 16A), bottom 612 (shown in FIG. 16A), first end 614 (shown in FIG. 16A), second end 616 (shown in FIG. 16A), first side 618 (shown in FIG. 16A), and second side 620 (shown in FIG. 16A). Base 602 includes top 630 (shown in FIG. 16B), bottom 632 (shown in FIG. 16B), first end 634 (shown in FIG. 16B), second end 636 (shown in FIG. 16B), first side 638 (shown in FIG. 16B), second side 640 (shown in FIG. 16B), cells 642, first posts 644, second posts 646 (shown in FIG. 16B), denest features 647, undercuts 648, chamfers 649, support surfaces 650, ribs 652 (shown in FIG. 16B), ledges 654 (shown in FIG. 16B), rim 656, ridges 658, undercuts 660, support members 662, vents 664, stacking columns 666, dividers 667, sets of projections 668, and dimples 670. Lid 604 includes top 680 (shown in FIG. 16B), bottom 682 (shown in FIG. 16B), first end 684 (shown in FIG. 16B), second end 686 (shown in FIG. 16B), first side 688 (shown in FIG. 16B), second side 690 (shown in FIG. 16B), openings 692, slits 694, cutouts 696, and flaps 698 (shown in FIG. 16B).

Egg tray 600 has the same general structure and design as egg tray 200 shown in FIGS. 12A-12B. The reference numerals that refer to the parts of egg tray 600 are incremented by four-hundred compared to the reference numerals that refer to the parts of egg tray 200 shown in FIGS. 12A-12B.

Egg tray 600 is a fourth example of an alternate embodiment of egg tray 200. Egg tray 600 is a twenty-four-count egg carton. Egg tray 600 includes twenty-four cells 642 that are configured to receive twenty-four eggs. Egg tray 600 includes nine first posts 644 and six second posts 646.

First posts 644 include first post 644A, first post 644B, first post 644C, first post 644D, first post 644E, first post 644F, first post 644G, first post 644H, and first post 644I, which are labeled in FIGS. 16A-16B. First post 644A, first post 644B, and first post 644C are positioned next to one in a row another adjacent first end 614 of egg tray 600; first post 644D, first post 644E, and first post 644F are positioned next to one another in a row in the middle of egg tray 600; and first post 644G, first post 644H, and first post 644I are positioned next to one another in a row adjacent second end 616 of egg tray 600.

Second posts 646 include second post 646A, second post 646B, second post 646C, second post 646D, second post 646E, and second post 646F, which are labeled in FIG. 16B. Second post 646A, second post 646B, and second post 646C are positioned next to one another in a row in the first end of egg tray 600; and second post 646D, second post 646E, and second post 646F are positioned next to one another in a row in the second end of egg tray 600. More specifically, second post 646A is between first post 644A and first post 644D; second post 646B is between first post 644B and first post 644E; second post 646C is between first post 644C and first post 644F; second post 646D is between first post 644D and first post 644G; second post 646E is between first post 644E and first post 644H, and second post 646F is between first post 644F and first post 644I.

Egg tray 600 has first posts 644 and second posts 646 arranged in an alternating rows of three extending from first end 614 to second end 616 of egg tray 600. Egg tray 600 having twenty-four cells 642 can have first posts 644 and second posts 646 arranged in any suitable arrangement in alternate embodiments. Egg tray 500 can also include denest features 547 and dividers 567 arranged in any suitable arrangement in alternative embodiments.

Egg Tray 700

FIG. 17A is an isometric view of egg tray 700. FIG. 17B is an isometric exploded view of egg tray 700. FIGS. 17A-17B will be discussed together. Egg tray 700 includes base 702 and lid 704. Egg tray 700 has top 710 (shown in FIG. 17A), bottom 712 (shown in FIG. 17A), first end 714 (shown in FIG. 17A), second end 716 (shown in FIG. 17A), first side 718 (shown in FIG. 17A), and second side 720 (shown in FIG. 15A). Base 702 includes top 730 (shown in FIG. 17B), bottom 732 (shown in FIG. 17B), first end 734 (shown in FIG. 17B), second end 736 (shown in FIG. 17B), first side 738 (shown in FIG. 17B), second side 740 (shown in FIG. 17B), cells 742, first posts 744, undercuts 748, chamfers 749, ribs 752 (shown in FIG. 17B), ledges 754 (shown in FIG. 17B), rim 756, ridges 758, undercuts 760, support members 762, vents 764, stacking columns 766, sets of projections 768, and dimples 770. Lid 704 includes top 780 (shown in FIG. 17B), bottom 782 (shown in FIG. 17B), first end 784 (shown in FIG. 17B), second end 786 (shown in FIG. 17B), first side 788 (shown in FIG. 17B), second side 790 (shown in FIG. 17B), openings 792, slits 794, and cutouts 796.

Egg tray 700 has the same general structure and design as egg tray 200 shown in FIGS. 12A-12B. The reference numerals that refer to the parts of egg tray 700 are incremented by five-hundred compared to the reference numerals that refer to the parts of egg tray 200 shown in FIGS. 12A-12B.

Egg tray 700 is a fifth example of an alternate embodiment of egg tray 200. Egg tray 700 is a six-count egg carton. Egg tray 700 includes six cells 742 that are configured to receive six eggs. Further, egg tray 700 does not include second posts having support surfaces on base 702.

Egg Tray 800

FIG. 18A is an isometric view of egg tray 800. FIG. 18B is an isometric exploded view of egg tray 800. FIGS. 18A-18B will be discussed together. Egg tray 800 includes base 802 and lid 804. Egg tray 800 has top 810 (shown in FIG. 18A), bottom 812 (shown in FIG. 18A), first end 814 (shown in FIG. 18A), second end 816 (shown in FIG. 18A), first side 818 (shown in FIG. 18A), and second side 820 (shown in FIG. 18A). Base 802 includes top 830 (shown in FIG. 18B), bottom 832 (shown in FIG. 18B), first end 834 (shown in FIG. 18B), second end 836 (shown in FIG. 18B), first side 838 (shown in FIG. 18B), second side 840 (shown in FIG. 18B), cells 842, second posts 846 (shown in FIG. 18B), support surfaces 850 (shown in FIG. 18B), ribs 852 (shown in FIG. 18B), ledges 854 (shown in FIG. 18B), rim 856, ridges 858, undercuts 860, support members 862, vents 864, stacking columns 866, sets of projections 868, and dimples 870. Lid 804 includes top 880 (shown in FIG. 18B), bottom 882 (shown in FIG. 18B), first end 884 (shown in FIG. 18B), second end 886 (shown in FIG. 18B), first side 888 (shown in FIG. 18B), second side 890 (shown in FIG. 18B), and cutouts 896.

Egg tray 800 has the same general structure and design as egg tray 200 shown in FIGS. 12A-12B. The reference numerals that refer to the parts of egg tray 800 are incremented by six-hundred compared to the reference numerals that refer to the parts of egg tray 200 shown in FIGS. 12A-12B.

Egg tray 800 is a seventh example of an alternate embodiment of egg tray 200. Egg tray 800 is a twelve-count egg carton. Egg tray 800 does not include first posts having undercuts and chamfers on base 802. Further, egg tray 800 does not include openings or cutouts on lid 804.

In the embodiment shown in FIGS. 18A-18B, egg tray 800 includes second posts 846 that support lid 804. In alternate embodiments, egg tray 800 can not include second posts 846 and/or cells 842, allowing egg tray 800 to have a larger opening in base 802. In these embodiments, egg tray 800 can be used for packaging anything, for example any type of greens.

Egg Processing Assembly Line 900

FIG. 19 is a schematic view of egg processing assembly line 900. Egg processing assembly line 900 includes conveyor belt 902, egg packing assembly 904, lid placing assembly 906, and tray loading assembly 908.

Egg processing assembly line 900 shown in FIG. 19 is one example of an egg processing assembly line that can be used to pack eggs into egg trays, place a lid on each egg tray, and load the egg trays into a box or onto a pallet for shipping. In alternate embodiments, egg processing assembly line 800 can include different components, additional components, or fewer components, and the components can be arranged in any manner.

Egg processing assembly line 900 includes conveyor belt 902 that extends from egg packing assembly 904, through lid placing assembly 906, and to tray loading assembly 908. Conveyor belt 902 is shown as being at an incline in FIG. 19, having a lower height at egg packing assembly 904 and having a higher height at tray loading assembly 908. In alternate embodiments, conveyor belt 902 can be at a constant height (i.e., does not have an incline) or can have a higher height at egg packing assembly 904 and a lower height at tray loading assembly 906.

Egg packing assembly 904 is shown schematically in FIG. 19, but can include any assembly for packing eggs into egg trays, for example any of egg trays 100, 200, 300, 400, 500, 600, 700, and 800 as shown in FIGS. 1-18B. More specifically, egg packing assembly 904 can pack the eggs into any of bases 102, 202, 302, 402, 502, 602, 702, and 802 of egg trays 100, 200, 300, 400, 500, 600, 700, and 800, respectively, as shown in FIGS. 1-18B. Egg packing assembly 902 can include equipment that is traditionally used in egg packing facilities for packing eggs into traditional egg cartons. The eggs can be washed prior to entering egg packing assembly 904 for packing into egg trays using any suitable equipment for washing the eggs.

Lid placing assembly 906 is shown schematically in FIG. 19, but can include any assembly for placing lids onto egg trays. For example, lid placing assembly 906 can be used to place lids 104, 204, 304, 404, 504, 604, 704, and 804 onto egg trays 100, 200, 300, 400, 500, 600, 700, and 800, respectively, as shown in FIGS. 1-18B. Examples of lid placing assembly 906 are discussed in reference to FIGS. 20A-23C below.

Tray loading assembly 908 is positioned at an end of egg processing assembly line 900. Tray loading assembly 908 is shown schematically in FIG. 19, but can include any assembly for loading egg trays into boxes or onto pallets for shipping. For example, tray loading assembly 908 can be used to load any of egg trays 100, 200, 300, 400, 500, 600, 700, and 800, as shown in FIGS. 1-18B, into boxes or onto pallets for shipping. Tray loading assembly 908 can include equipment that is traditionally used in egg packing facilities for loading traditional egg cartons into boxes or onto pallets for shipping.

Lid Placing Assembly 906

FIG. 20A is a perspective view of lid placing assembly 906. FIG. 20B is a top view of lid placing assembly 906. FIG. 20C is a side view of lid placing assembly 906. FIGS. 20A-20C will be discussed together. FIGS. 20A-20C show conveyor belt 902, including infeed end 902A, discharge end 902B, and egg trays 905. Lid placing assembly 906 includes stand 910, casters 912, and robotic assembly 914, which includes enclosure 916, magazine 918, robotic arm 920, and line stops 922.

Conveyor belt 902 extends from infeed end 902A to discharge end 902B. Conveyor belt 902 can be any conveyor belt located in an egg packing facility. Egg trays 905 are placed on conveyor belt 902 and move from infeed end 902A to discharge end 902B. Egg packing assembly 904 as shown in FIG. 19 can be positioned at infeed end 902A to fill egg trays 905 with eggs prior to egg trays 905 advancing along conveyor belt 902. Tray loading assembly 908 as shown in FIG. 19 can be positioned at discharge end 902B to load egg trays 905 into boxes or onto pallets for shipping.

Lid placing assembly 906 can be positioned at conveyor belt 902 to facilitate the placement of lids on egg trays 905 moving along conveyor belt 902. Lid placing assembly 906 can be positioned at conveyor belt 902 at any suitable point between egg packing assembly 904 and tray load assembly 908 as shown in FIG. 19. Lid placing assembly 906 includes stand 910 that forms a frame to support lid placing assembly 906. Stand 910 includes casters 912 attached to a bottom of stand 910 that allow lid placing assembly 906 to be easily pushed to positioned it at conveyor belt 902. In some embodiments, casters 912 can be locked into position after lid placing assembly 906 is positioned at conveyor belt 902. Alternatively, lid placing assembly 906 can be mounted directly to conveyor belt 902.

Stand 910 supports robotic assembly 914, which is positioned at a top of stand 910. Robotic assembly 914 is positioned over conveyor belt 902 when lid placing assembly 906 is positioned at conveyor belt 902. Robotic assembly 914 is used to place lids on egg trays 902 on conveyor belt 902 as they move underneath robotic assembly 914 on conveyor belt 902. Robotic assembly 914 includes enclosure 916 that forms a main body of robotic assembly 914. Robotic assembly 914 further includes magazine 918 that is configured to hold a stack of lids to be placed on egg trays 905. Robotic assembly 914 also includes robotic arm 920 that is used to remove one lid out of magazine 918 to place it on one egg tray 905.

Robotic arm 920 can take a number of different forms. For example, robotic arm 920 can be a reciprocating placer. Robotic arm 920 can include a frame that is moveable between magazine 918 and a top of one egg tray 905 to apply a lid to one egg tray 905. Robotic arm 920 can have a head attached to the moveable frame that is used to remove one lid from magazine 918 to place it on one egg tray 905. The head can remove lids from magazine 918 using any suitable mechanism. In one embodiment, the head can use suction to remove one lid from magazine 918. To place the lid on one egg tray 905, the suction can be removed once the lid is placed on one egg tray 905. In alternate embodiments, lid placing assembly 906 can include an industrial robot arm or a cobot arm to place a lid on egg tray 905.

Robotic assembly 914 can also include line stops 922. Robotic assembly 914 includes two sets of line stops 922 in the embodiment shown in FIGS. 20A-20C, but can include any number of line stops 922 or no line stops in alternate embodiments. Line stops 922 are positioned adjacent conveyor 902 and are configured to stop one egg tray 905 on conveyor belt 902 so that a lid can be placed on the one egg tray 905. When line stops 922 stop one egg tray 905, conveyor 902 can continue to move underneath egg tray 905. Once a lid has been applied to the one egg tray 905 it can advance on conveyor 902 towards discharge end 902B and the next egg tray 905 can be stopped by line stops 922.

Lid placing assembly 906 can include robotic arm 920 having either of head 930 as will be discussed below in reference to FIGS. 21A-21B or head 950 as will be discussed below in reference to FIGS. 22A-22B.

Lid placing assembly 906 allows for the automated placement of lids on egg trays 905. Lid placing assembly 906 can be used to place any of lids 104, 204, 304, 404, 504, 604, 704, and 804 onto bases 102, 202, 302, 402, 502, 602, 702, and 802 of egg trays 100, 200, 300, 400, 500, 600, 700, and 800, respectively, as shown in FIGS. 1-18B. Lid placing assembly 906 also allows egg processing facilities easily adapt to the use of egg trays 100, 200, 300, 400, 500, 600, 700, and 800 shown in FIGS. 1-18B instead of traditional egg cartons, as lid placing assembly 906 can be integrated into and used with existing egg processing assembly line equipment.

Lid placing assembly 906 is shown as placing a lid on a single egg tray 905 at a time in FIGS. 20A-20C. In alternate embodiments, lid placing assembly 906 can be configured to place two or more lids on respective egg trays 905 at a time. In these alternate embodiments, conveyor belt 902 can have a width that accommodates two or more egg trays 905 next to one another. Line stops 922 can be used to stop two or more egg trays 805 on conveyor belt 802 and position the two or more egg trays 905 for placement of lids on the two or more egg trays 905. In these alternate embodiments, lid placing assembly 906 can include two or more magazines 918 and two or more robotic arms 920 to facilitate the placement of lids on egg trays 905.

Head 930 for Robotic Arm 920

FIG. 21A is a schematic side view of head 930 for robotic arm 920. FIG. 21B is a schematic bottom view of head 930 for robotic arm 920. FIGS. 21A-21B will be discussed together. FIGS. 21A-21B schematically show robotic arm 920, which includes head 930 and vacuum source 932 (shown in FIG. 21A). Head 930 includes body 940, lid face 942, openings 944, and suction cups 946.

Robotic arm 920 shown in FIGS. 21A-21B is one example of robotic arm 920 that can form a part of lid placing assembly 906. Robotic arm 920 can include additional components not shown in FIGS. 21A-21B, for example structural components that can move head 930 between magazine 918 and egg tray 905 on conveyor 902, as shown in FIGS. 20A-20C.

Robotic arm 920 includes head 930 that is configured to remove a lid from magazine 918. Head 930 is pneumatically coupled to vacuum source 932. Head 930 includes body 940 that forms the structure of head 930. Lid face 942 forms a bottom of body 940. Lid face 942 is configured to abut a lid to remove a lid from magazine 918 and place the lid on one egg tray 905.

Head 920 also includes openings 944 extending through head 930. Openings 944 are configured to align with posts on one egg tray 905. Head 930 can have any number of openings 944 positioned in any suitable locations to align with any number or location of posts. For example, egg tray 905 can be any of egg trays 100, 200, 300, 400, 500, 600, and 700 shown in FIGS. 1-17B having first posts 144, 244, 344, 444, 544, 644, or 744, respectively. As described in reference to FIGS. 1-17B, first posts 144, 244, 344, 444, 544, 644, or 744 can extend above a ledge of egg trays 100, 200, 300, 400, 500, 600, and 700, respectively. Head 930 includes openings 944 to allow first posts 144, 244, 344, 444, 544, 644, or 744 of egg trays 100, 200, 300, 400, 500, 600, and 700, respectively, to extend into openings 944 when head 930 is placing a lid on egg tray 905. This prevents head 930 from crushing first posts 144, 244, 344, 444, 544, 644, or 744, and prevents first posts 144, 244, 344, 444, 544, 644, or 744 from interfering with the proper placement of a lid on egg tray 905.

Head 930 further includes suction cups 946 positioned in head 930. Suction cups 946 are pneumatically coupled to vacuum source 932. Suction cups 946 are positioned in lid face 942 and are configured to abut a lid. Vacuum source 932 can apply suction to suction cups 946 to suction and hold a lid against lid face 942. Suction cups 946 are configured to apply a constant vacuum across a lid. When robotic arm 930 is positioned at magazine 918, vacuum source 932 can apply suction to suction cups 946 to suction a lid to lid face 942. The suction will hold the lid against lid face 942 as robotic arm 930 is moved away from magazine 918, cause the lid to be pulled out of magazine 918. Robotic arm 930 is then moved to place the lid on one egg tray 905. Robotic arm 930 can press head 930 onto one egg tray 905 to place the lid onto egg tray 905. Once the lid has been placed on egg tray 905, the vacuum applied by vacuum source 932 can be removed so that the lid remains on egg tray 905.

Head 950 for Robotic Arm 920

FIG. 22A is a schematic side view of head 950 for robotic arm 920. FIG. 22B is a schematic bottom view of head 950 for robotic arm 920. FIGS. 22A-22B will be discussed together. FIGS. 22A-22B schematically show robotic arm 920, which includes head 950 and vacuum source 952 (shown in FIG. 22A). Head 950 includes body 960, lid face 962, openings 964, and holes 966.

Robotic arm 920 shown in FIGS. 22A-22B is one example of robotic arm 920 that can form a part of lid placing assembly 906. Robotic arm 920 can include additional components not shown in FIGS. 22A-22B, for example structural components that can move head 950 between magazine 918 and egg tray 905 on conveyor 902, as shown in FIGS. 20A-20C.

Robotic arm 920 includes head 950 that is configured to remove a lid from magazine 918. Head 950 is pneumatically coupled to vacuum source 952. Head 950 includes body 960 that forms the structure of head 950. Lid face 962 forms a bottom of body 960. Lid face 962 is configured to abut a lid to remove a lid from magazine 918 and place the lid on one egg tray 905.

Head 950 also includes openings 964 extending through head 950. Openings 964 are configured to align with posts on one egg tray 905. Head 950 can have any number of openings 964 positioned in any suitable locations to align with any number or location of posts. For example, egg tray 905 can be any of egg trays 100, 200, 300, 400, 500, 600, and 700 shown in FIGS. 1-17B having first posts 144, 244, 344, 444, 544, 644, or 744, respectively. As described in reference to FIGS. 1-17B, first posts 144, 244, 344, 444, 544, 644, or 744 can extend above a ledge of egg trays 100, 200, 300, 400, 500, 600 and 700, respectively. Head 950 includes openings 964 to allow first posts 144, 244, 344, 444, 544, 644, or 744 of egg trays 100, 200, 300, 400, 500, 600, and 700, respectively, to extend into openings 964 when head 950 is placing a lid on egg tray 905. This prevents head 950 from crushing first posts 144, 244, 344, 444, 544, 644, or 744, and prevents first posts 144, 244, 344, 444, 544, 644, or 744 from interfering with the proper placement of a lid on egg tray 905.

Head 950 further includes holes 966 positioned in head 920. Holes 966 are pneumatically coupled to vacuum source 952 through head 950. Holes 966 are positioned in lid face 962 and are configured to abut a lid. Vacuum source 952 can apply suction to holes 966 to suction and hold a lid against lid face 962. Holes 966 are configured to apply a constant vacuum across a lid. When robotic arm 920 is positioned at magazine 918, vacuum source 952 can apply suction to holes 966 to suction a lid to lid face 962. The suction will hold the lid against lid face 962 as robotic arm 920 is moved away from magazine 918, cause the lid to be pulled out of magazine 918. Robotic arm 920 is then moved to place the lid on one egg tray 905. Robotic arm 920 can press head 950 onto one egg tray 905 to place the lid onto egg tray 905. Once the lid has been placed on egg tray 905, the vacuum applied by vacuum source 952 can be removed so that the lid remains on egg tray 905.

Lid Placing Assembly 1006

FIG. 23A is a perspective view of lid placing assembly 1006. FIG. 23B is a top view of lid placing assembly 1006. FIG. 23C is a side view of lid placing assembly 1006. FIGS. 23A-23C will be discussed together. FIGS. 23A-23C show conveyor belt 1002, including infeed end 1002A, discharge end 1002B, supports 1003, and egg trays 1005. Lid placing assembly 1006 includes stand 1010 (shown in FIGS. 23A and 23C), feet 1013 (shown in FIGS. 23A and 23C), and robotic assembly 1014, which includes enclosure 1016, magazine 1018, robotic arm 1020, and line stops 1022.

Lid placing assembly 1006 has a similar design and function as lid placing assembly 1006 shown in FIGS. 20A-20C. Conveyor belt 1002 includes supports 1003 that are configured to support conveyor belt 1002. Further, lid placing assembly 1006 has stand 1010 that includes feet 1013 instead of casters. Lid placing assembly 1006 can be positioned at conveyor belt 1002 by moving stand 1010 into positioned at conveyor belt 1002.

Lid placing assembly 1006 can include robotic arm 1020 having either of head 930 shown in FIGS. 21A-21B or head 950 shown in FIGS. 22A-22B. Alternatively, lid placing assembly 1006 can include robotic arm 1020 have any suitable design and configuration.

Lid placing assembly 1006 allows for the automated placement of lids on egg trays 1005. Lid placing assembly 1006 can be used to place any of lids 104, 204, 304, 404, 504, 604, 704, and 804 onto bases 102, 202, 302, 402, 502, 602, 702, and 802 of egg trays 100, 200, 300, 400, 500, 600, 700, and 800, respectively, as shown in FIGS. 1-18B. Lid placing assembly 1006 also allows egg processing facilities easily adapt to the use of egg trays 100, 200, 300, 400, 500, 600, 700, and 800 shown in FIGS. 1-18B instead of traditional egg cartons, as lid placing assembly 1006 can be integrated into and used with existing egg processing assembly line equipment.

Lid placing assembly 1006 is shown as placing a lid on a single egg tray 1005 at a time in FIGS. 23A-23C. In alternate embodiments, lid placing assembly 1006 can be configured to place two or more lids on respective egg trays 1005 at a time. In these alternate embodiments, conveyor belt 1002 can have a width that accommodates two or more egg trays 1005 next to one another. Line stops 1022 can be used to stop two or more egg trays 1005 on conveyor belt 1002 and position the two or more egg trays 1005 for placement of lids on the two or more egg trays 1005. In these alternate embodiments, lid placing assembly 1006 can include two or more magazines 1018 and two or more robotic arms 1020 to facilitate the placement of lids on egg trays 1005.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An egg tray comprising:

a base comprising:

a plurality of cells;

a plurality of posts surrounded by the plurality of cells, wherein the plurality of posts includes a first post having a first height and a second post having a second height, wherein the first height is greater than the second height, and wherein the first post is separated from the second post by the plurality of cells; and a rim extending around an upper perimeter of the base; and a lid configured to be releasably engaged on the base by snapping the lid onto the base, so that the lid is snapped onto the first post so that the first post extends through the lid and the lid is snapped under the rim of the base, and wherein the lid is configured to rest upon a top most surface of the second post when the lid is placed on the base.

2. The egg tray of claim 1, wherein the first post is configured to extend through the lid when the lid is placed on the base, and wherein the first post has an undercut formed at a top end of the first post to engage the lid when the lid is placed on the base.

3. The egg tray of claim 1, wherein the first post has a chamfer formed along a circumference of a top end of the first post, wherein the chamfer is configured to guide the lid onto the first post when the lid is placed on the base.

4. The egg tray of claim 1, wherein the second post has a flat support surface formed on the top most surface of the second post.

5. The egg tray of claim 1, wherein the lid further comprises:

an opening extending through the lid; and a set of slits that extend through the lid and surround the opening.

6. The egg tray of claim 5, wherein:

the first post is configured to extend through the opening in the lid when the lid is placed on the base, and the first post has an undercut formed at a top end of the first post to engage the area surrounding the opening in the lid when the lid is placed on the base; and the first post has a chamfer formed along a circumference of a top end of the first post, wherein the chamfer is configured to guide the opening in the lid onto the first post when the lid is placed on the base.

7. The egg tray of claim 1, wherein the base further comprises:

a rib extending between adjacent cells of the plurality of cells; and a ledge that forms a top of the rib, wherein the lid is configured to rest upon the ledge when the lid is placed on the base.

8. The egg tray of claim 1, wherein the rim of the base further comprises:

a ridge extending inwards from an outer edge of the rim; and an undercut formed on a bottom of the ridge, wherein the undercut is configured to engage the lid when the lid is placed on the base.

9. The egg tray of claim 1, and further comprising:

a support member extending between adjacent cells of the plurality of cells.

10. The egg tray of claim 1, and further comprising:

a vent extending outward from a side of the base, wherein the vent is configured to allow moisture to escape from the egg tray when the lid is placed on the base; and a gap formed between the base and the lid in the area adjacent the vent.

11. The egg tray of claim 1, and further comprising:

a stacking column extending outwards from a side or an end of the base, wherein a bottom of the stacking column extends lower than bottoms of the plurality of cells of the base.

12. The egg tray of claim 11, wherein the lid further comprises:

a cutout formed in the lid, wherein the cutout of the egg tray is configured to receive a bottom of a stacking column of an adjacent egg tray.

13. The egg tray of claim 1, and further comprising:

a divider separating a first subset of the plurality of cells from a second subset of the plurality of cells.

14. The egg tray of claim 1, and further comprising:

a set of projections formed in a bottom end of one cell of the plurality of cells and projecting inwards, wherein the set of projections are configured to support an egg placed in the base.

15. The egg tray of claim 1, and further comprising:

a dimple formed on a bottom of one cell of the plurality of cells, wherein the dimple extends upwards into the one cell of the plurality of cells, and wherein the dimple is configured to cushion the bottom of an egg placed in the base.

16. The egg tray of claim 1, wherein the base is made from a thermoformed plastic selected from a group consisting of polyethylene terephthalate (PETE), polypropylene, polylactic acid (PLA), polyhydroxyalkanoates (PHA), and combinations thereof.

17. The egg tray of claim 1, wherein the lid is made out of a material selected from the group consisting of paper, laminated corrugated cardboard, paperboard, film, polyethylene terephthalate (PETE), polypropylene (PP), and combinations thereof.

18. The egg tray of claim 1, wherein the base is configured to receive eggs so that the entirety of the eggs sit in the base.

19. The egg tray of claim 1, wherein the lid and the base are made from recycled materials.

* * * * *